US007326328B2

(12) United States Patent
Hudspeth et al.

(10) Patent No.: US 7,326,328 B2
(45) Date of Patent: Feb. 5, 2008

(54) GATED NANOROD FIELD EMITTER STRUCTURES AND ASSOCIATED METHODS OF FABRICATION

(75) Inventors: Heather Diane Hudspeth, Clifton Park, NY (US); Ji Ung Lee, Niskayuna, NY (US); Reed Roeder Corderman, Niskayuna, NY (US); Anping Zhang, Niskayuna, NY (US); Renee Bushey Rohling, Burnt Hills, NY (US); Lauraine Denault, Nassau, NY (US); Joleyn Eileen Balch, Clifton Park, NY (US)

(73) Assignee: General Electric Company, Niskayuna, NY (US)

( * ) Notice: Subject to any disclaimer, the term of this patent is extended or adjusted under 35 U.S.C. 154(b) by 175 days.

(21) Appl. No.: 11/185,004

(22) Filed: Jul. 19, 2005

(65) Prior Publication Data

US 2007/0029911 A1 Feb. 8, 2007

(51) Int. Cl.
*C25D 5/02* (2006.01)

(52) U.S. Cl. ..... 205/118; 313/306; 427/77

(58) Field of Classification Search ..... 313/306, 313/307, 309; 427/77; 205/118
See application file for complete search history.

(56) References Cited

U.S. PATENT DOCUMENTS

| | | | | |
|---|---|---|---|---|
| 3,665,241 | A | 5/1972 | Spindt et al. | 313/351 |
| 3,755,704 | A | 8/1973 | Spindt et al. | 313/309 |
| 3,812,559 | A | 5/1974 | Spindt et al. | 29/25.18 |
| 5,229,331 | A | 7/1993 | Doan et al. | 437/228 |
| 5,266,530 | A | 11/1993 | Bagley et al. | 437/228 |
| 5,372,973 | A | 12/1994 | Doan et al. | 437/228 |
| 6,339,281 | B2 * | 1/2002 | Lee et al. | 313/309 |
| 6,391,670 | B1 | 5/2002 | Wells et al. | 438/20 |
| 6,394,871 | B2 | 5/2002 | Lee | 445/24 |
| 6,650,061 | B1 * | 11/2003 | Urayama et al. | 315/169.3 |
| 2003/0143398 | A1 | 7/2003 | Ohki et al. | |

(Continued)

FOREIGN PATENT DOCUMENTS

EP 1146541 A2 10/2001

(Continued)

OTHER PUBLICATIONS

G. Pirio et al., "Fabrication and electrical Characteristics of Carbon Nanotube Field Emission Microcathodes With An Integrated Gate Electrode", Institute of Physics Publishing, Nanotechnology, vol. 13, pp. 1-4, 2002.

(Continued)

*Primary Examiner*—Nam Nguyen
*Assistant Examiner*—Luan V. Van
(74) *Attorney, Agent, or Firm*—Paul J. DiConza; William E. Powell, III

(57) ABSTRACT

The present invention relates to gated nanorod field emission devices, wherein such devices have relatively small emitter tip-to-gate distances, thereby providing a relatively high emitter tip density and low turn on voltage. Such methods employ a combination of traditional device processing techniques (lithography, etching, etc.) with electrochemical deposition of nanorods. These methods are relatively simple, cost-effective, and efficient; and they provide field emission devices that are suitable for use in x-ray imaging applications, lighting applications, flat panel field emission display (FED) applications, etc.

25 Claims, 44 Drawing Sheets

U.S. PATENT DOCUMENTS

2005/0067935 A1 3/2005 Lee et al.

FOREIGN PATENT DOCUMENTS

| | | |
|---|---|---|
| JP | 2001-250469 | 9/2001 |
| WO | WO01/62665 A1 | 8/2001 |
| WO | WO 2004/012218 | 2/2004 |
| WO | WO 2004/064101 | 7/2004 |
| WO | WO2005051842 A2 | 6/2005 |

OTHER PUBLICATIONS

K. B. K. Teo et al., "Fabrication and Electrical Characteristics of Carbon Nanotube-based Microcathodes for Use in a Parallel Electron-Beam Lithography System", J. Va. Sci. Technol. B, vol. 21 (2), American Vacuum Society, pp. 693-697, 2003.
Search Report—Nov. 24, 2006.
CA Spindt, "A thin-Film Field-Emission Cathode", J. Appl. Phys., Communications, vol. 39 (7), pp. 3504-3505, 1968.
H. Masuda et al., "Ordered Metal Nanohole Arrays Made by a Two-Step Replication of Honeycomb Structures of Anodic Alumina", Science, New Series, vol. 268, No. 5216, pp. 1446-1468, 1995.
H. Masuda et al., "Highly Ordered Nanochannel-Array Architecture in Anodic Alumina", Applied Physics Letters, American Institute of Physics, vol. 71 (19), pp. 2770-2772, 1997.
O. Jessensky et al., "Self-Organized formation of Hexagonal Pore Arrays in Anodic Alumina", Applied Physics Letters, American Institute of Physics, vol. 72 (10), pp. 1173-1175, 1998.
AJ Vin et al., "Fabrication of Highly Ordered Metallic Nanowire Arrays By Electrodeposition", Applied Physics Letters, American Institute of Physics, vol. 79 (7), pp. 1039-1041, 2001.
M. Zheng et al., "Fabrication and Structural Characterization of Large-Scale Uniform SnO2 Nanowire Array Embedded in Anodic Alumina Membrane", Chem. Mater., American Chemical Society, vol. 13, pp. 3859-3861, 2001.
Search Report dated Jun. 16, 2007.

* cited by examiner

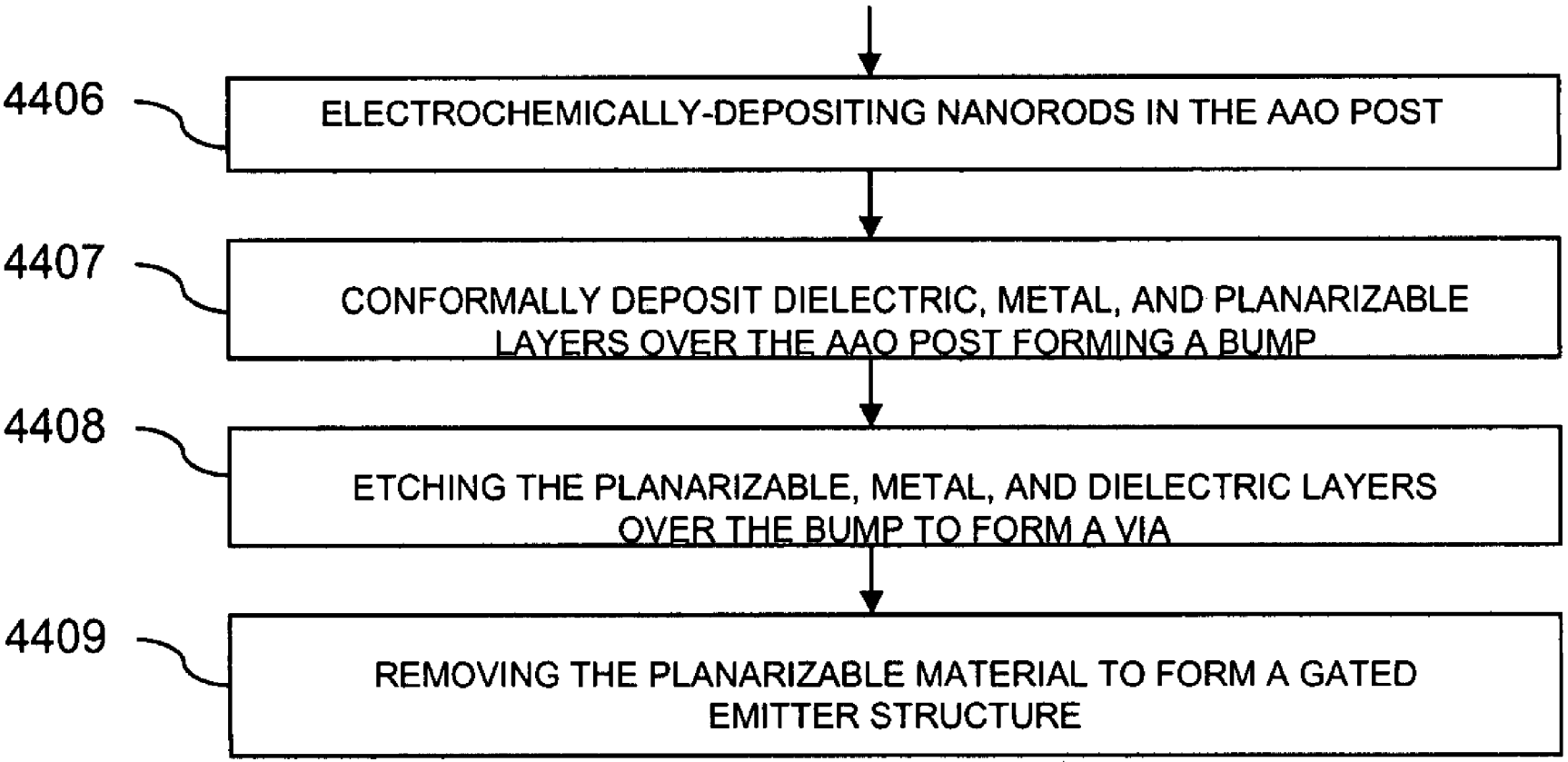
Fig. 44 (con't)

GATED NANOROD FIELD EMITTER STRUCTURES AND ASSOCIATED METHODS OF FABRICATION

This invention was made with support from the United States Department of Commerce, National Institute of Standards and Technology (NIST) Contract No. 70NANB2H3030.

TECHNICAL FIELD

The present invention relates generally to field emission devices that are suitable for use in x-ray imaging applications, lighting applications, flat panel field emission display applications, microwave amplifier applications, electron-beam lithography applications and the like. More specifically, the present invention relates to gated nanorod field emission devices and associated methods of fabrication.

BACKGROUND INFORMATION

Electron emission devices, such as thermionic emitters, cold cathode field emitters and the like, are currently used as electron sources in x-ray tube applications, flat panel field emission display applications, microwave amplifier applications, electron-beam lithography applications and the like. Typically, thermionic emitters, which operate at relatively high temperatures and allow for relatively slow electronic addressing and switching, are used in x-ray imaging applications. It is desirable to develop a cold cathode field emitter that may be used as an electron source in x-ray imaging applications, such as computed tomography (CT) applications, to improve scan speeds, as well as in other applications. Moreover, applications like low pressure gas discharge lighting and fluorescent lighting, which are limited by the life of the thermionic emitters that are typically used, will benefit from cold cathode field emitters.

Conventional cold cathode field emitters generally include a plurality of substantially conical or pyramid-shaped emitter tips arranged in a grid surrounded by a plurality of grid openings, or gates. The plurality of substantially conical or pyramid-shaped emitter tips are typically made of a metal or a metal carbide, such as molybdenum (Mo), tungsten (W), tantalum (Ta), iridium (Ir), platinum (Pt), molybdenum carbide ($Mo_2C$), hafnium carbide (HfC), zirconium carbide (ZrC), niobium carbide (NbC) or the like, or a semiconductor material, such as silicon (Si), silicon carbide (SiC), gallium nitride (GaN), diamond-like C or the like, and have a radius of curvature on the order of about 20 nm. A common conductor, or cathode electrode, is used and a gate dielectric layer is selectively disposed between the cathode electrode and the gate electrode, forming a plurality of microcavities around the plurality of substantially conical or pyramid-shaped emitter tips. Exemplary cathode electrode materials include doped amorphous Si, crystalline Si and thin-film metals, such as Mo, aluminum (Al), chromium (Cr) and the like. Exemplary gate dielectric layer materials include silicon dioxide ($SiO_2$), silicon nitride ($Si_3N_4$) and alumina ($Al_2O_3$). Exemplary gate electrode materials include Al, Mo, Pt and doped Si. When a voltage is applied to the gate electrode, electrons tunnel from the plurality of substantially conical or pyramid-shaped emitter tips.

The key performance factors associated with cold cathode field emitters include the emitter tip sharpness, the alignment and spacing of the emitter tips and the gates, the emitter tip-to-gate distance, and the emitter tip density. For example, the emitter tip-to-gate distance partially determines the turn-on voltage of the cold cathode field emitter, i.e., the voltage difference required between the emitter tip and the gate for the cold cathode field emitter to start emitting electrons. Typically, the smaller the emitter tip-to-gate distance, the lower the turn-on voltage of the cold cathode field emitter and the lower the power consumption/dissipation. Likewise, the emitter tip density affects the footprint of the cold cathode field emitter.

Conventional cold cathode field emitters may be fabricated using a number of methods. For example, the Spindt method, well known to those skilled in the art, may be used (see U.S. Pat. Nos. 3,665,241; 3,755,704; and 3,812,559; and C. A. Spindt "A Thin-Film Field-Emission Cathode," J. Appl. Phys., 1968, vol. 39(7), pp. 3504-3505). Generally, the Spindt method includes masking one or more dielectric layers and performing a plurality of lengthy, labor-intensive etching, oxidation and deposition steps. Residual gas particles in the vacuum surrounding the plurality of substantially conical or pyramid-shaped emitter tips collide with emitted electrons and are ionized. The resulting ions bombard the emitter tips and damage their sharp points, decreasing the emission current of the cold cathode field emitter over time and limiting its operating life. In general, the emitter tip-to-gate distance is determined by the thickness of the dielectric layer disposed between the two. A smaller emitter tip-to-gate distance may be achieved by depositing a thinner dielectric layer. This, however, has the negative consequence of increasing the capacitance between the cathode electrode and the gate electrode, thus increasing the response time of the cold cathode field emitter. One or both of these shortcomings are shared by the other methods for fabricating conventional cold cathode field emitters as well, including the recent chemical-mechanical planarization (CMP) methods (see U.S. Pat. Nos. 5,266,530, 5,229,331 and 5,372,973) and the recent ion milling methods (see U.S. Pat. Nos. 6,391,670 and 6,394,871), all of which produce a plurality of substantially conical or pyramid-shaped emitter tips. Generally, optical lithography and other methods are limited to field openings on the order of about 0.5 microns or larger and emitter tip-to-gate distances on the order of about 1 micron or larger.

Thus, what is still needed is a simple and efficient method for fabricating a cold cathode field emitter that includes a plurality of emitter tips that are continuously sharp. What is also still needed is a method for fabricating a cold cathode field emitter that has a relatively small emitter tip-to-gate distance, providing a relatively high emitter tip density. Such cold cathode field emitters should be suitable for use in x-ray applications, lighting applications, flat panel field emission display applications, microwave amplifier applications, and the like.

BRIEF DESCRIPTION OF THE INVENTION

Embodiments of the present invention provide novel methods for fabricating novel cold cathode field emitter devices, wherein such devices comprise an array of emitter tips that are self-aligned with their respective gates and decouples the emitter-to-tip spacing from the dielectric support for the gate layer, thereby providing a relatively high emitter tip density. Such methods are relatively simple, cost-effective, and efficient; and, they provide field emission devices that are suitable for use in x-ray imaging applications, lighting applications, flat panel field emission display (FED) applications, etc. Invention embodiments are also directed to the gated nanorod field emission devices made by the above-mentioned methods.

In some embodiments, the present invention is directed to methods comprising the steps of: (a) providing a nanoporous AAO template comprising nanopores that extend down to a substrate-supported conductive layer on which the template resides; (b) filling the nanopores with nanopore filler comprising a first dielectric material to form a filled nanoporous AAO template; (c) depositing a layer of a second dielectric material (which can be the same as the first dielectric material) on top of the filled nanoporous AAO template; (d) depositing a second conductive layer of conductive material on top of the layer of second dielectric material; (e) depositing a patternable material on top of the second conductive layer and patterning the patternable material; etching, in regions where the patternable material was removed, through the second conductive layer and the layer of second dielectric material to create "vias," and the first dielectric material to remove the nanopore filler; (f) electrochemically-depositing nanorod emitters in the nanopores; and (g) etching back the AAO template to expose the nanorod field emitters.

As an alternative to the above-described embodiments, in some embodiments, the present invention is directed to methods comprising the steps of: (a) providing a nanoporous anodized aluminum oxide (AAO) template comprising nanopores that extend down to a substrate-supported conductive layer; (b) electrochemically-depositing nanorod emitters in the nanopores to form an AAO template-based nanorod array; (c) filling any unfilled nanopores in the AAO template-based nanorod array with nanopore filler comprising a first dielectric material to form a filled AAO template-based nanorod array; (d) depositing a layer of a second dielectric material (which can be the same as the first dielectric material) on top of the filled AAO template-based nanorod array; (e) depositing a second conductive layer of conductive material on top of the layer of second dielectric material; (f) depositing a patternable material (e.g., a resist) on top of the second conductive layer and patterning the patternable material; (g) etching, in regions where the patternable material was removed, through the second conductive layer and the layer of second dielectric material to create vias exposing the nanorods in those regions; and (h) etching back the AAO surrounding those nanorods to yield nanorod field emitters.

As another alternative to the above-described embodiments, in some or other embodiments the present invention is directed to methods comprising the steps of: (a) providing a thin film material comprising: (i) a substrate, (ii) a dielectric layer on the substrate, and (iii) a conductive film on the dielectric layer; (b) patterning a patternable material deposited onto the conductive film; (c) selectively etching the conductive film and dielectric layer in regions where the patternable material has been removed to form microcavities; (d) depositing aluminum (Al) inside the microcavities to form Al posts (e.g., mesas); (e) anodizing the Al posts to form localized nanoporous AAO templates; (f) electrochemically-depositing nanorods in the nanopores of the AAO templates; and (g) etching back the AAO to expose the nanorod field emitters. In some embodiments, the Al is deposited as a Al stack, e.g., Ti/Cu/Ti/Al.

As another alternative to the above-described embodiments, in some or other embodiments the present invention is directed to methods comprising the steps of: (a) providing a nanoporous AAO template comprising nanopores that extend down to a substrate-supported conductive layer on which the nanoporous AAO template resides; (b) filling the nanopores with nanopore filler comprising a first dielectric material to form a filled nanoporous AAO template; (c) patterning and etching the AAO template to form AAO posts; (d) conformally depositing: (i) a dielectric layer comprising a second dielectric material, (ii) a gate metal layer, such that the dielectric and gate metal layers form a bump in the regions over the AAO posts, and (iii) a planarizable layer over the bumps that is subsequently planarized; (e) etching the dielectric, gate metal, and planarizable layers over the bump to form vias, such vias providing depositional access to the AAO posts; (f) electrochemically-depositing nanorods in the AAO posts to form nanorod/AAO posts and etching back the AAO to more fully expose the nanorods; and (g) removing the planarizable material to form gated emitter structures. Variations on these embodiments include, but are not limited to, fabricating posts in the Si substrate that the AAO posts can reside on.

As another alternative to the above-described embodiments, in some or other embodiments the present invention is directed to methods comprising the steps of: (a) providing a nanoporous AAO template comprising nanopores that extend down to a substrate-supported conductive layer on which the nanoporous AAO template resides; (b) filling the nanopores with nanopore filler comprising a first dielectric material to form a filled nanoporous AAO template; (c) patterning and etching the AAO template to form AAO posts capped with a metal masking layer; (d) depositing a thin conformal layer of a second dielectric material over the capped AAO posts, removing residual masking layer to expose the AAO posts, electrochemically depositing nanorods in the AAO posts to form nanorod/AAO posts, and etching back the AAO to more fully expose the nanorods in the nanorod/AAO posts; (e) conformally depositing: (i) a dielectric layer comprising a second dielectric material, (ii) a gate metal layer, such that the dielectric and gate metal layers form a bump in the regions over the AAO posts, and (iii) a planarizable layer over the bumps that is subsequently planarized via reflow; (f) etching the dielectric, gate metal, and planarizable layers over the bump to form vias, such vias providing access to the nanorod/AAO posts; and (g) removing the planarizable layer to form gated emitter structures. As above, variations on these embodiments include, but are not limited to, fabricating posts in the Si substrate that the AAO posts can reside on.

As another alternative to the above-described embodiments, in some or other embodiments the present invention is directed to methods comprising the steps of: (a) patterning a substrate; (b) depositing at least one Al stack, as an Al post, in a patterned microcavity region on the substrate; (c) conformally coating the Al post with layers of a dielectric material and a planarizable material; (d) etching the dielectric and planarizable layers over the post; (e) removing the planarizable material and anodizing the posts to form a nanoporous AAO post on the substrate; (f) electrochemically depositing nanorods in the AAO posts to form nanorod/AAO posts; (g) conformally depositing: (i) a dielectric layer comprising a second dielectric material, (ii) a gate metal layer, such that the dielectric and gate metal layers form a bump in the regions over the nanorod/AAO posts, and (iii) a planarizable layer over the bumps that is subsequently planarized via reflow; (h) etching the planarizable, metal, and dielectric layers over the bump to form a via exposing the nanorod/AAO posts; and (i) removing the planarizable material to form a gated emitter structure. As above, variations on these embodiments include, but are not limited to, fabricating posts in the Si substrate that the AAO posts can reside on.

In some embodiments, devices of the present invention comprise a substrate, a conductive layer, a region of nanoporous AAO comprising filled nanopores and nanorod field emitters, the latter of which are positioned within vias, the vias being holes in the dielectric layer and gate metal layer that reside on top of the nanoporous AAO region.

In some or other embodiments, devices of the present invention comprise a substrate, a dielectric layer, a gate metal layer, microcavities in the dielectric and gate metal layers, nanoporous AAO posts in the microcavities, and nanorod field emitters in the nanoporous AAO posts. Generally, the substrate comprises at least a top portion that is conductive.

The foregoing has outlined rather broadly the features of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
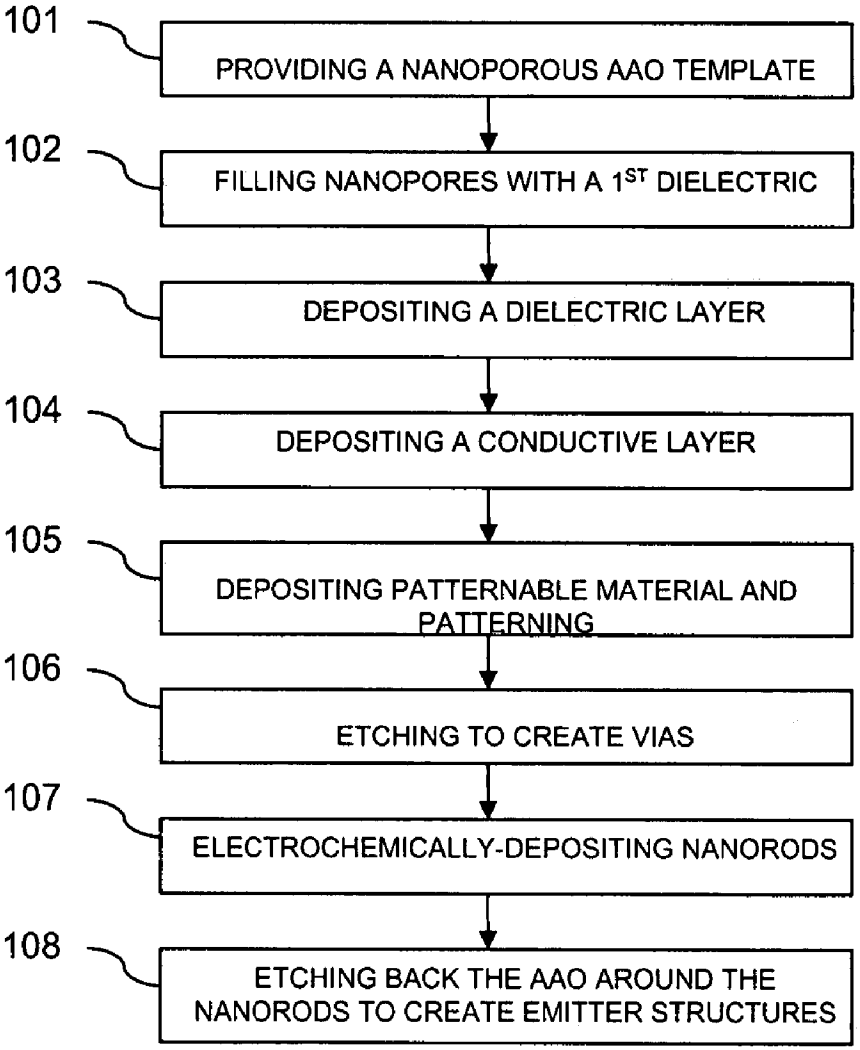
FIG. 1 depicts, in flow diagram form, methods for making gated nanorod field emitters, in accordance with some embodiments of the present invention.

In some embodiments, the present invention is directed to novel cold cathode field emitter devices that comprise an array of emitter tips that are self-aligned with their respective gates and have relatively small emitter tip-to-gate distances, thereby providing a relatively high emitter tip density, and methods for making same. Such methods are relatively simple, cost-effective, and efficient; and they provide field emission devices that are suitable for use in x-ray imaging applications, lighting applications, flat panel field emission display (FED) applications, etc.

In the following description, specific details are set forth such as specific quantities, sizes, etc. so as to provide a thorough understanding of embodiments of the present invention. However, it will be obvious to those skilled in the art that the present invention may be practiced without such specific details. In many cases, details concerning such considerations and the like have been omitted inasmuch as such details are not necessary to obtain a complete understanding of the present invention and are within the skills of persons of ordinary skill in the relevant art.

Referring to the drawings in general, it will be understood that the illustrations are for the purpose of describing a particular embodiment of the invention and are not intended to limit the invention thereto.

Referring to the flow chart in FIG. 1, in some embodiments, the present invention is directed to methods comprising the steps of: (101) providing a nanoporous anodized aluminum oxide (AAO) template comprising nanopores that extend down to a substrate-supported first conductive layer on which the template resides; (102) filling the nanopores with nanopore filler comprising a first dielectric material to form a filled nanoporous AAO template; (103) depositing a layer of a second dielectric material (which can be the same as the first dielectric material) on top of the filled nanoporous AAO template; (104) depositing a second conductive layer of conductive material on top of the layer of second dielectric material; (105) depositing a patternable (e.g., resist) material on top of the second conductive layer and patterning (e.g., lithographically) to selectively remove portions of the patternable material; (106) etching, in regions where the patternable material was removed, through the second conductive layer and the layer of second dielectric material to create "vias," and etching the first dielectric material to remove the nanopore filler; (107) electrochemically-depositing nanorod emitters in the nanopores; and (108) etching back the AAO to expose the nanorod field emitters. These steps are described in greater detail below.

Figure 2:
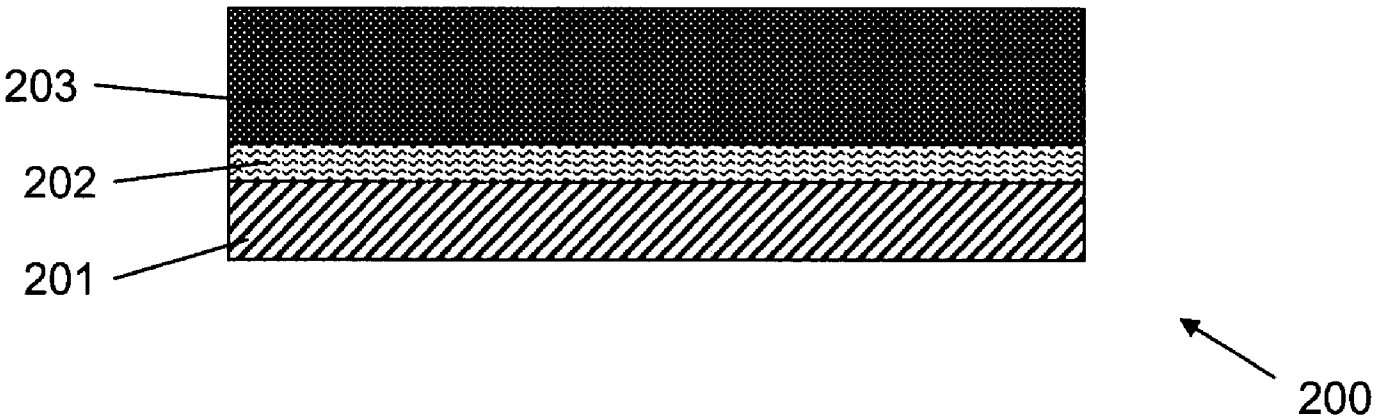
FIG. 2 depicts a layer of Al on a substrate-supported conductive layer, where the layer of Al can be anodized to form a nanoporous AAO template.
Figure 3:
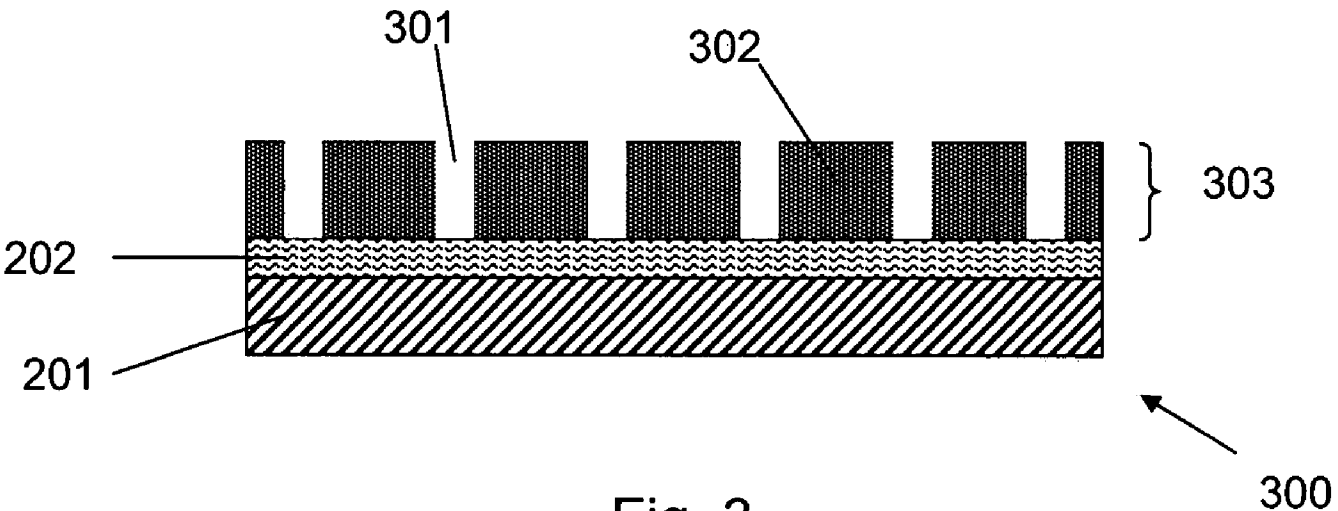
FIG. 3 depicts a nanoporous AAO template comprising nanopores and residing on a substrate-supported conductive layer, where the nanopores extend down to the conductive substrate.

Nanoporous AAO templates are known in the art. See Masuda et al., Science, 1995, 268, p. 1466; Masuda et al., Appl. Phys. Lett., 1997, 71, p. 2770; Jessensky et al., Appl. Phys. Lett., 1998, 72(10), p. 1173; Yin et al., Appl. Phys. Lett., 2001, 79, p. 1039; and Zheng et al., Chem. Mater., 2001, 13, p. 3859. Referring to FIG. 2, such templates can be made by first providing a layered thin film material 200 comprising a substrate 201, a conductive layer 202 on top of the substrate 201, and an Al layer 203 on top of the conductive layer 202—collectively referred to as a "stack." Referring to FIG. 3, upon anodization, a nanoporous AAO template is formed comprising a nanoporous AAO layer 303 comprising nanopores 301 and regions of AAO 302, wherein such nanopores 301 are aligned substantially perpendicular to the layered thin film material 200 (and correspondingly the substrate 201). "Substantially perpendicular," as defined herein, means that the angle the nanopores (and nanorods ultimately within such nanopores) make with the substrate is greater than 45°, but less than or equal to 90°.

Substrates 201 can be of any material that suitably provides for a substrate in accordance with embodiments of the present invention. Suitable substrate materials include, but are not limited to, glasses, metals, polymers, molecular solids, silicon (Si), silicon carbide (SiC), polysilicon (poly Si), amorphous silicon, and combinations thereof. In some embodiments, the substrate comprises a polished Si wafer. The conductive layer 202 can comprise any material that is electrically-conductive and amenable to processing in accordance with embodiments of the present invention. In some embodiments, the conductive layer is simply a homogeneous extension of the substrate (e.g., a Si substrate with a Si conductive layer). Generally, the conductive layer 202 comprises a material that is not susceptible, or is only moderately susceptible, to anodization, i.e., it will not readily oxidize under conditions of the anodization process—it is substantially immune to anodization. In some or other embodiments, when the conductive layer 202 is moderately susceptible to anodization, any oxide formed in this layer can be removed or reduced prior to subsequent steps of electrodeposition. Suitable materials include, but are not limited to, gold (Au), copper (Cu), platinum (Pt), palladium (Pd), aluminum (Al), silver (Ag), nickel (Ni), carbon (C), rhodium (Rh), ruthenium (Ru), iridium (Ir), osmium (Os), and combinations thereof. Generally, the conductive layer has a thickness of between about 10 nm and about 100 μm.

Figure 4:
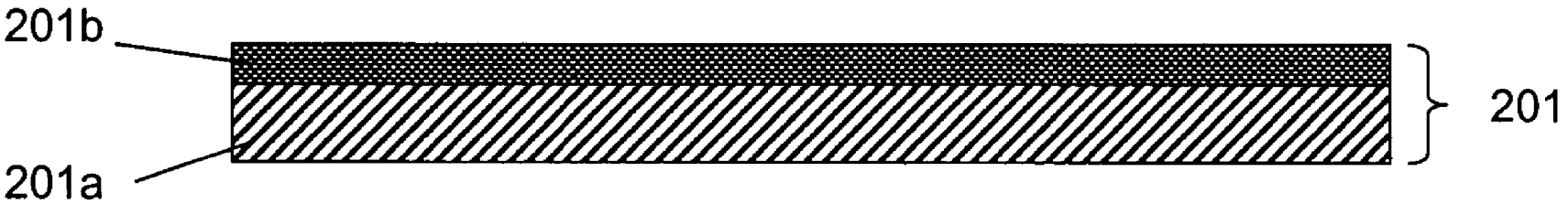
FIG. 4 depicts a substrate (201) comprising an adhesion layer (201*b*) on top of a substrate base (201*a*), in accordance with some embodiments of the present invention.

In some embodiments, substrate 201 may comprise an adhesion layer to facilitate adhesion of the conductive layer 202 with the substrate. Referring to FIG. 4, in such embodiments, substrate 201 is comprised of a substrate base 201*a* and an adhesion layer 201*b*, on top of the substrate base 201*a*. The adhesion layer 201*b* can be of any material that suitably adheres the substrate 201 to the conductive layer 202. Such materials include, but are not limited to, titanium (Ti), tungsten (W), titanium-tungsten (TiW), chromium (Cr), germanium (Ge), palladium (Pd), and combinations thereof. Typically, the adhesion layer has a thickness of between about 5 nm and several micrometers.

Figure 5:
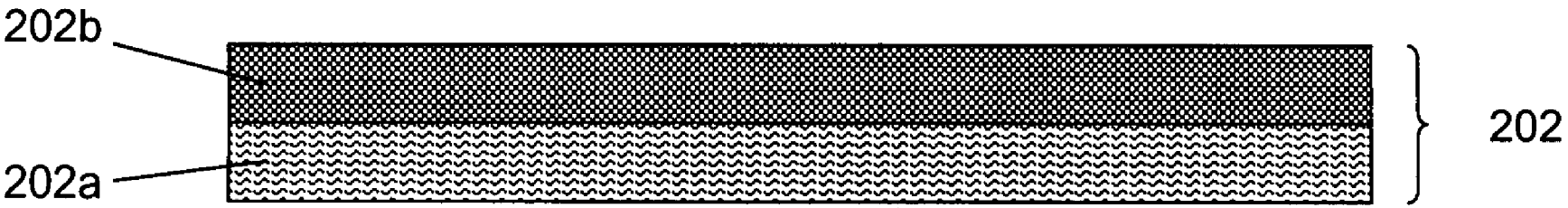
FIG. 5 depicts a conductive layer (202) comprising a sacrificial barrier layer (202*b*) on top of an oxidation-resistant conductive layer (202*a*), in accordance with some embodiments of the present invention.

In some embodiments, the nanoporous AAO template is fabricated in accordance with methods described in commonly assigned co-pending U.S. patent application Ser. No. 11/141,613 incorporated by reference herein (Corderman et al., Atty Dkt No. GE 162154-1, filed May 27, 2005). Referring to FIG. 5, in such embodiments, conductive layer 202 is comprised of an oxidation-resistant conductive sub-layer 202*a* and a sacrificial barrier sub-layer 202*b* on top of sub-layer 202*a*. Suitable oxidation-resistant sub-layers include, but are not limited to materials such as Au, Cu, Pt, Ag, Ni, Pd, Rh, Ru, Os, and combinations thereof. Such oxidation-resistant sub-layers typically have a thickness of between about 10 nm and about 100 μm. Sacrificial barriers layers should comprise any electrically-conducting metal other than Al, which becomes insulating upon anodization, but which can be removed under conditions that do not substantially remove AAO. Suitable sacrificial barrier layers include, but are not limited to materials such as titanium (Ti), magnesium (Mg), niobium (Nb), tantalum (Ta), tungsten (W), zirconium (Zr), zinc (Zn), and combinations thereof. In some embodiments, the thickness of this layer is important. In such embodiments, the thickness of this layer can be in the range of from at least about 5 nm to at most about 30 nm.

Figure 6:
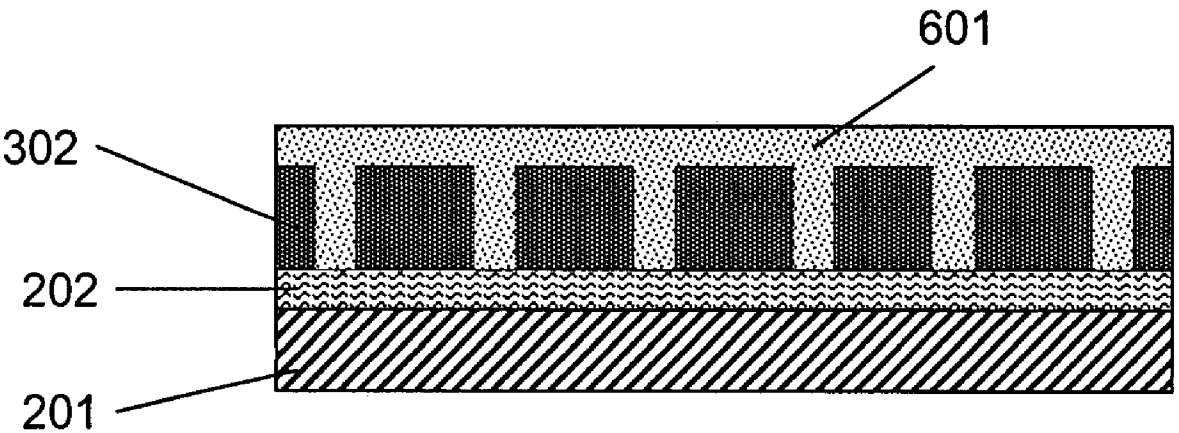
FIG. 6 depicts a substrate-supported nanoporous AAO template into which dielectric material has been deposited.
Figure 7:
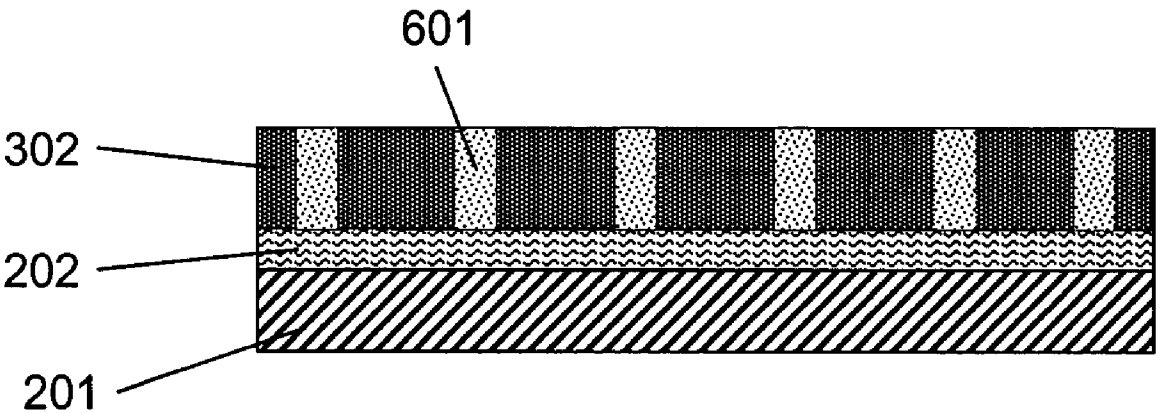
FIG. 7 depicts the article of FIG. 6, where the dielectric material above the nanopores has been removed via a planarization process.
Figure 8:
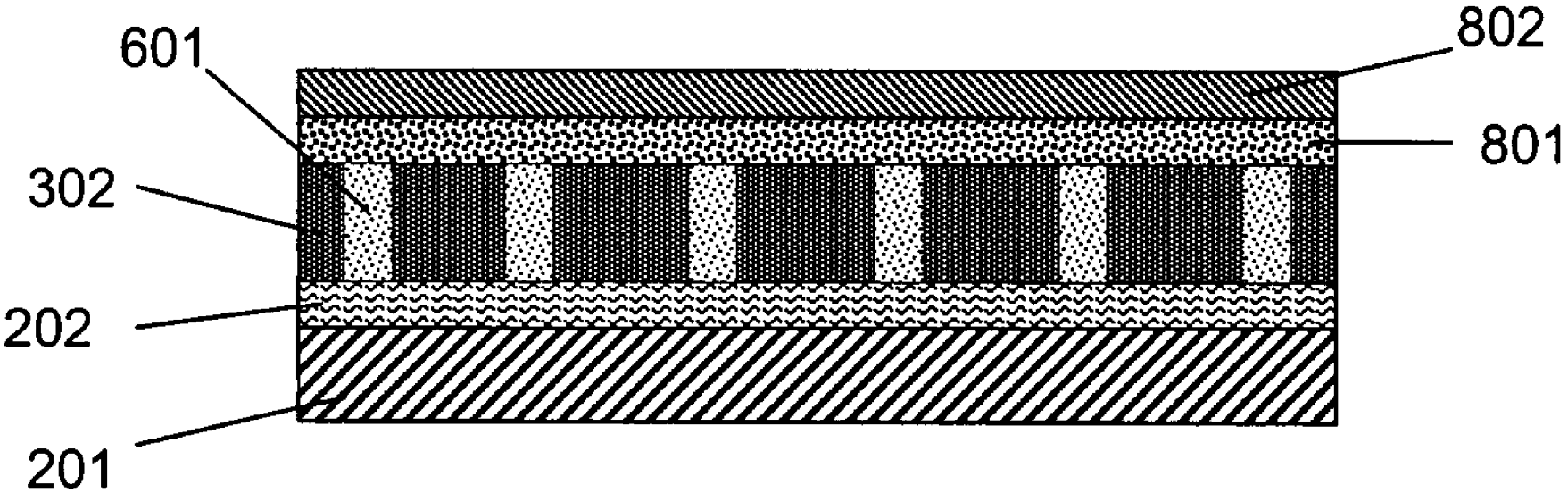
FIG. 8 depicts the article of FIG. 7, upon which a second dielectric material (801) and a second conductive layer (802) have been deposited.
Figure 9:
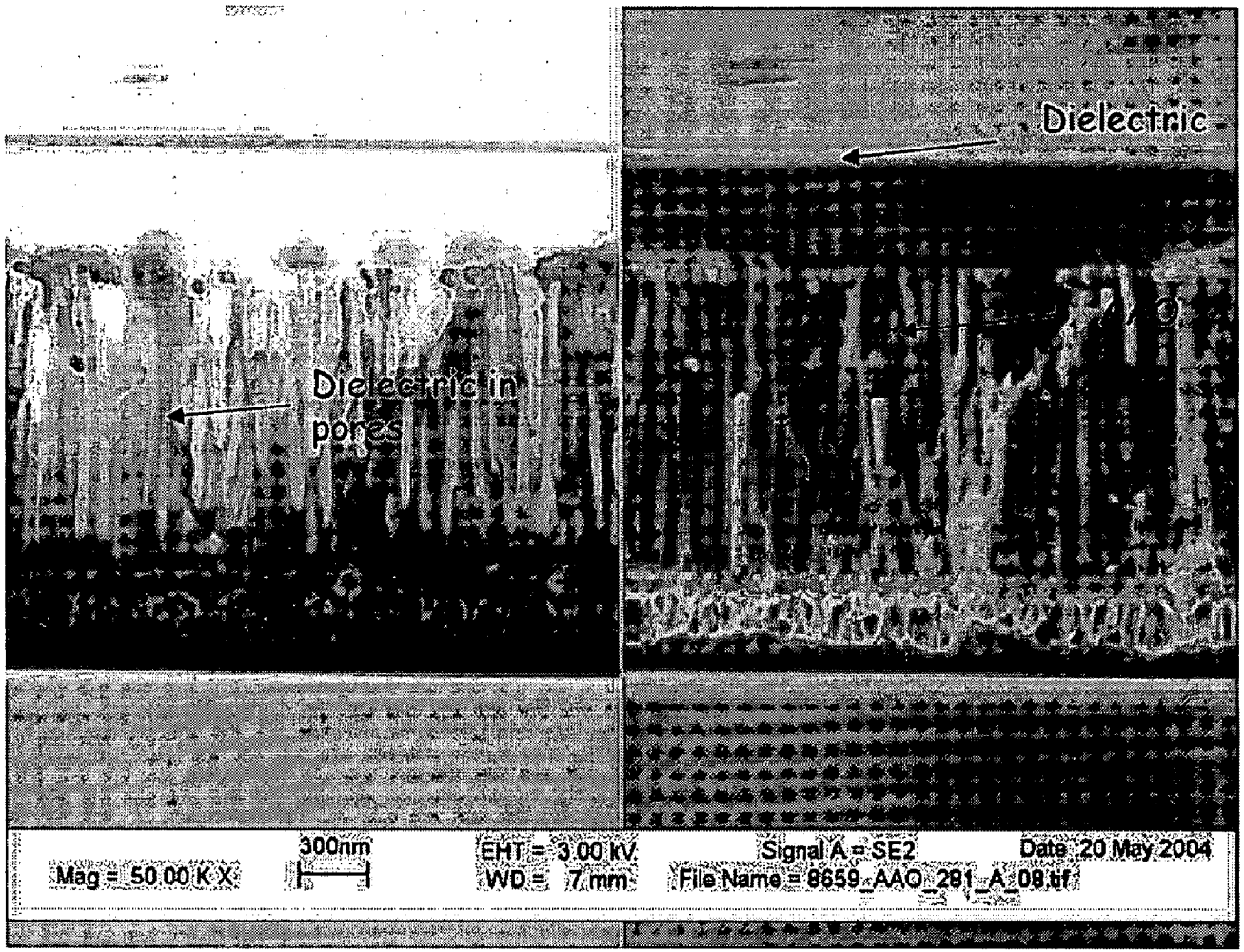
FIG. 9 is a field emission scanning electron microscopy (FE-SEM) image of an AAO template with dielectric material filling the pores of the template.
Figure 10:
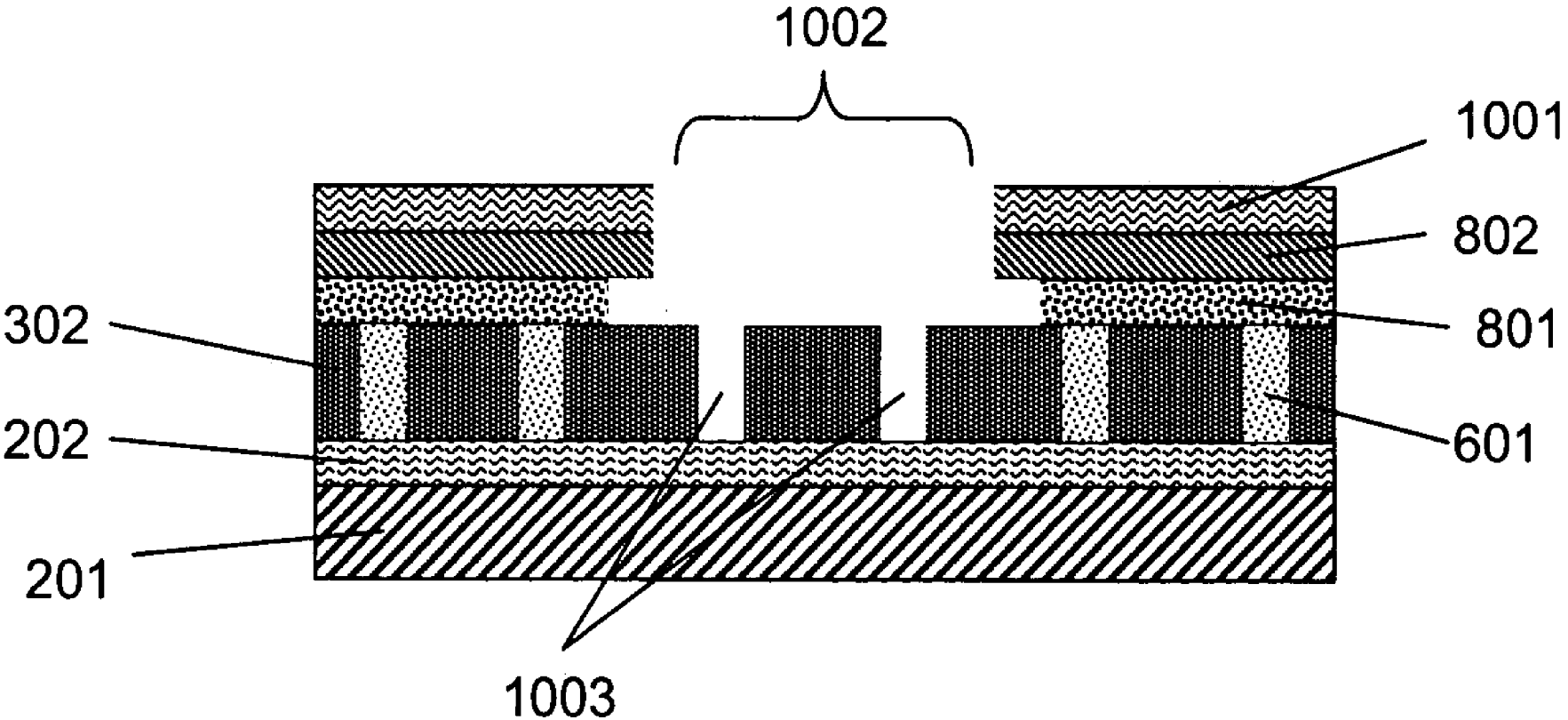
FIG. 10 depicts the article of FIG. 8, where a patternable material (1001) has been added and lithographically-patterned, where the second dielectric material (801) and the second conductive layer (802) have been etched to create vias (1002), and where the exposed first dielectric material has been etched to yield re-generated nanopores.
Figure 11:
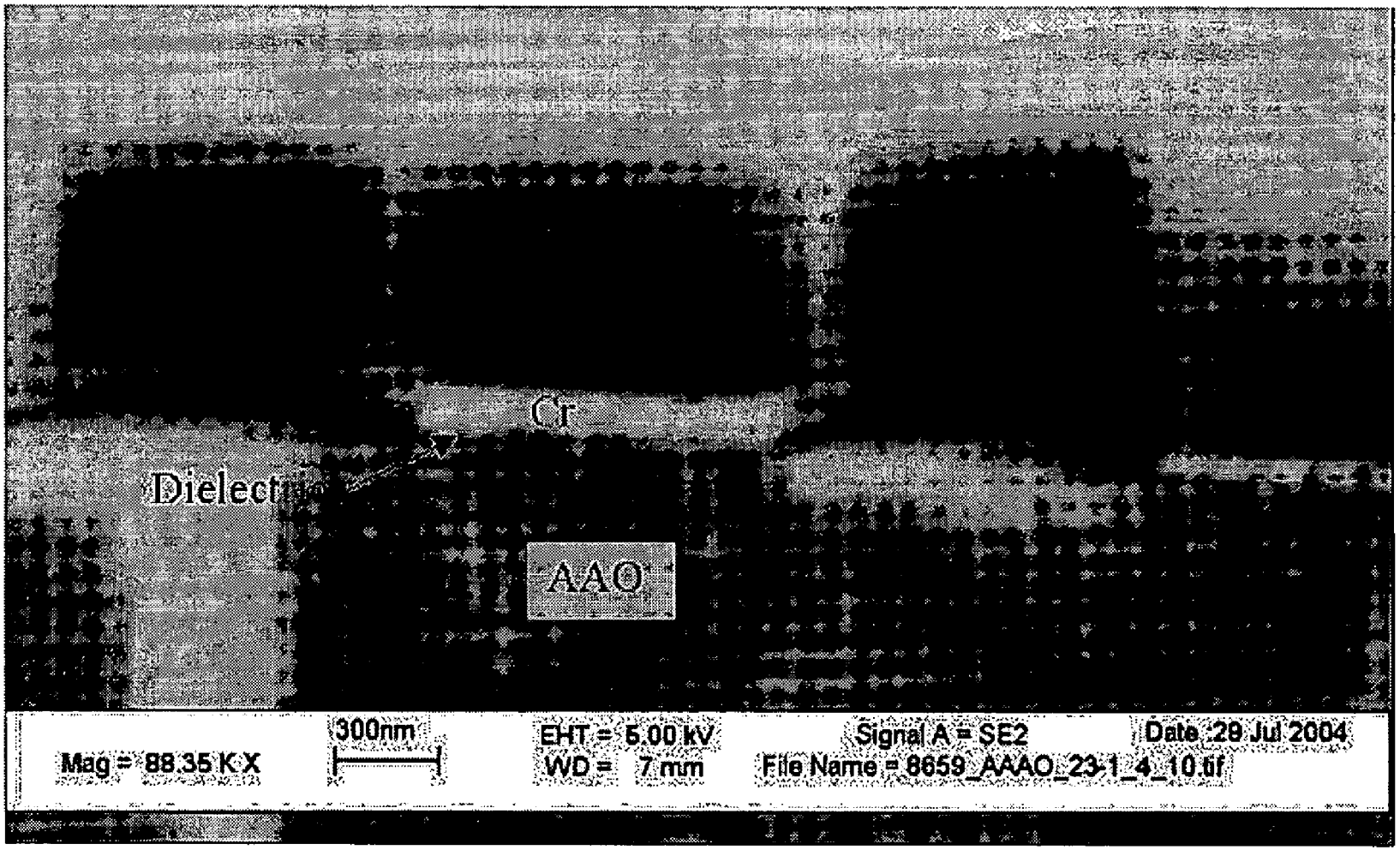
FIG. 11 is an FE-SEM image depicting a cross-section after vias have been formed and the first dielectric material (SOG) removed.
Figure 12:
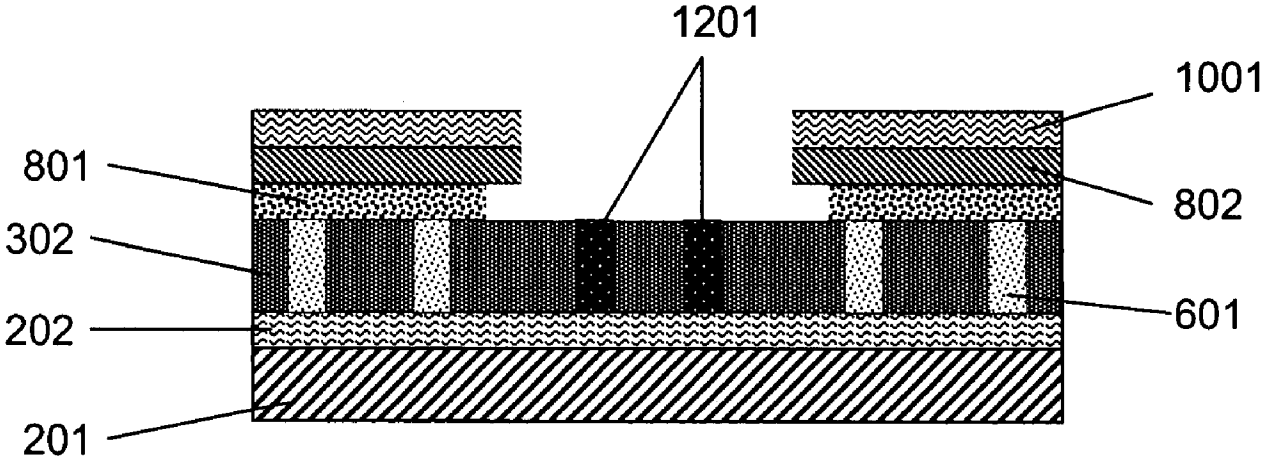
FIG. 12 depicts the article of FIG. 10, where nanorods have been electrochemically-deposited in the re-generated nanopores.
Figure 13:
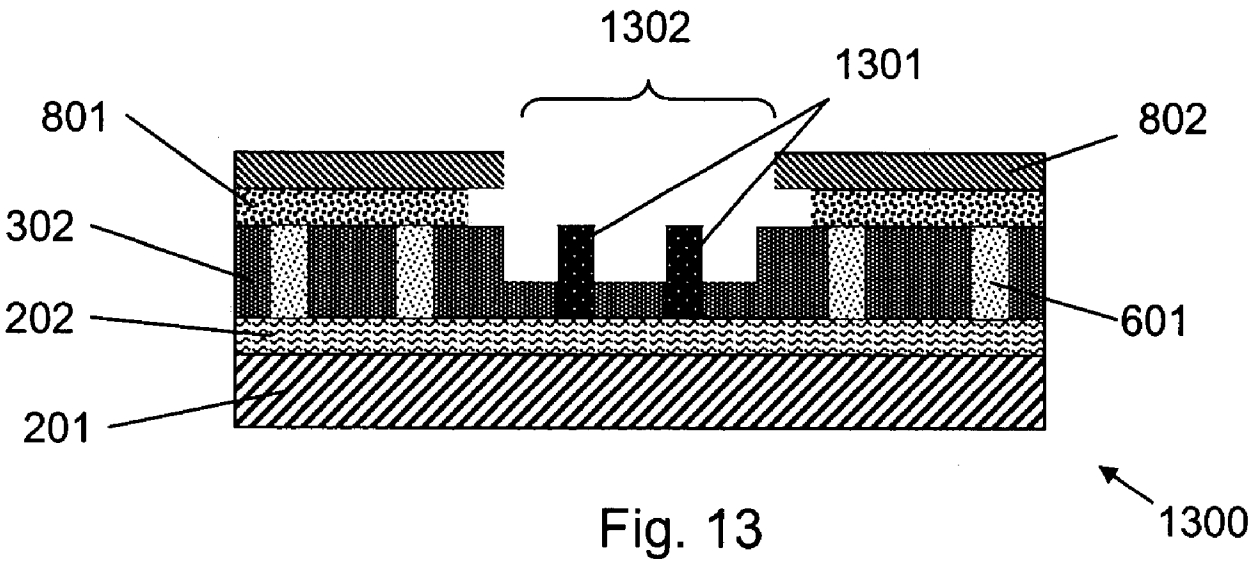
FIG. 13 depicts the article of FIG. 12, where the AAO around the nanorods has been etched back to yield gated nanorod field emitters, in accordance with some embodiments of the present invention.
Figure 14:
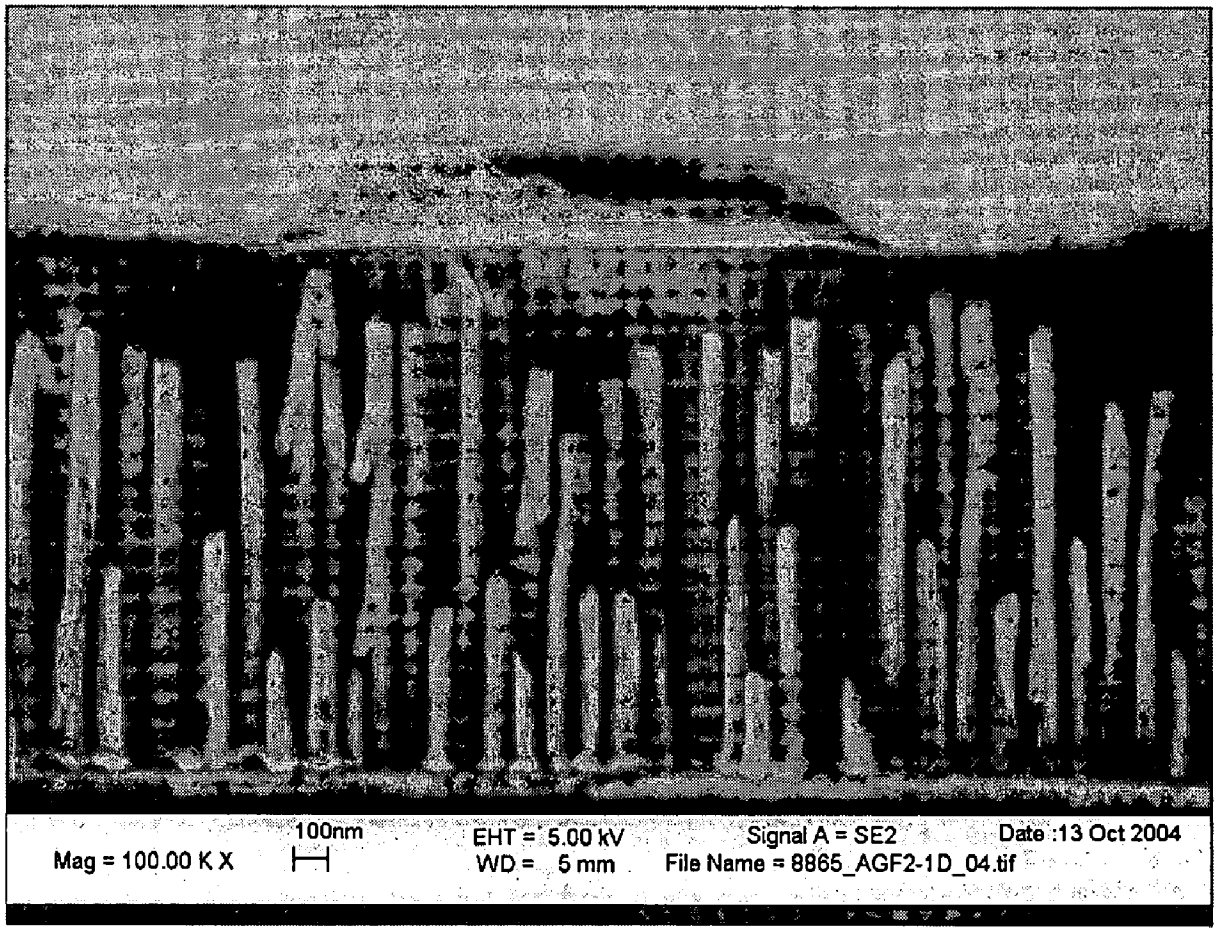
FIG. 14 is an FE-SEM image depicting a cross-section after electrodeposition of nanorods in the regenerated pores.

In some embodiments, the first dielectric material is used to fill the nanopores of the AAO template, as shown in FIG. 6, where the first dielectric material 601 not only fills the nanopores, but also forms a layer on top of the nanopores. In such embodiments, this layer can be planarized, as shown in FIG. 7. Referring to FIG. 8, a layer of second dielectric material 801 (which can be of the same material as, or different from, the first dielectric material) is deposited. A conductive gate material 802 is then deposited, as a second conductive layer, on the second dielectric material 801. In some embodiments, an annealing sub-step is carried out after one or both of the steps of depositing dielectric material. Suitable first dielectric materials include, but are not limited to, spin-on-glass (SOG), photoresist, electrochemically-deposited (ECD) dielectric, metallo-organic chemical vapor deposited $SiO_2$ (e.g., tetraethyloxysilane (TEOS)), doped $SiO_2$ (e.g., phosphosilicate glass (PSG)), porous dielectric, and combinations thereof. Planarization can be accomplished by any suitable method, but typically involves either dry etching or chemical-mechanical polishing (CMP). Suitable second dielectric materials include, but are not limited to, $SiO_2$, $SiN_x$ where $0.5 \leqq x \leqq 1.5$ (e.g., SiN and $Si_3N_4$), epitaxial intrinsic SiC (epi-i-SiC), $Al_2O_3$, undoped wide bandgap semiconductors (e.g., SiC, GaN, spin-on-glass), and combinations thereof. Suitable conductive gate materials include, but are not limited to, metals, such as, but not limited to, Nb, Pt, Al, W, Mo, Ti, Ni, Cr, TiW, and the like; semiconductor material, such as, but not limited to, highly-doped Si, GaN, GaAs, SiC, doped poly Si, doped amorphous Si, and the like; and combinations thereof. The layer formed by the second dielectric material typically has a thickness in the range of about 100 nm to about 5 μm. The second conductive layer typically has a thickness between about 10 nm and several micrometers. FIG. 9 is a field emission scanning electron microscopy (FE-SEM) image of an AAO template with dielectric material filling the pores of the template Referring to FIG. 10, by applying a patternable material 1001 on top of the conductive gate material 802, patterning the patternable layer, and etching the conductive gate material 802, second dielectric layer 801, and first dielectric material 601 in regions where the patternable material has been removed, etched vias 1002 can be created that offer access to regenerated nanopores 1003 (note that layers 1001, 802, and 801 can be aligned or not aligned, in the latter case possessing overhangs and/or underhangs of one or more layers). FIG. 11 is an FE-SEM image depicting a cross-section after vias have been formed and the first dielectric material (SOG) removed. Referring to FIG. 12, nanorods 1201 can be electrochemically deposited into the regenerated nanopores 1003 and, as shown in FIG. 13, the residual patternable material 1001 can be removed and the AAO 302 around the nanorods 1201 can be etched back to yield nanorod field emitters 1301 in a gated nanorod field emission device 1300. FIG. 14 is an FE-SEM image depicting a cross-section after electrodeposition of nanorods in the regenerated pores. Suitable methods of patterning include, but are not limited to, lithography (e.g., photolithography, UV lithography, e-beam lithography, and the like), imprinting, embossing, and combinations thereof.

Regarding the above-mentioned lithographic patterning, a mask is typically applied to the layer of patternable resist material and the exposed regions are irradiated with radiation, typically in the ultraviolet region of the electromagnetic (EM) spectrum. The resist is then contacted with developer to remove the irradiated resist (unless a negative resist is employed, wherein polymer is crosslinked and the non-irradiated areas are removed). Suitable resist material includes, but is not limited to, polymethylmethacylate (PMMA), AZ1512, NFR-16, and the like. Etching of exposed regions of the conductive gate material 802 and the second dielectric layer 801 are typically done via either a wet or dry etching technique. Residual resist removal is typically done via a solvent removal technique or dry cleaning. While such patterning typically involves lithography (e.g., photo, UV, e-beam, etc.), it will be appreciated by those of skill in the art that other patterning techniques can be used, such as, but not limited to, embossing, imprinting, hot stamping, and the like.

Electrodeposition of nanorods into nanopores of the AAO template can be done by methods well known in the art. See Masuda et al., Science, 1995, 268, p. 1466; Masuda et al., Appl. Phys. Lett., 1997, 71, p. 2770; Jessensky et al., Appl. Phys. Lett., 1998, 72(10), p. 1173; Yin et al., Appl. Phys. Lett., 2001, 79, p. 1039; and Zheng et al., Chem. Mater., 2001, 13, p. 3859. Generally, however, by contacting the conductive bottom of the nanopores (i.e., conductive layer) with an electrolyte solution comprising precursor ions operable for being electrodeposited in the nanopores, and by operating the conductive layer as a working electrode component of an electrochemical cell, nanorods can be formed in the nanopores. Depending upon the precursors in the electrolyte, nanorods can comprise any material that can be electrodeposited, i.e., metals; metal borides, carbides, nitrides, oxides; etc., subject only to the availability of a suitable electrolyte from which these materials may be electrodeposited, such materials including, but not limited to, Pt, Pd, Ni, Au, Ag, Cu, Zn, ZnO, $MoO_3/Mo_2O_5$, and combinations thereof.

Figure 15:
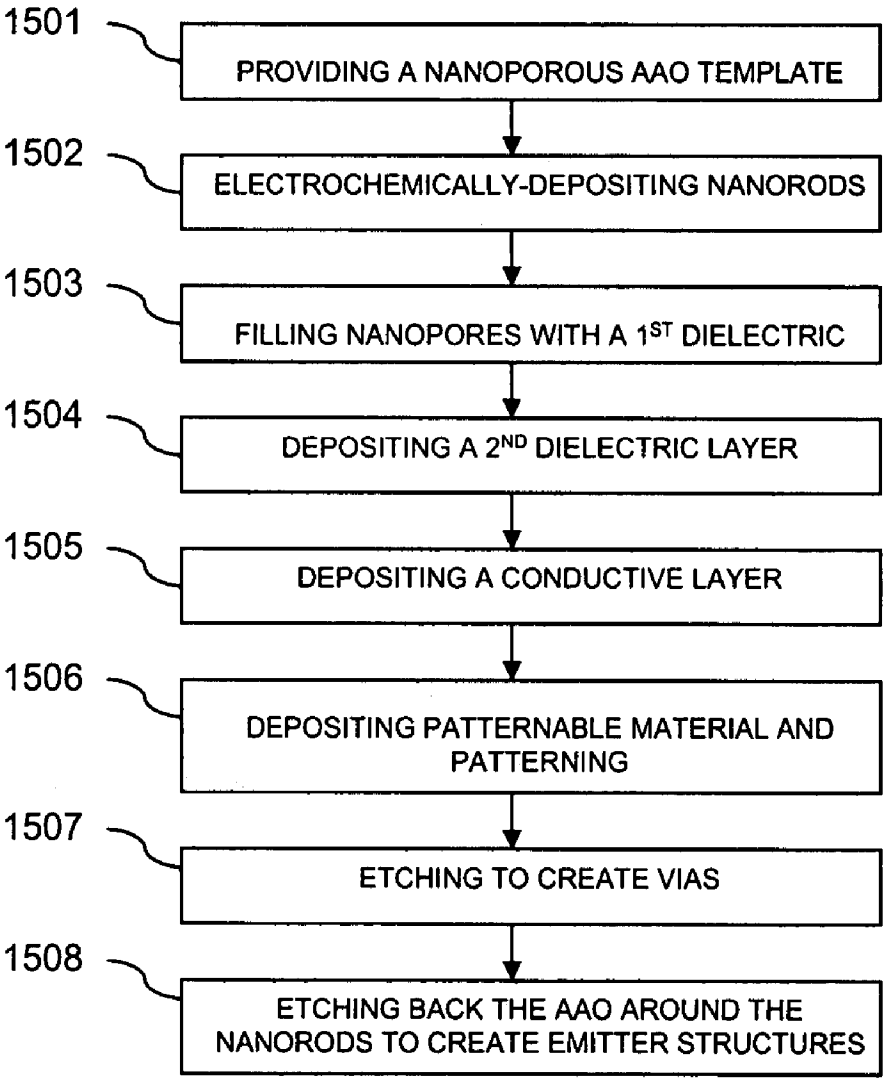
FIG. 15 depicts, in flow diagram form, alternative methods for making gated nanorod field emitters, in accordance with some embodiments of the present invention.

The above-described set of embodiments can be modified by changing the order of the various steps. As an example, and as an alternative to the above-described embodiments, and referring to the flow diagram in FIG. 15, in some embodiments, the present invention is directed to methods comprising the steps of: (1501) providing a nanoporous AAO template comprising nanopores that extend down to a substrate-supported conductive layer; (1502) electrochemically-depositing nanorod emitters in the nanopores to form an AAO template-based nanorod array and optionally planarizing the sample with the CMP; (1503) filling any unfilled nanopores in the AAO template-based nanorod array with nanopore filler comprising a first dielectric material to form a filled, planar AAO template-based nanorod array; (1504) depositing a layer of a second dielectric material (which can be the same as the first dielectric material) on top of the filled AAO template-based nanorod array; (1505) depositing a second conductive layer of conductive material on top of the layer of second dielectric material; (1506) depositing a patternable material on top of the second conductive layer and lithographically-patterning to selectively remove portions of the patternable material; (1507) etching, in regions where the patternable material was removed, through the second conductive layer and the layer of second dielectric material to create vias exposing the nanorods in those regions; and (1508) etching back the AAO surrounding those nanorods to yield nanorod field emitters. This etching can be achieved with either dry etching or wet etching techniques.

In the above-described alternative embodiments, the various steps and sub-steps can be performed generally as described previously for the related embodiments described in FIG. 1.

Figure 16:
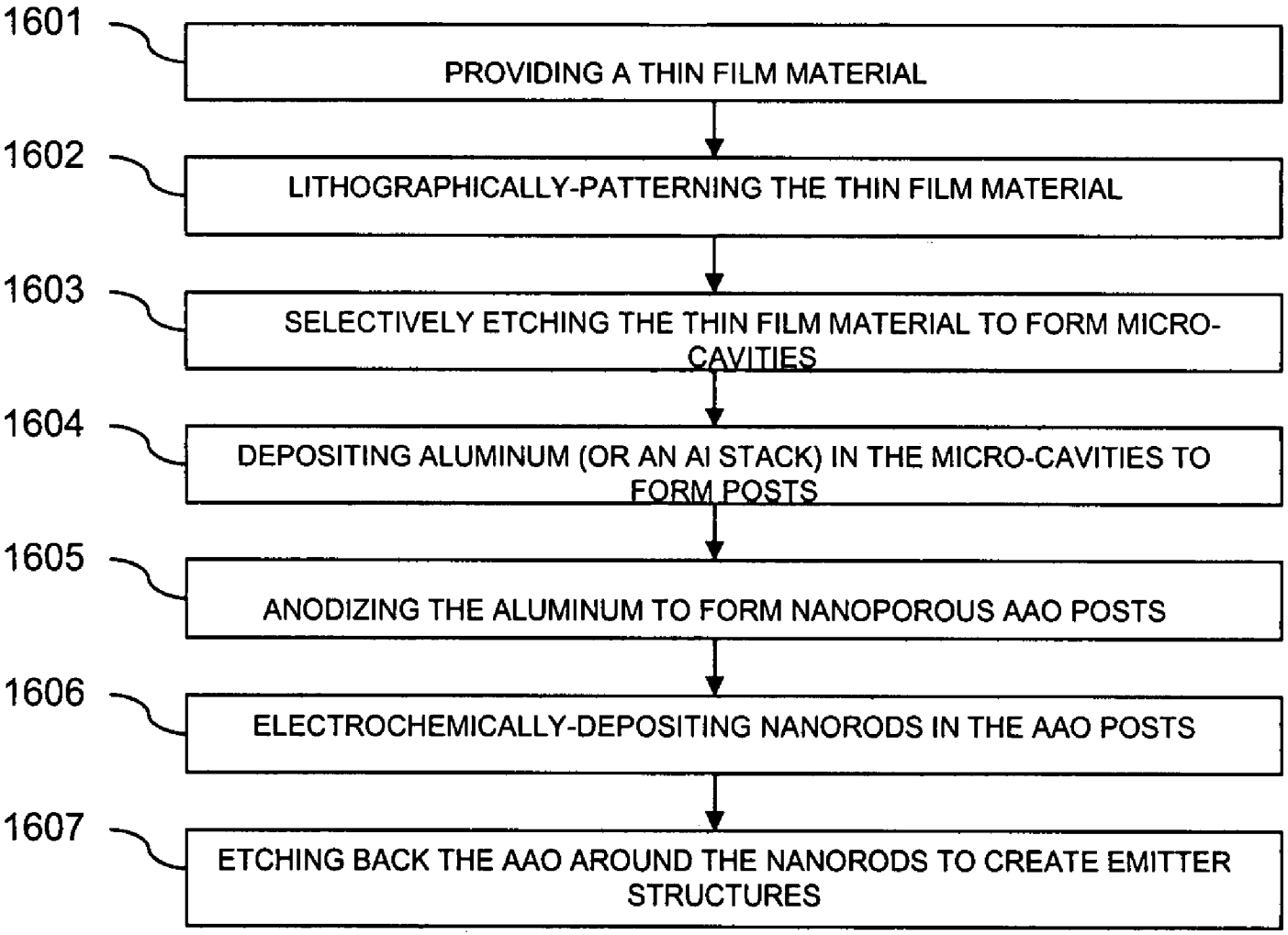
FIG. 16 depicts, in flow diagram form, additional alternative methods for making gated nanorod field emitters, in accordance with some embodiments of the present invention.

As another alternative to the above-described embodiments, and referring to the flow diagram in FIG. 16, in some embodiments the present invention is directed to methods comprising the steps of: (1601) providing a thin film material comprising a substrate, a dielectric layer on the substrate, and a conductive film on the dielectric layer; (1602) lithographically patterning a resist material deposited onto the conductive film; (1603) selectively etching the conductive film and dielectric layer in regions where the resist has be removed to form microcavities; (1604) depositing Al inside the microcavities to form Al mesas; (1605) anodizing the Al mesas to form localized nanoporous AAO templates; (1606) electrochemically-depositing nanorods in the nanopores of the AAO templates; and (1607) optionally etching back the AAO to expose the nanorod field emitters. Such steps are described below in greater detail. Note that in some embodiments, the Al is deposited as a Al stack, e.g., Ti/Cu/Ti/Al.

Figure 17:
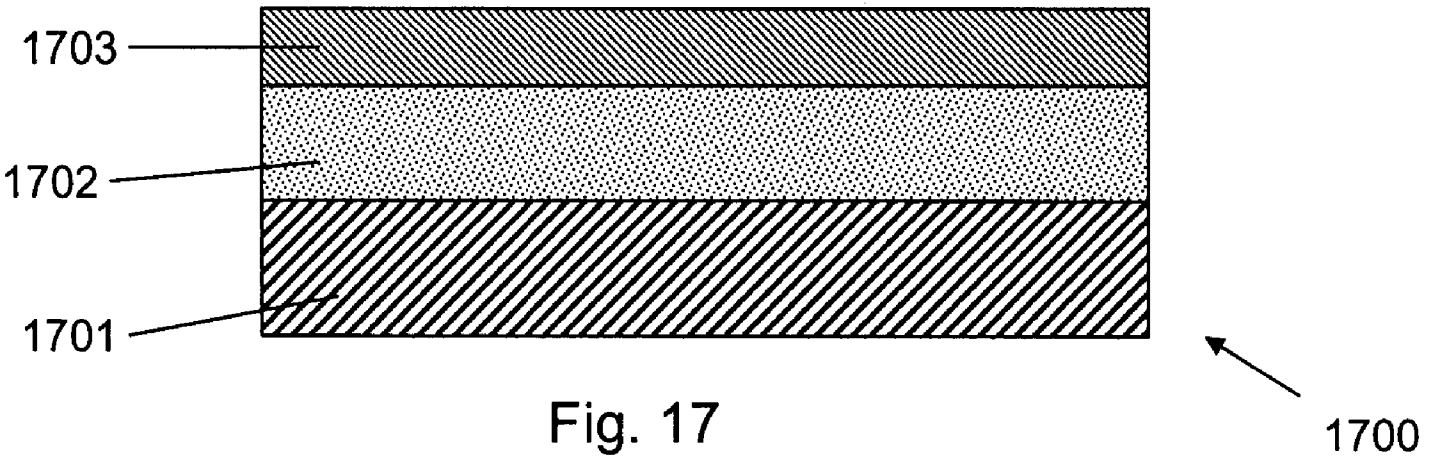
FIG. 17 depicts a thin film material, in accordance with some embodiments of the present invention.

FIG. 17 illustrates the above-described thin film material 1700, where dielectric layer 1702 resides on substrate 1701, and where conductive layer 1703 (gate metal layer) resides on dielectric layer 1702. Substrate 1701 can be of any suitable substrate material including, but not limited to, semiconductors, glasses, molecular solids, metals, ceramics, polymers, and combinations thereof. Exemplary substrate materials include, but are not limited to, Si, SiC, poly Si, amorphous Si, and combinations thereof. Dielectric layer 1702 can be of any suitable dielectric material or composition including, but not limited to, $SiO_2$, $SiN_x$ ($0.5 \leqq x \leqq 1.5$, such as SiN and $Si_3N_4$, epi-i-SiC, $Al_2O_3$, undoped wide bandgap semiconductors (SiC, GaN, spin-on-glass, etc.), and combinations thereof. Dielectric layer 1702 typically has a thickness in the range of about 100 nm to about 5 μm. Conductive layer 1703 can be of any suitable conductive material including, but not limited to, metal, such as Nb, Pt, Al, W, Mo, Ti, Ni, Cr, TiW, and the like; semiconducting material, such as highly-doped Si, GaN, GaAs, SiC, doped poly Si, doped amorphous Si, and the like; and combinations thereof. Conductive layer 1703 typically has a thickness in the range of about 10 nm to about 100 μm.

Figure 18:
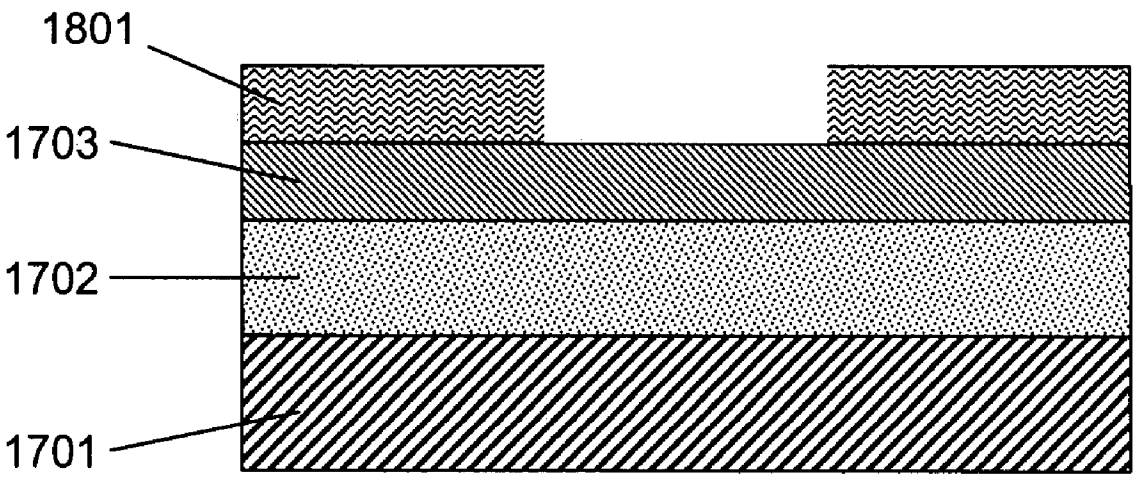
FIG. 18 depicts the thin film material of FIG. 17, upon which a patternable layer has been deposited.
Figure 19:
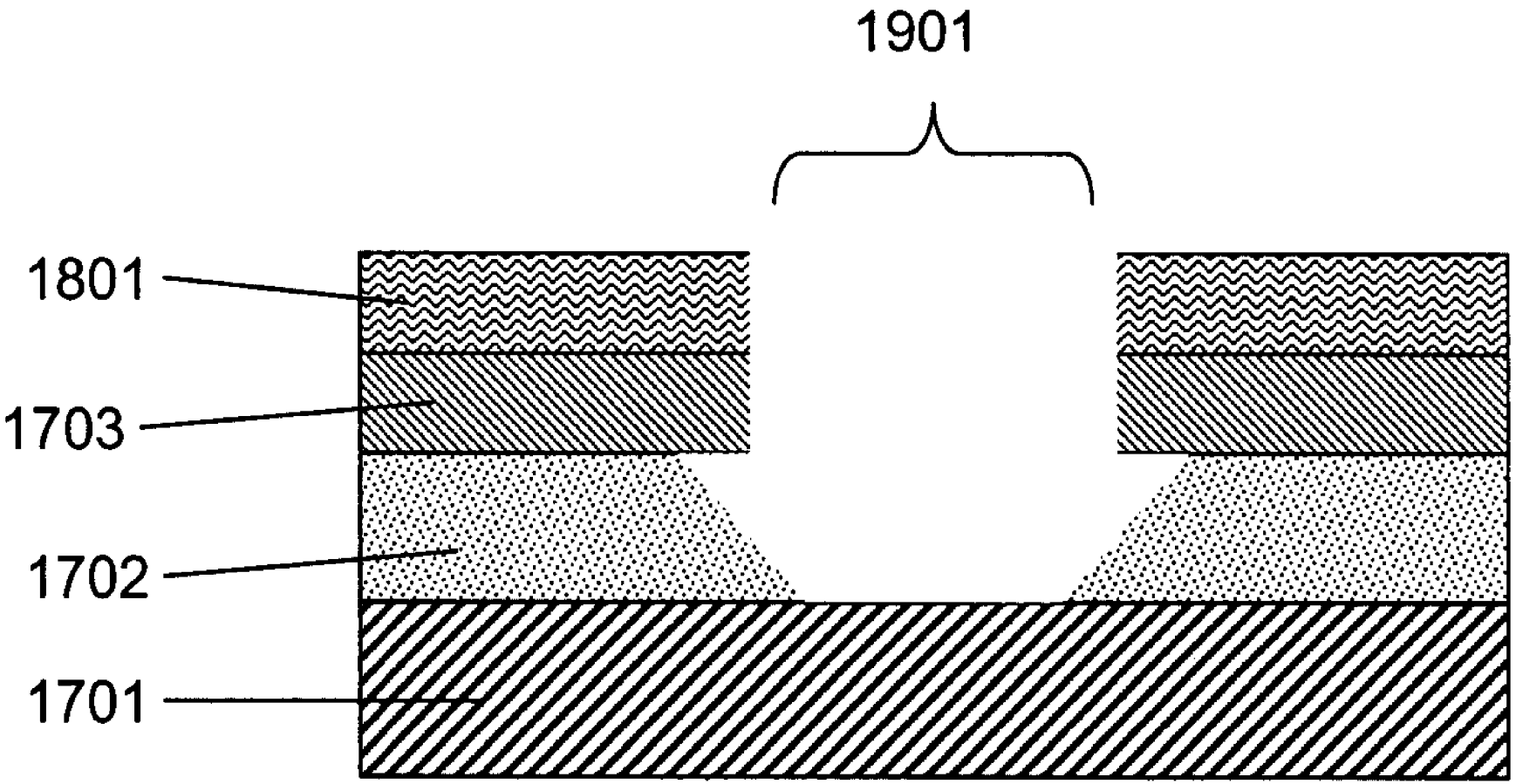
FIG. 19 depicts the article of FIG. 18, where the dielectric (1702) and conductive (1703) layers have been etched, in selected regions exposed by the removal of patterned portions of the patternable layer, to yield micro-cavities (1901)
Figure 20:
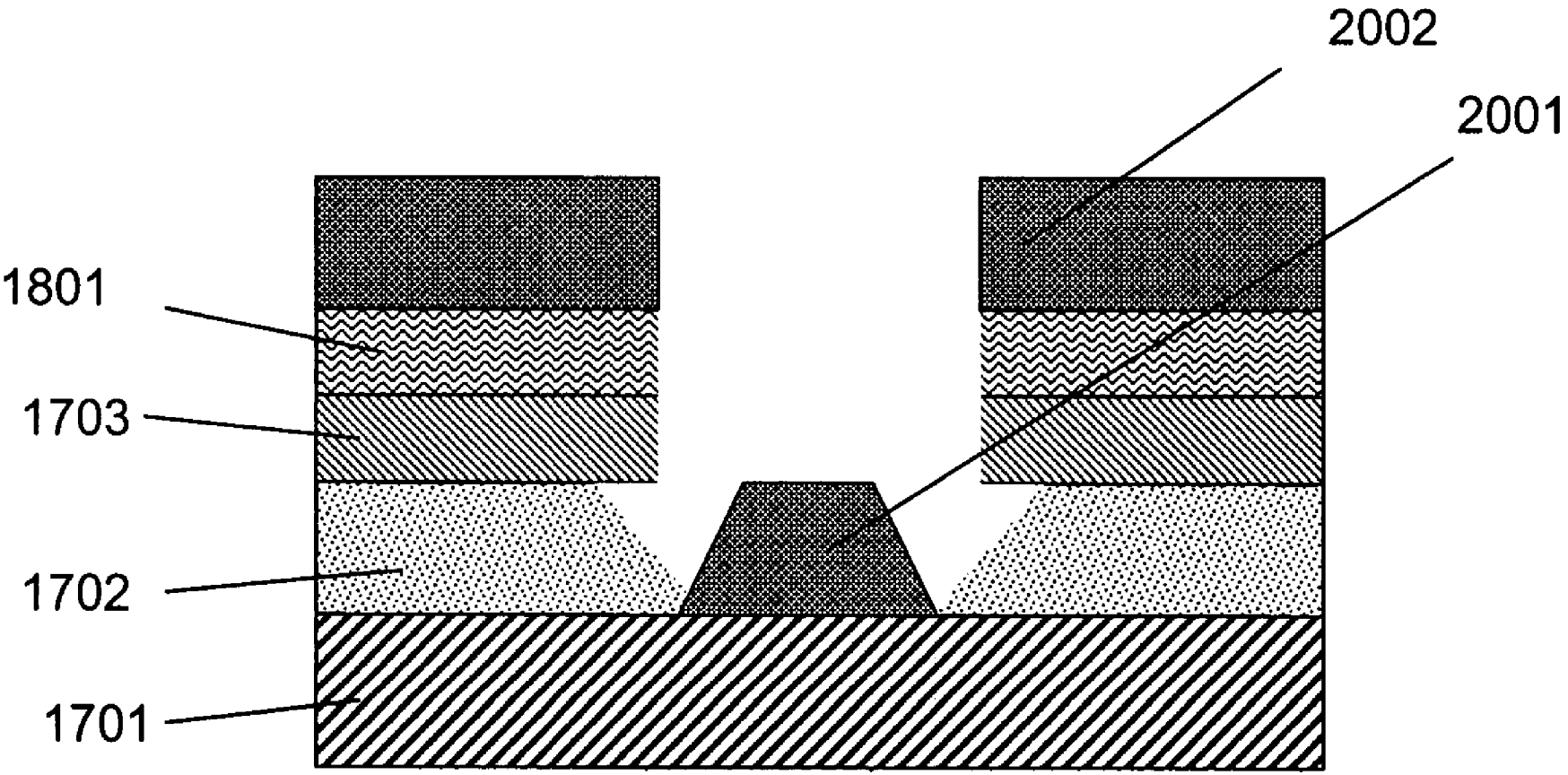
FIG. 20 depicts the article of FIG. 19 in the micro-cavities of which have been deposited Al mesas.

FIG. 18 illustrates the above-described thin film material on which a patternable material 1801 has been deposited and lithographically-patterned. This lithographically-patterned layer 1801 then allows for selective etching of the conductive layer 1703 and dielectric layer 1702, as shown in FIG. 19, where micro-cavities 1901 are formed that expose select regions of the substrate 1701 (note that alignment of layers 1801, 1703, and 1702 is variable). Referring to FIG. 20, inside these microcavities, Al mesas 2001 (a type of post) can be deposited. Al deposited on top of the residual patternable material (i.e., deposited Al layer 2002) can then be removed together with the patternable material. Suitable lithography and etching techniques are described above for the previous embodiments. Al mesas 2001 can be deposited in the microcavities using any suitable technique including, but not limited to, thermal metal evaporation, electron-beam metal evaporation, and combinations thereof. In some embodiments, the Al mesas 2001 are deposited as a Al stack, e.g., Ti/Cu/Ti/Al. See above for descriptions of sacrificial barrier layers, etc.

Figure 21:
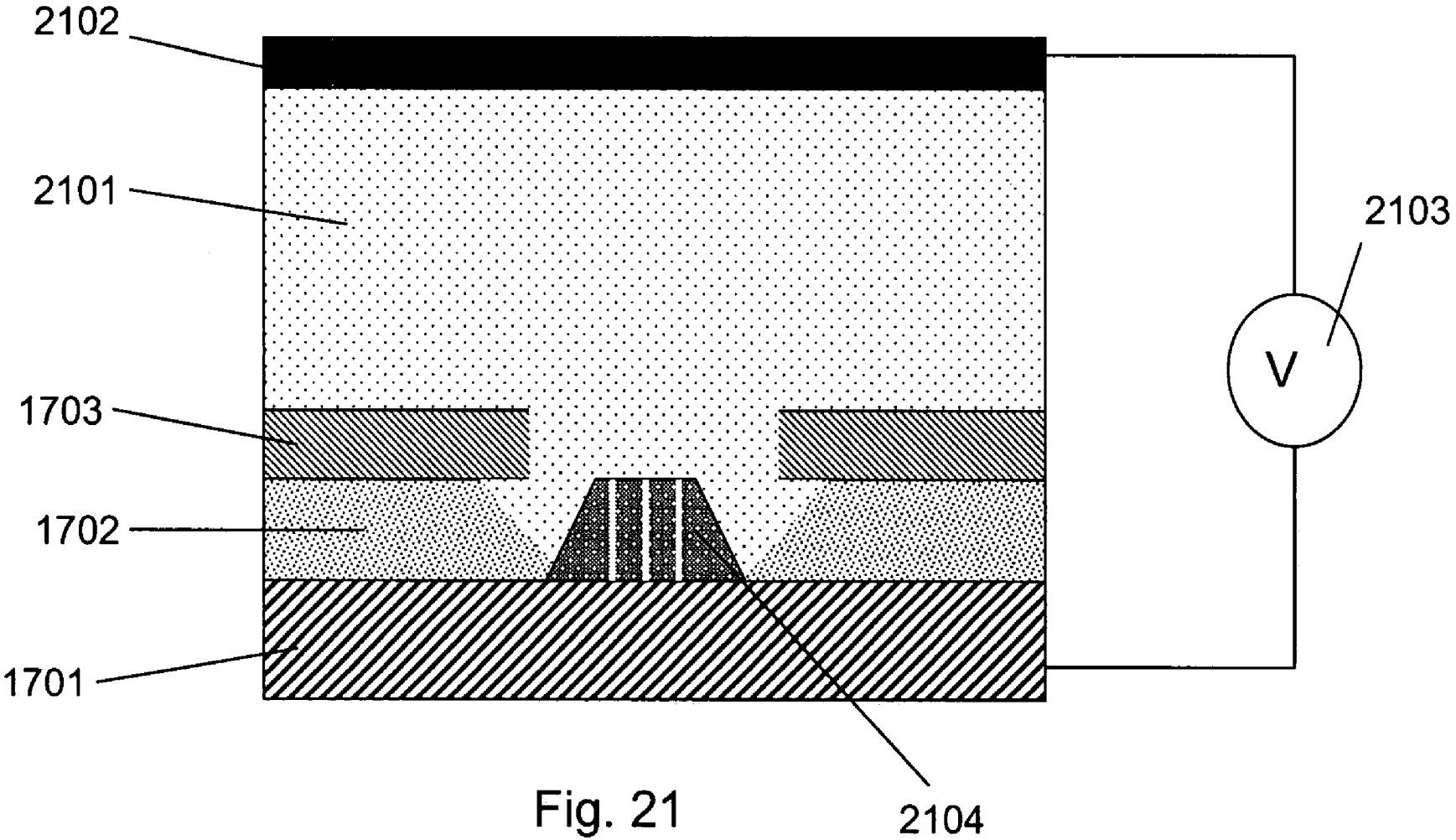
FIG. 21 depicts the anodization of the article of FIG. 20 to yield nanoporous AAO mesas (2104)
Figure 22:
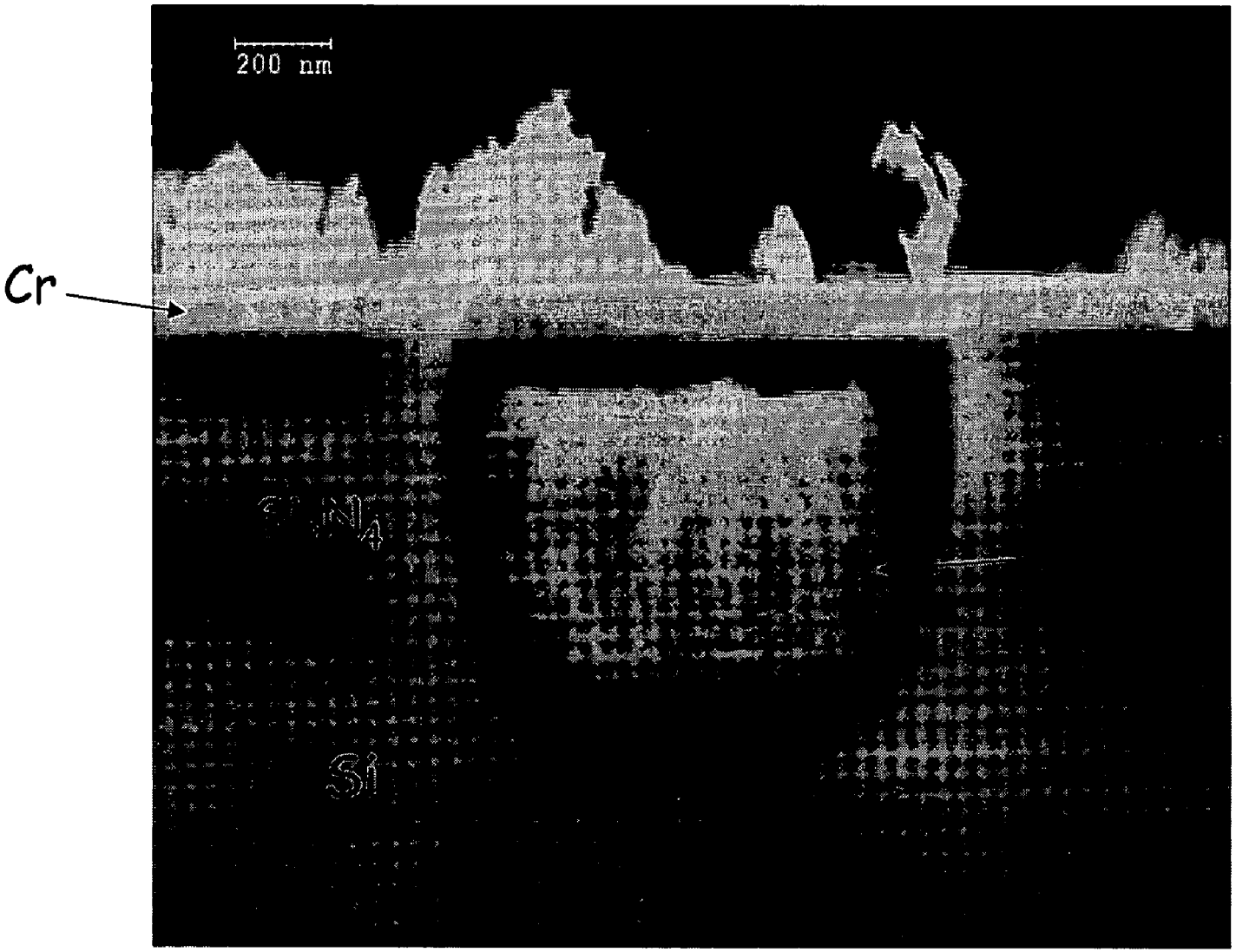
FIG. 22 is an FE-SEM image depicting AAO posts (e.g., mesas) in a microcavity, in accordance with some embodiments of the present invention.
Figure 23:
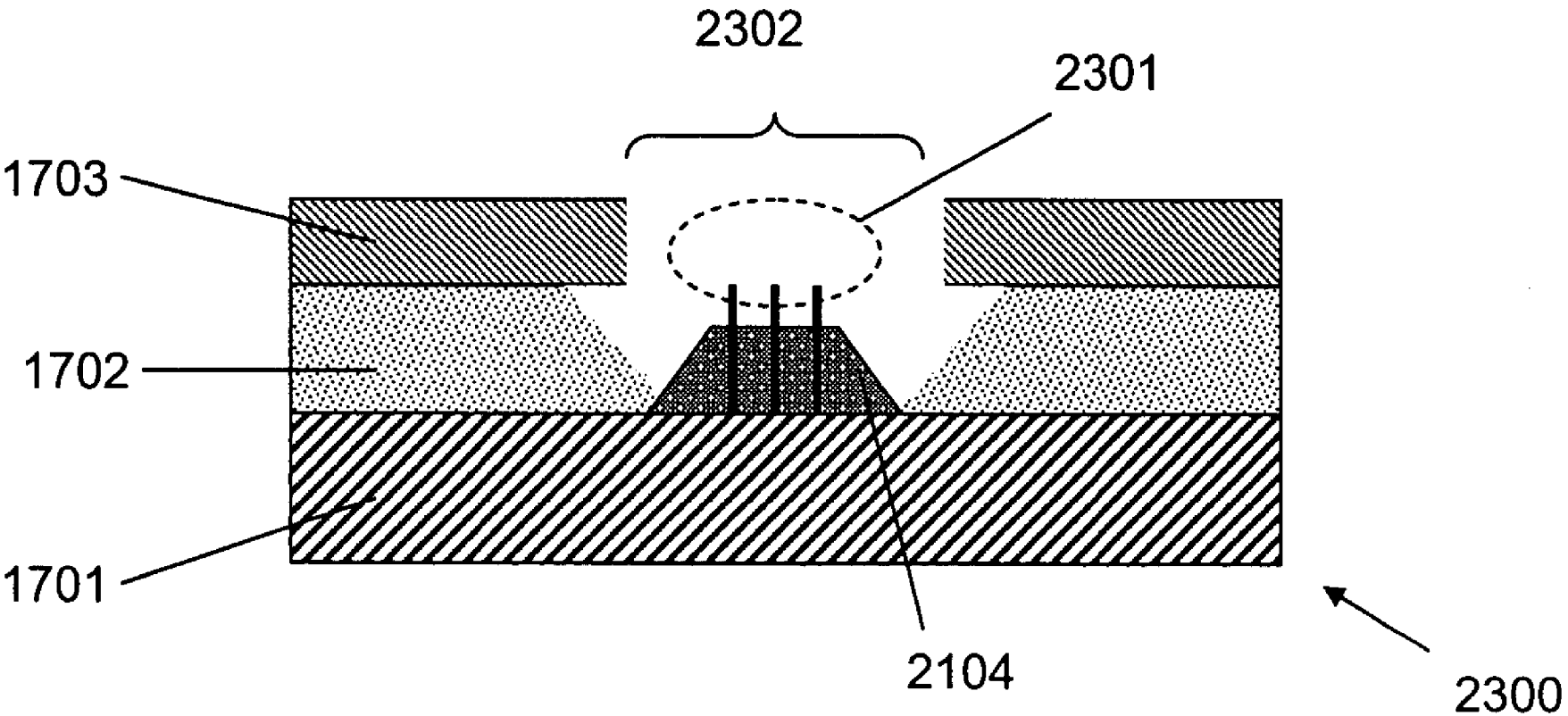
FIG. 23 depicts the article of FIG. 21, into the nanoporous AAO mesas of which nanorods have been electrochemically deposited, and where the AAO around these nanorods has been etched back to yield gated nanorod field emitters, in accordance with some embodiments of the present invention.

Referring to FIG. 21, the Al mesas 2001 can be electrochemically anodized to nanoporous AAO mesas 2104 in an electrolyte 2101, using a counter electrode 2102 and a power supply 2103. FIG. 22 is an FE-SEM image depicting AAO mesas in a microcavity. Referring to FIG. 23, nanorods 2301 can then be electrochemically deposited in the nanopores of the nanoporous AAO mesas 2104 to yield a gated field emitter device 2300. Suitable anodization and electrodeposition techniques are described above for the previous embodiments.

Figure 27:
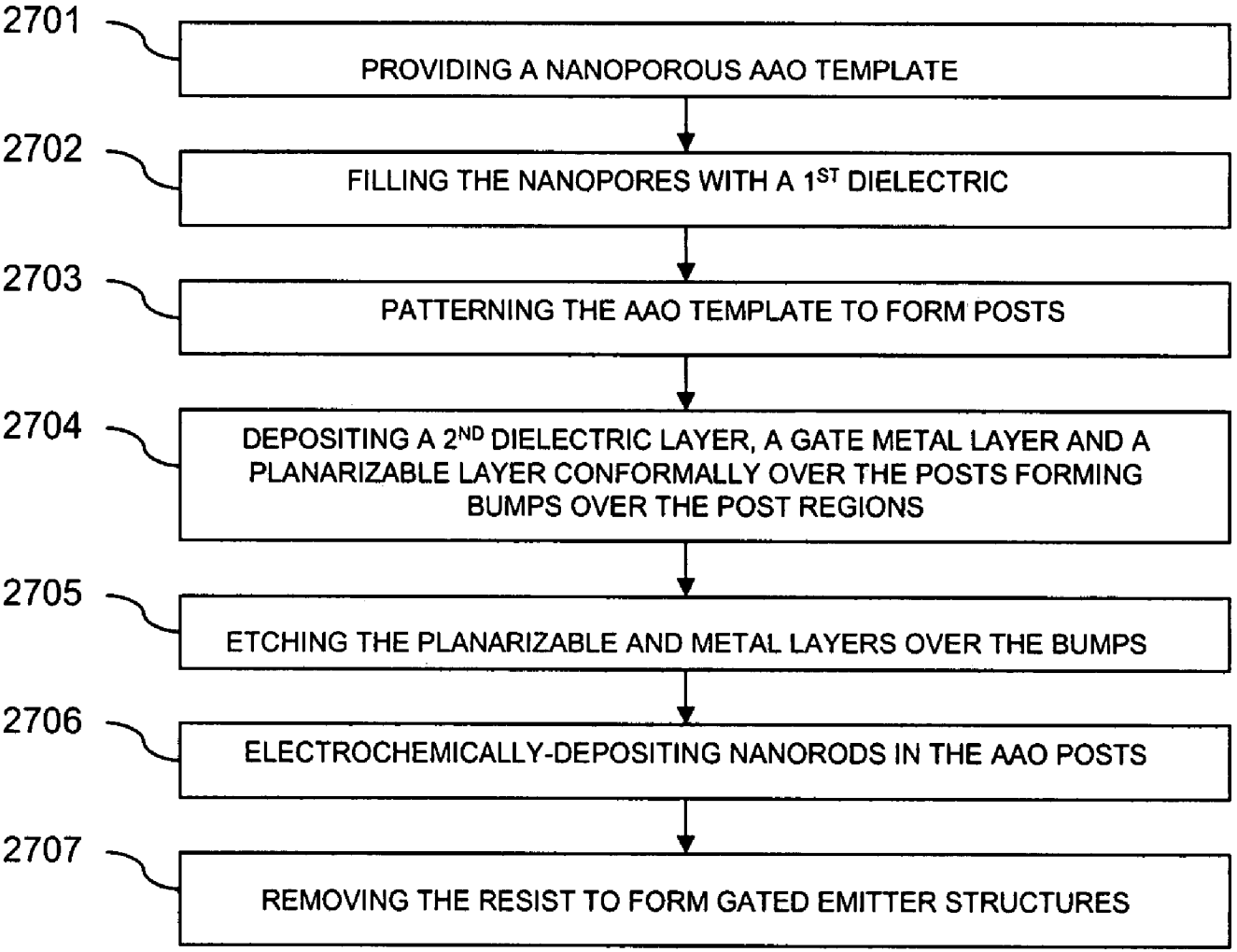
FIG. 27 depicts, in flow diagram form, methods for making gated nanorod field emitters, in accordance with some embodiments of the present invention.

Referring to FIG. 27, as another alternative to the above-described embodiments, in some or other embodiments the present invention is directed to methods comprising the steps of: (2701) providing a nanoporous AAO template comprising nanopores that extend down to a substrate-supported conductive layer on which the nanoporous AAO template resides; (2702) filling the nanopores with nanopore filler comprising a first dielectric material to form a filled nanoporous AAO template; (2703) patterning and etching the AAO template to form AAO posts; (2704) conformally depositing: (i) a dielectric layer comprising a second dielectric material, (ii) a gate metal layer, such that the dielectric and gate metal layers form a bump in the regions over the AAO posts, and (iii) a planarizable layer over the bumps that is subsequently planarized via reflow; (2705) etching the dielectric, gate metal, and planarizable layers over the bump to form vias, such vias providing depositional access to the AAO posts; (2706) electrochemically-depositing nanorods in the AAO posts and etching back the AAO to more fully expose the nanorods; and (2707) removing the planarizable layer to form gated nanorod emitter structures. Variations on these embodiments include, but are not limited to, fabricating posts in the Si substrate that the AAO posts can reside on. Note that the gate metal layer need not be a metal, but that it must only generally be conductive (vide infra) so as to be operable for use as a gate.

Figure 24:
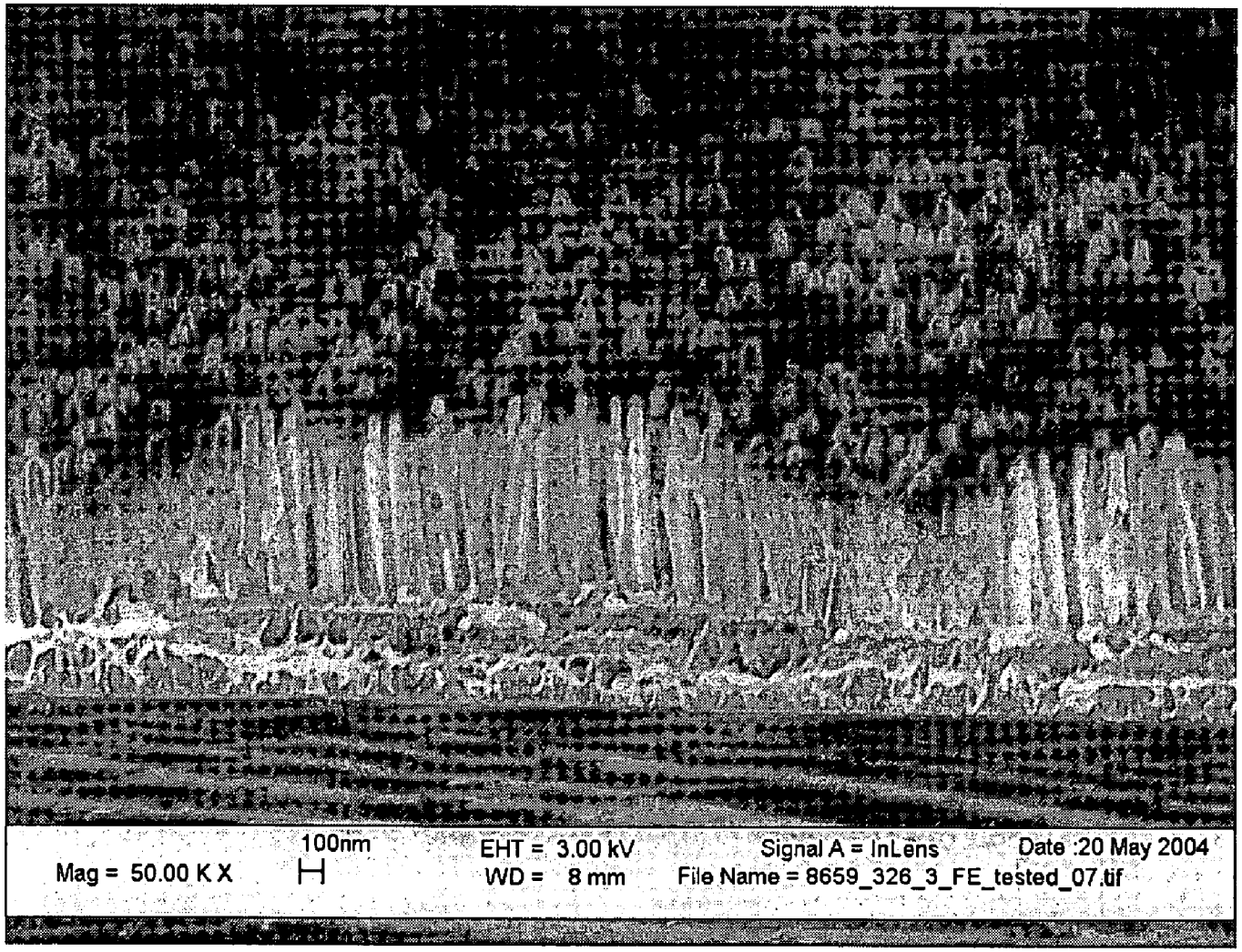
FIG. 24 is an FE-SEM image depicting electrochemically-deposited nanorods in an AAO template where the AAO has been selectively etched such that the tops of the nanorods are observed protruding above the plane of the AAO template, in accordance with some embodiments of the present invention.
Figure 28:
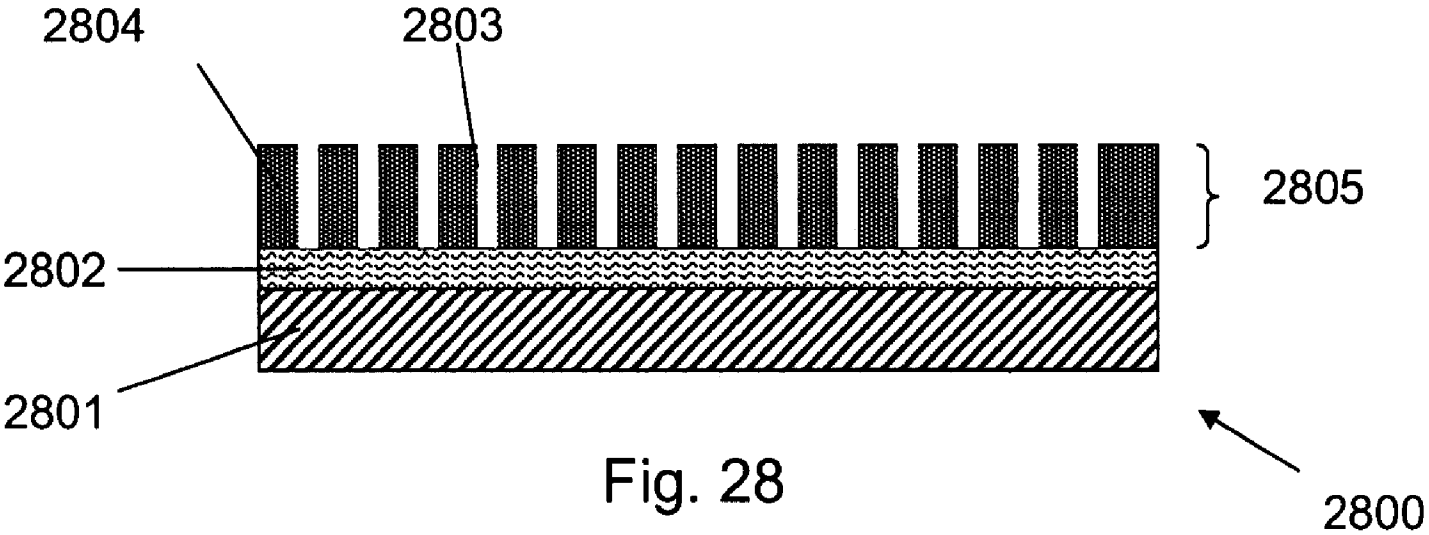
FIG. 28 illustrates a substrate supported AAO template (2800) comprising a substrate (2801), a conductive layer (2802), and an AAO layer (2805)
Figure 55:
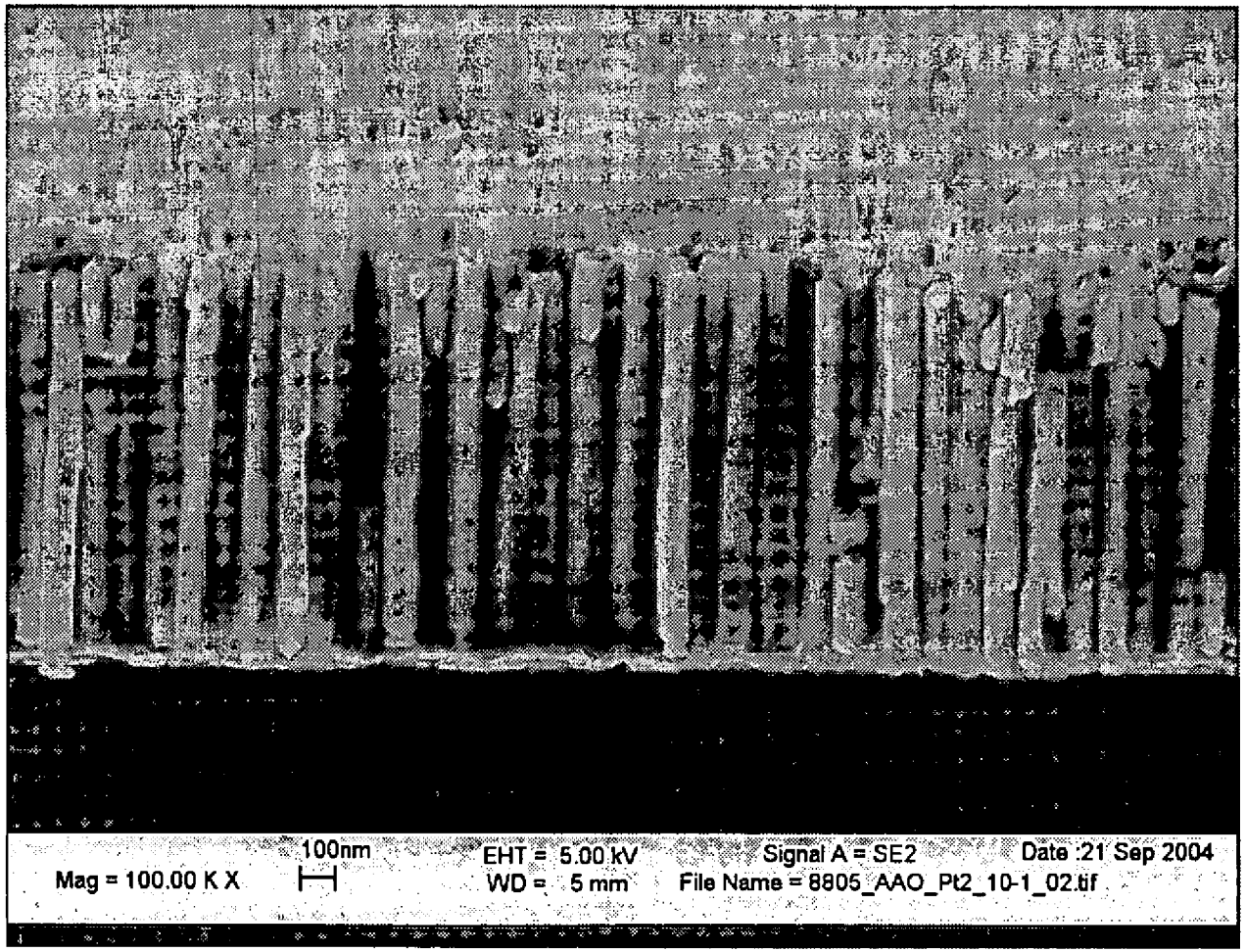
FIG. 55 is an FE-SEM image of Pt nanorods electrochemically deposited in an AAO template with an underlying TiW/Au/Ti conductive (buffer) layer, in accordance with some embodiments of the present invention.

Referring to FIG. 28, the nanoporous AAO template 2805 comprises nanopores 2803 that extend down through the AAO 2804 to a substrate-supported conductive layer 2802 (supported by substrate 2801) on which the nanoporous AAO template 2805 resides. In some embodiments, the substrate 2801 comprises an adhesion layer and a substrate base similar to that shown in FIG. 4. In some embodiments, the substrate-supported conductive layer 2802 comprises a sacrificial barrier layer analogous to that depicted in FIG. 5. FIG. 24 is a FE-SEM image of Ni nanorods electrochemically-deposited in an AAO template with an underlying Nb oxide conductive (buffer) layer, in accordance with some embodiments of the present invention. Similarly, FIG. 55 is an FE-SEM image of Pt nanorods electrochemically-deposited in an AAO template with an underlying Au conductive layer comprising a Ti sacrificial barrier layer, and a TiW adhesion layer on the substrate.

Figure 29:
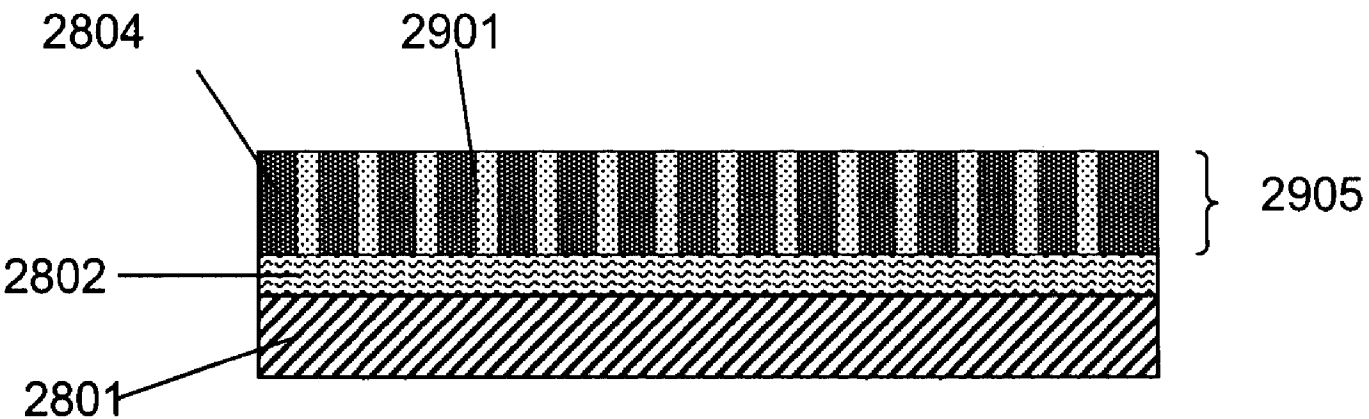
FIG. 29 illustrates the deposition of dielectric material into the nanopores of the substrate supported AAO template of FIG. 28.
Figure 30:
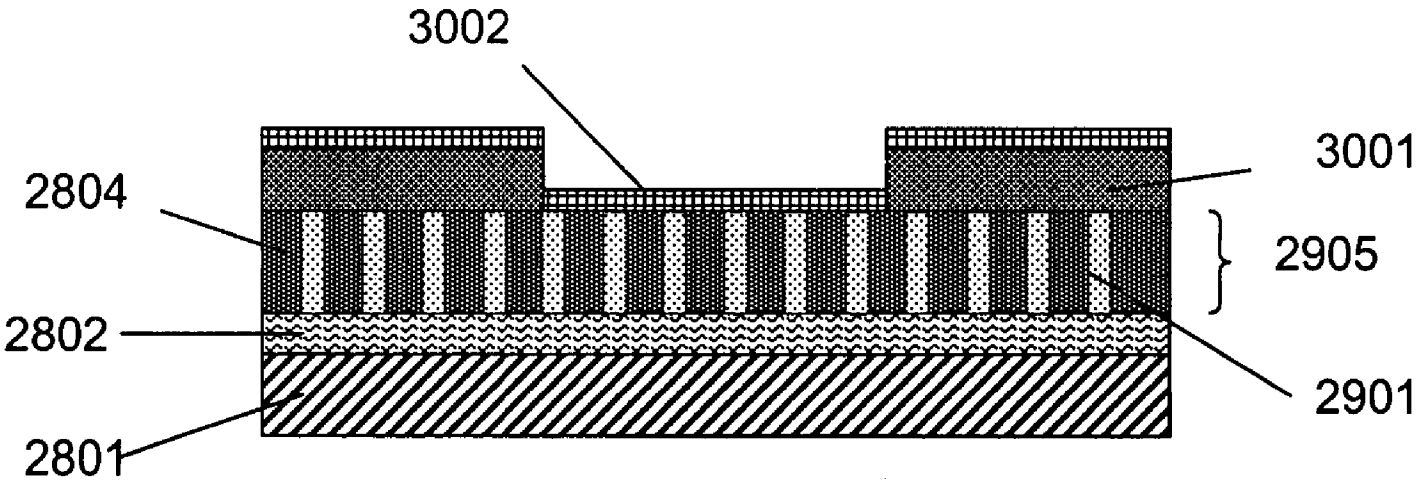
FIG. 30 illustrates the deposition of a masking (metal) layer (3002) to surface of the assembly shown in FIG. 29, after having been patterned with a patternable (e.g., resist) material (3001)
Figure 31:
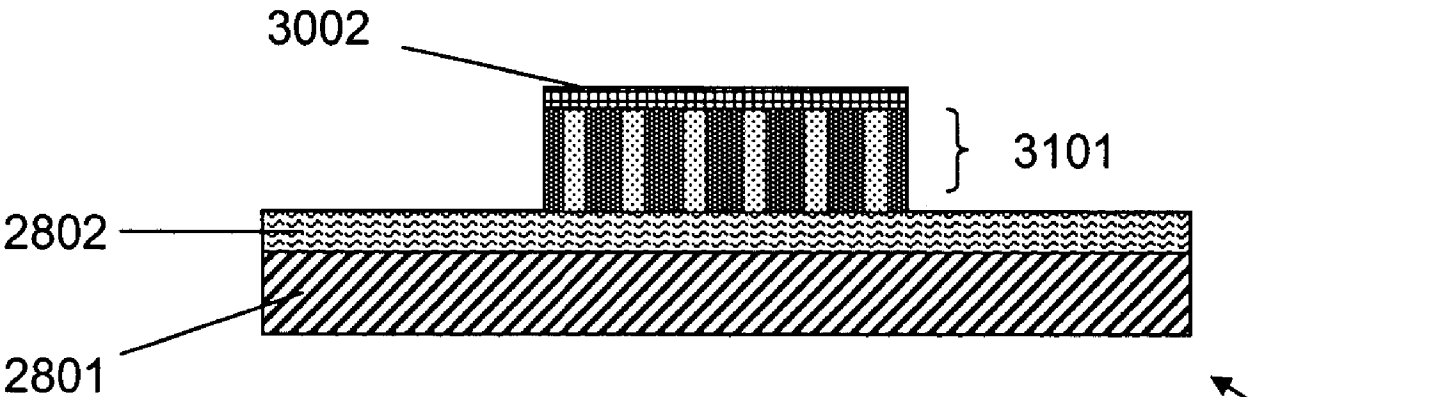
FIG. 31 illustrates the formation of nanoporous AAO posts (3101) by resist removal and etching of the structure shown in FIG. 30.

Filling of the nanopores 2803 with a first dielectric material 2901 to yield a filled AAO template 2905 is depicted in FIG. 29. Patterning and etching the AAO template to form AAO posts is depicted in FIG. 30, where a patternable (e.g., resist) material 3001 is deposited on the filled AAO template 2905. The patternable material is then patterned and a masking material (e.g., metal) 3002 is deposited over the patterned layer. The patternable material is then removed and the filled AAO template not masked by masking material 3002 is etched away to yield AAO posts 3101, as shown in FIG. 31. Suitable masking materials include, but are not limited to easily etchable materials such as Ni, Cr, Al, and the like.

Figure 32:
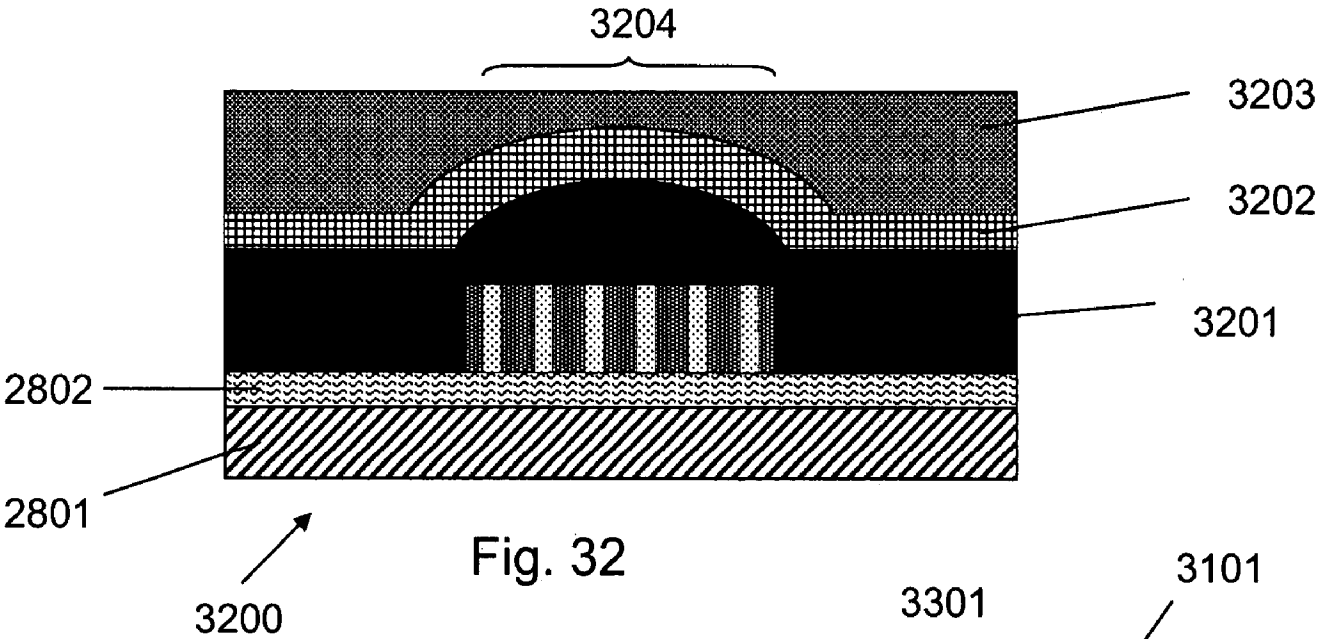
FIG. 32 illustrates the deposition of a stack of conformal layers comprising layers of (a) dielectric (3201), (b) metal (3202), and (c) planarizable (resist) material (3203) over the AAO posts of the structure shown in FIG. 31, wherein the dielectric and metal layers layers form a "bump" in the region over the AAO posts, and the planarizable layer planarizes the stack.
Figure 33:
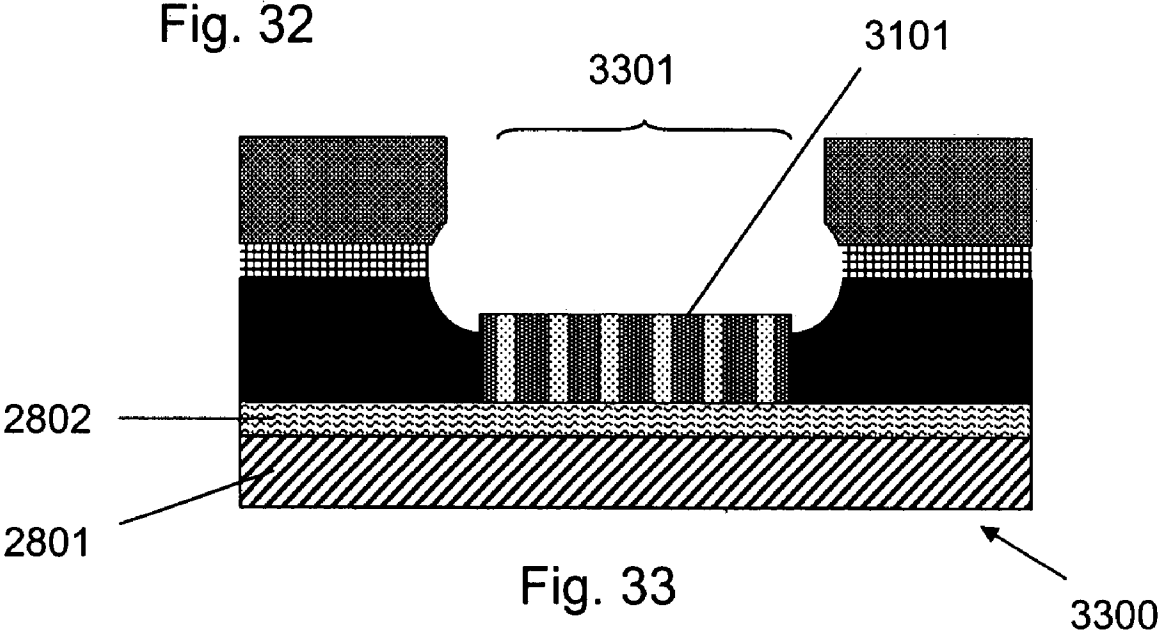
FIG. 33 illustrates the structure of FIG. 32 after having etched away the layers in the bump region to create vias (3301) over AAO posts (3101)
Figure 34:
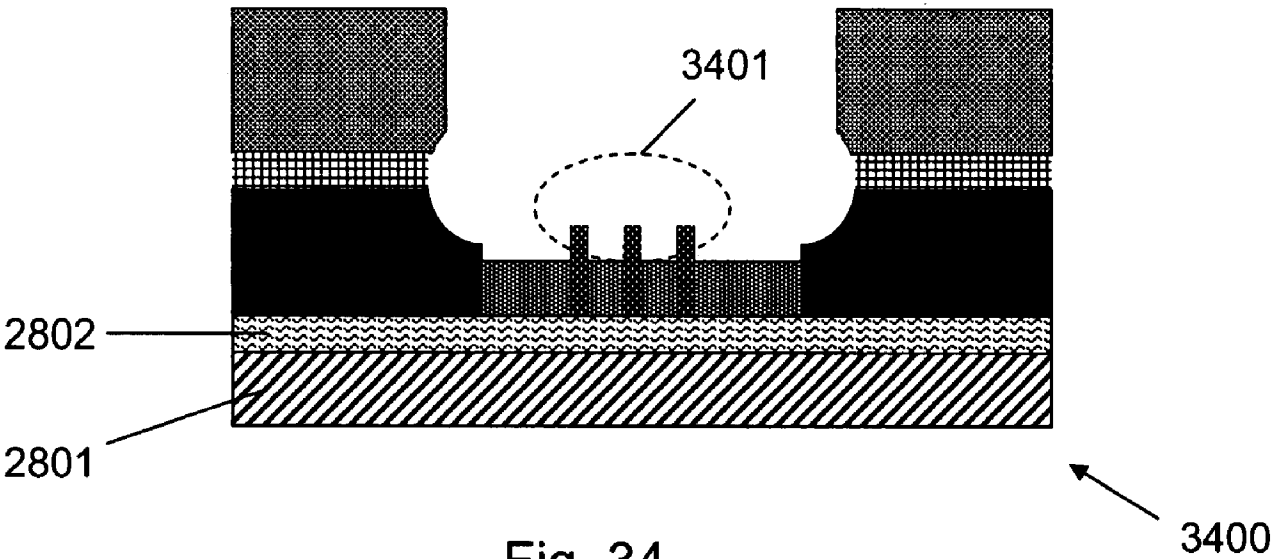
FIG. 34 illustrates the structure of FIG. 33, but where nanorods (3401) have been deposited in the AAO posts, and where the AAO has been etched back.
Figure 35:
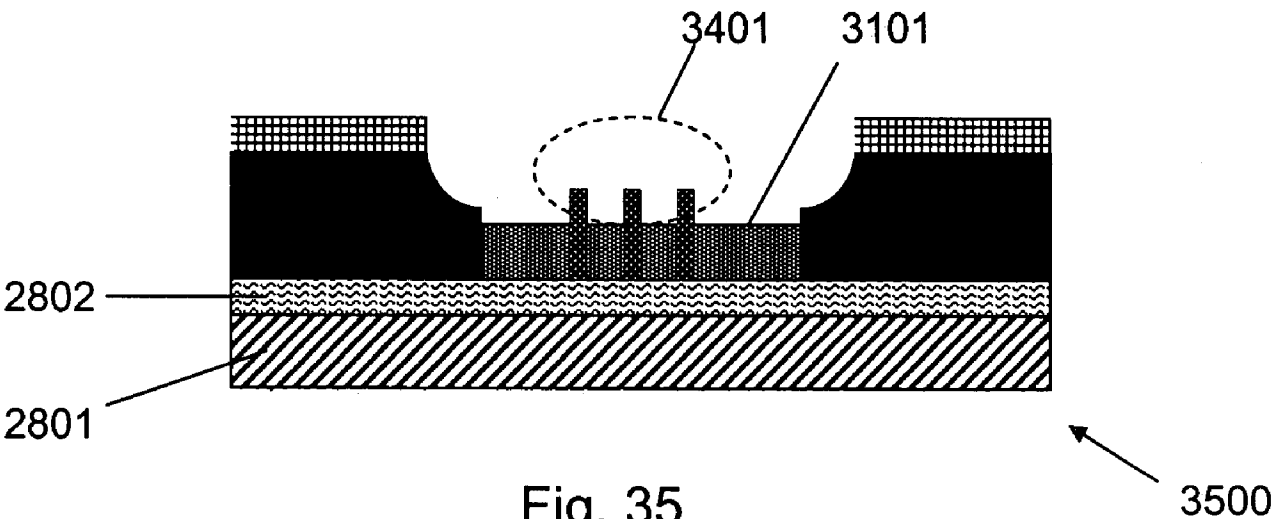
FIG. 35 illustrates the structure of FIG. 34, where the layer of patternable material has been removed to yield a gated emitter structure (3500), in accordance with some embodiments of the present invention.

Referring to FIG. 32, conformal deposition of a dielectric layer 3201, a gate metal layer 3202, and a planarizing layer 3203 (e.g., reflowed resist) over the AAO post 3101 forms a bump region 3204 over the AAO post region. Suitable conductive gate materials include, but are not limited to, metals, such as Nb, Pt, Al, W, Mo, Ti, Ni, Cr, TiW, and the like; semiconductors, such as highly-doped Si, GaN, GaAs, SiC, doped poly Si, doped amorphous Si, and the like; and combinations thereof. Etching of the bump region 3204 is shown in FIG. 33 to yield a via 3301 exposing AAO post 3101. Referring to FIG. 34, nanorods 3401 are deposited in the AAO post, and the AAO is etched back to more fully expose the nanorods. Finally, as shown in FIG. 35, the patternable layer is completely removed to yield gated nanorod emitter structure 3500. Note that materials, depositional layer thicknesses, etching, electrochemical deposition, etc. can all be as generally described above.

Figure 36:
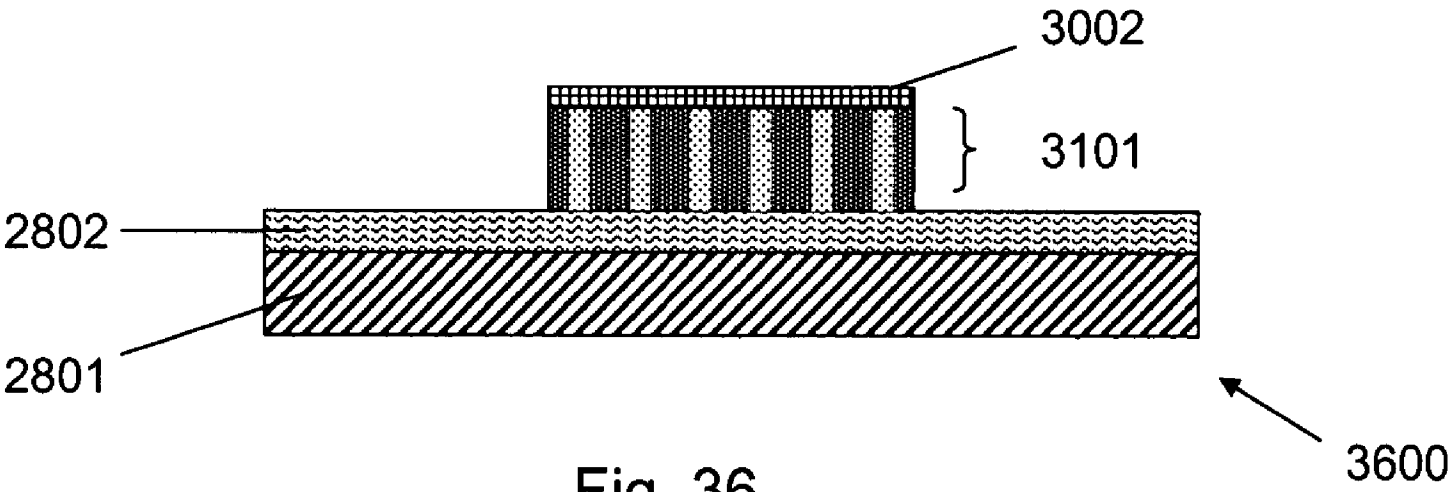
FIG. 36 illustrates a step in an alternative embodiment, where the structure (3600) is essentially identical to that shown in FIG. 31, wherein the structure (3600) comprises a substrate (2801), a conductive layer (2802), and an AAO post (3101) capped with a masking layer (3002)
Figure 37:
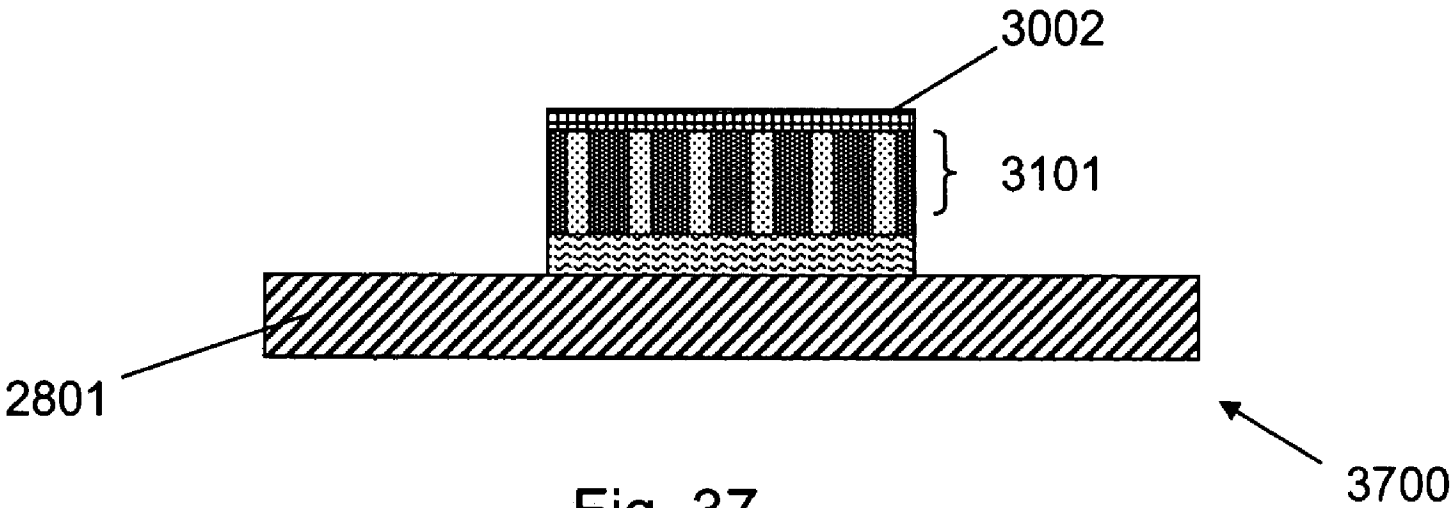
FIG. 37 illustrates the structure of FIG. 36, after the conductive layer surrounding the AAO post has been etched away.
Figure 38:
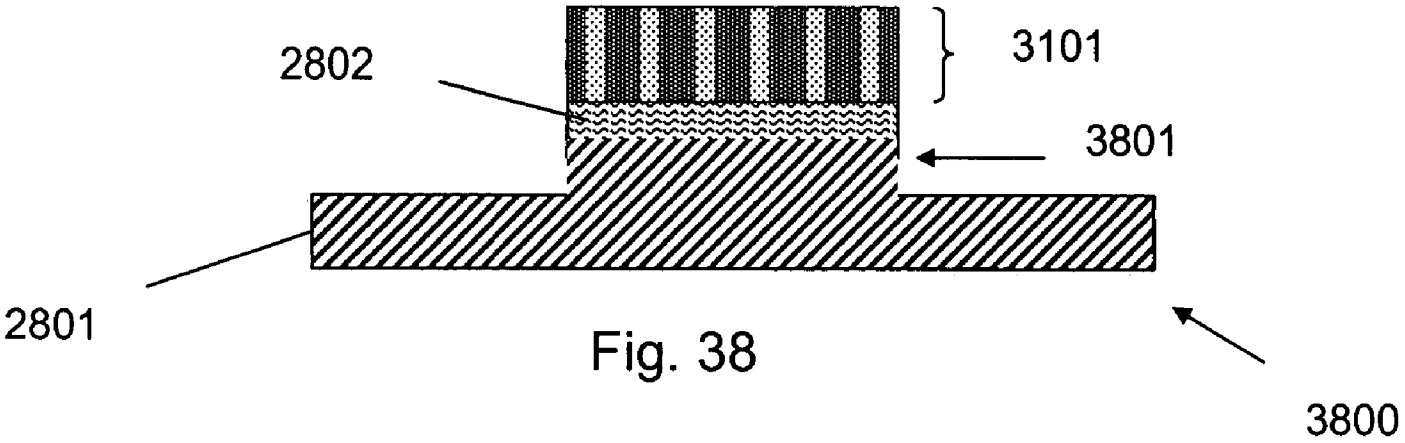
FIG. 38 illustrates the structure of FIG. 37, wherein the surrounding substrate material has been etched to form substrate posts (3801) with which elevated AAO posts (3802) can be formed.
Figure 39:
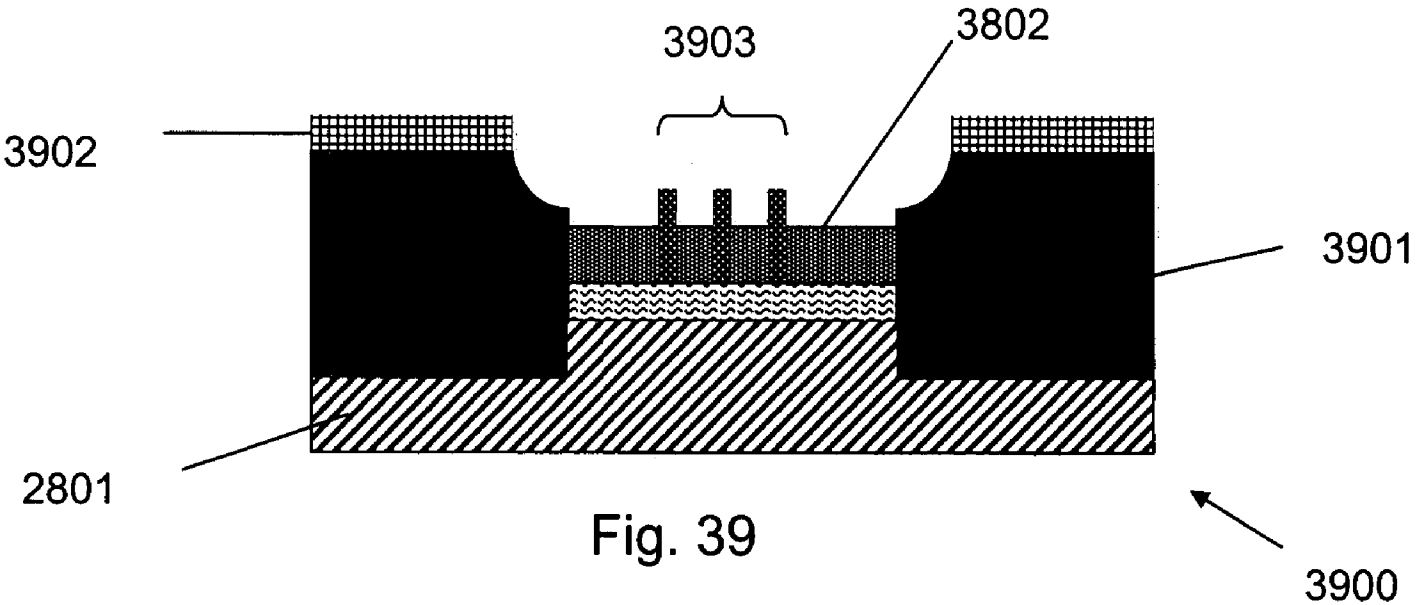
FIG. 39 illustrates the structure of FIG. 38, wherein nanorods (3903) have been electrochemically-deposited in the AAO posts and dielectric and gate metal layers have been deposited and etched to form vias over the posts comprising the nanorods.
Figure 56:
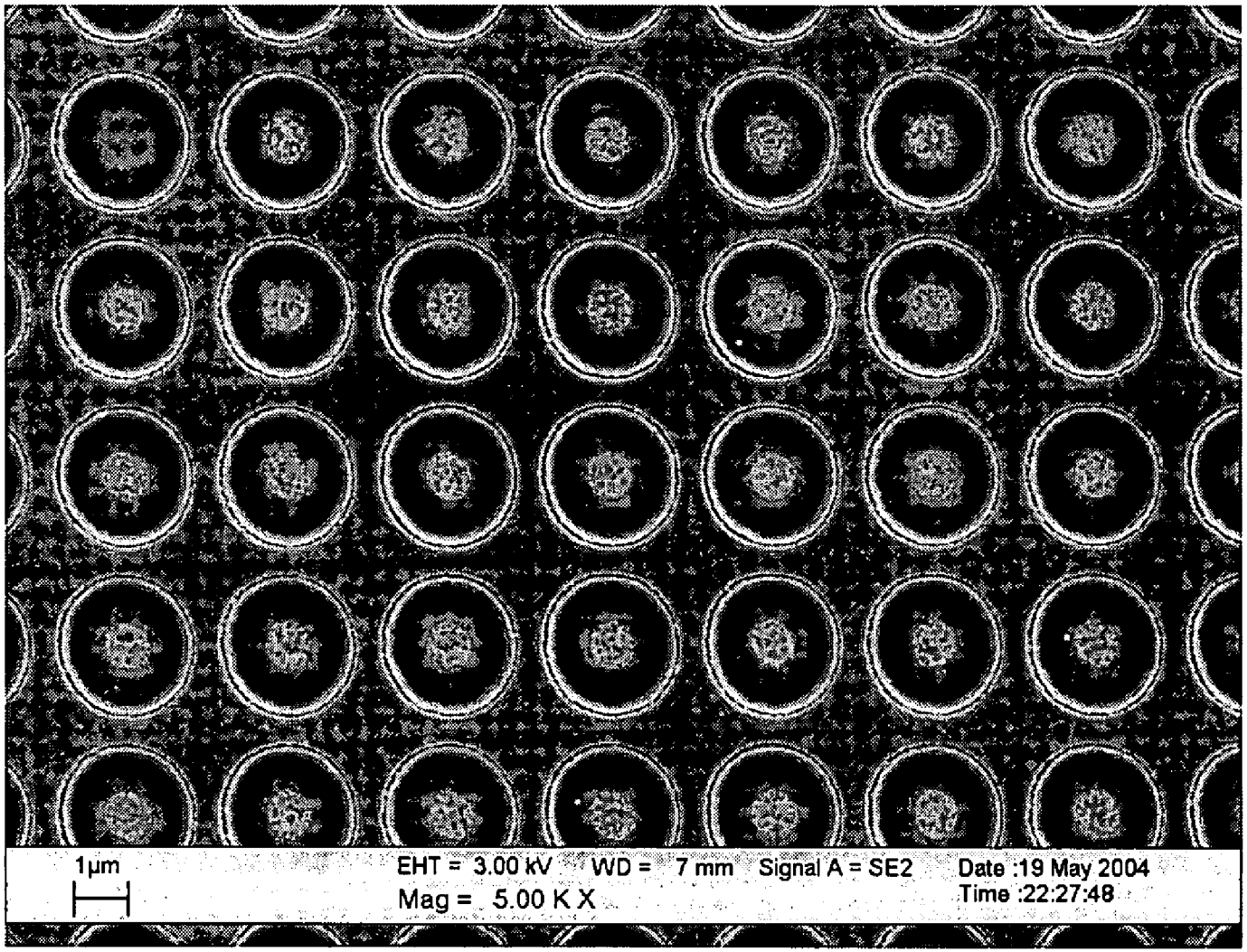
FIG. 56 is a top-down FE-SEM image of a Si post with integrated gate structure.
Figure 57:
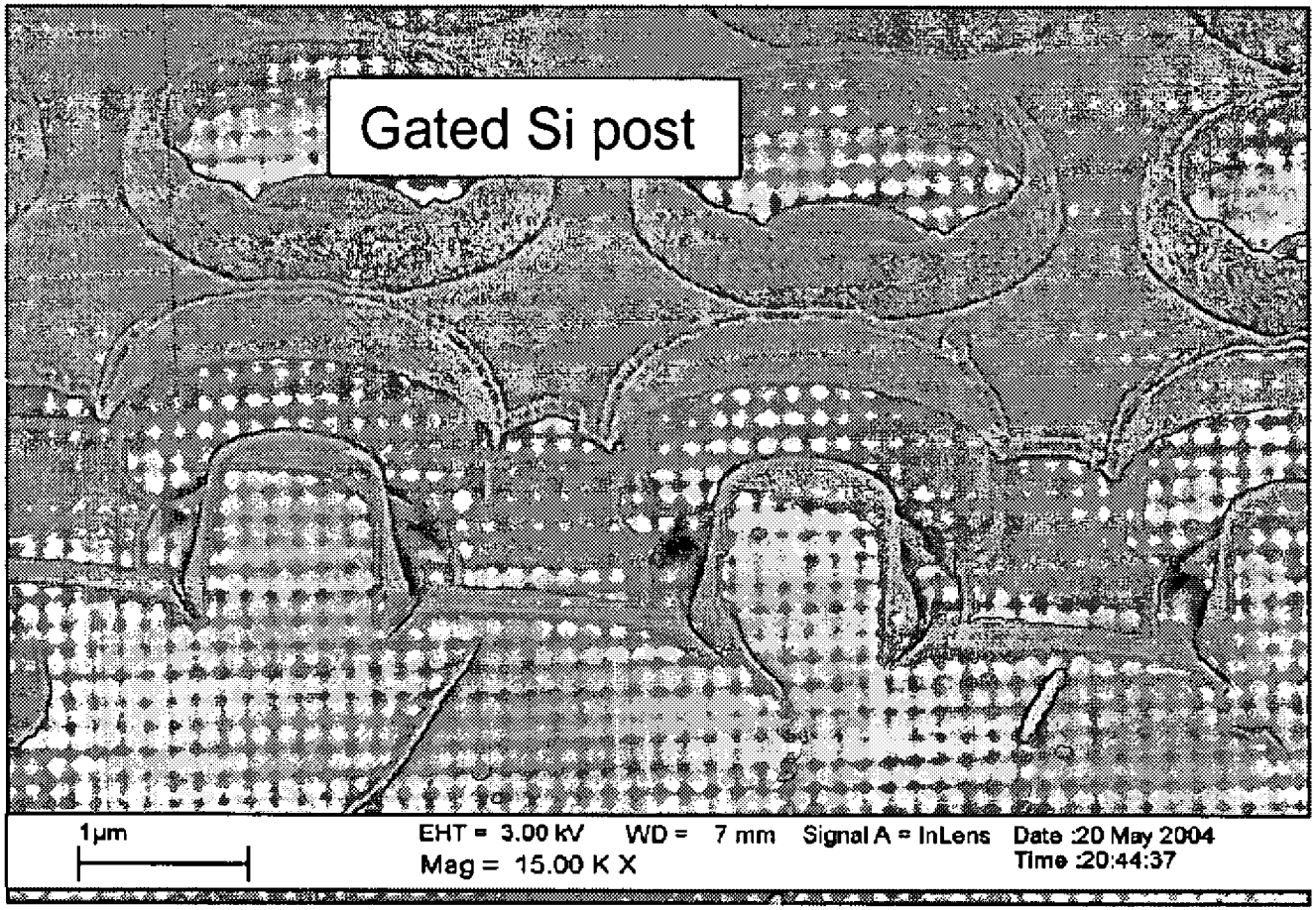
FIG. 57 is a FIB cross-sectional image of the sample shown in FIG. 56, wherein the image demonstrates the feasibility of post processing with a Si post, wherein little or no changes in processing are expected with AAO posts.

In some embodiments, the substrate can be etched to form substrate posts on which the AAO posts reside. Referring to FIG. 36 (identical to FIG. 31), beginning with the substrate-supported filled AAO post 3101, conductive layer 2802 can be etched in the regions around the AAO post 3101 to yield structure 3700, as shown in FIG. 37. Next, as shown in FIG. 38, substrate 2801 can be etched to yield substrate posts 3801, and masking layer 3101 can be removed. As shown in FIG. 39, subsequent processing as described above yields a gated nanorod emitter structure 3900 similar to that shown in FIG. 35, but comprising a substrate post 3801 on which the nanorods (3903)/AAO post (3802) can reside and be elevated. FIG. 56 is a top-down FE-SEM image of a Si post with integrated gate structure and FIG. 57 is a focused ion beam (FIB) cross-sectional image of the sample shown in FIG. 56, wherein the image demonstrates the feasibility of post processing with a Si post, wherein little or no changes in processing are expected with AAO posts.

Figure 40:
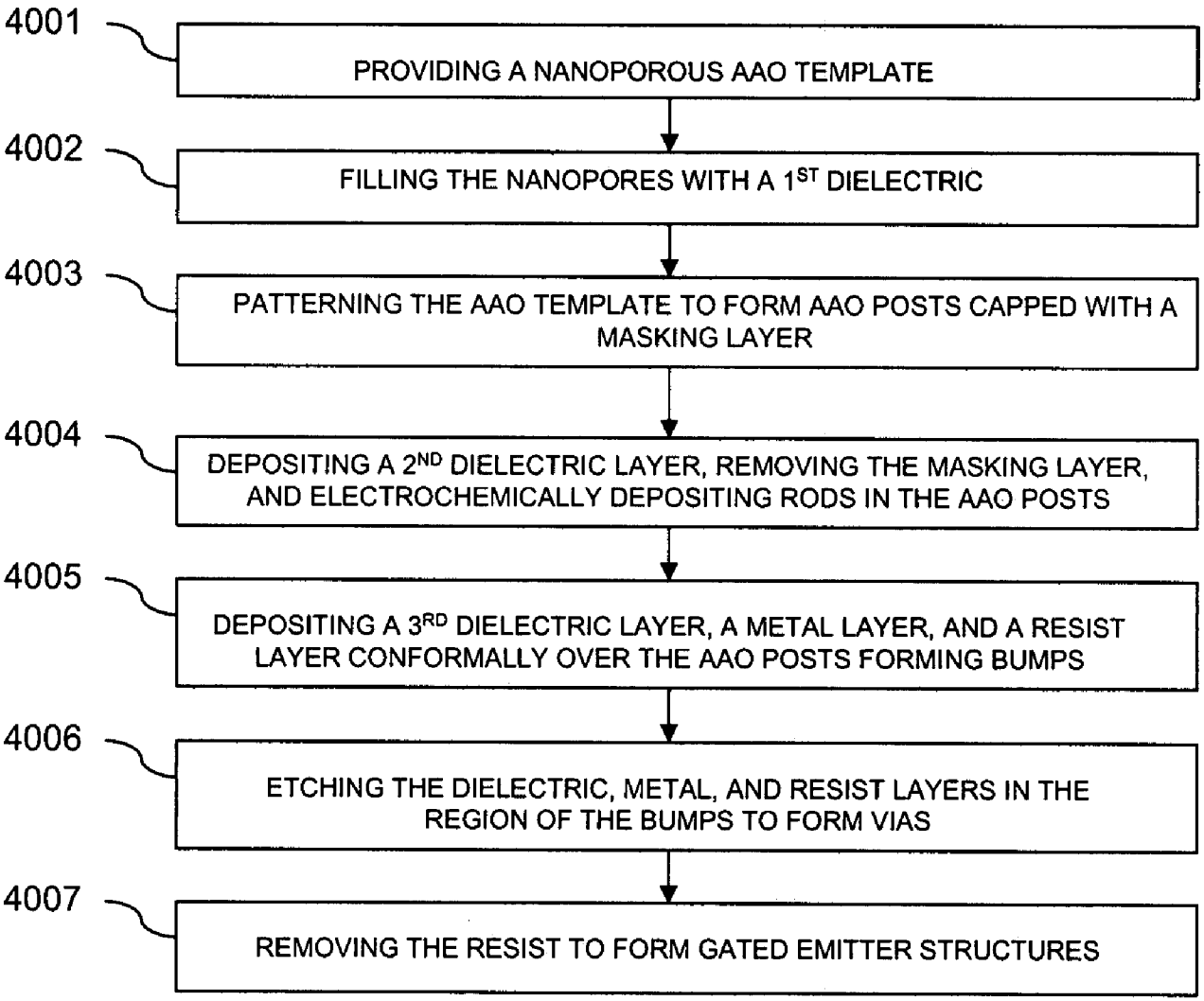
FIG. 40 depicts, in flow diagram form, methods for making gated nanorod field emitters, in accordance with some embodiments of the present invention.

Referring to FIG. 40, as another alternative to the above-described embodiments, in some or other embodiments the present invention is directed to methods comprising the steps of: (4001) providing a nanoporous AAO template comprising nanopores that extend down to a substrate-supported conductive layer on which the nanoporous AAO template resides; (4002) filling the nanopores with nanopore filler comprising a first dielectric material to form a filled nanoporous AAO template; (4003) patterning and etching the AAO template to form AAO posts capped with a masking layer; (4004) depositing a thin conformal layer of a second dielectric material over the capped AAO posts, removing residual masking layer to expose the AAO posts, electrochemically-depositing nanorods in the AAO posts to form nanorod/AAO posts, and etching back the AAO to more fully expose the nanorods in the nanorod/AAO posts; (4005) conformally depositing: (i) a dielectric layer comprising a second dielectric material, (ii) a gate metal layer, such that the dielectric and gate metal layers form a bump in the regions over the nanorod/AAO posts, and (iii) a planarizable layer over the bumps that is subsequently planarized via reflow; (4006) etching the dielectric, gate metal, and resist layers over the bump to form vias, such vias providing access to the nanorod/AAO posts; and (4007) removing the resist to form gated emitter structures. As above, variations on these embodiments include, but are not limited to, fabricating posts in the Si substrate that the AAO posts can reside on.

Figure 41:
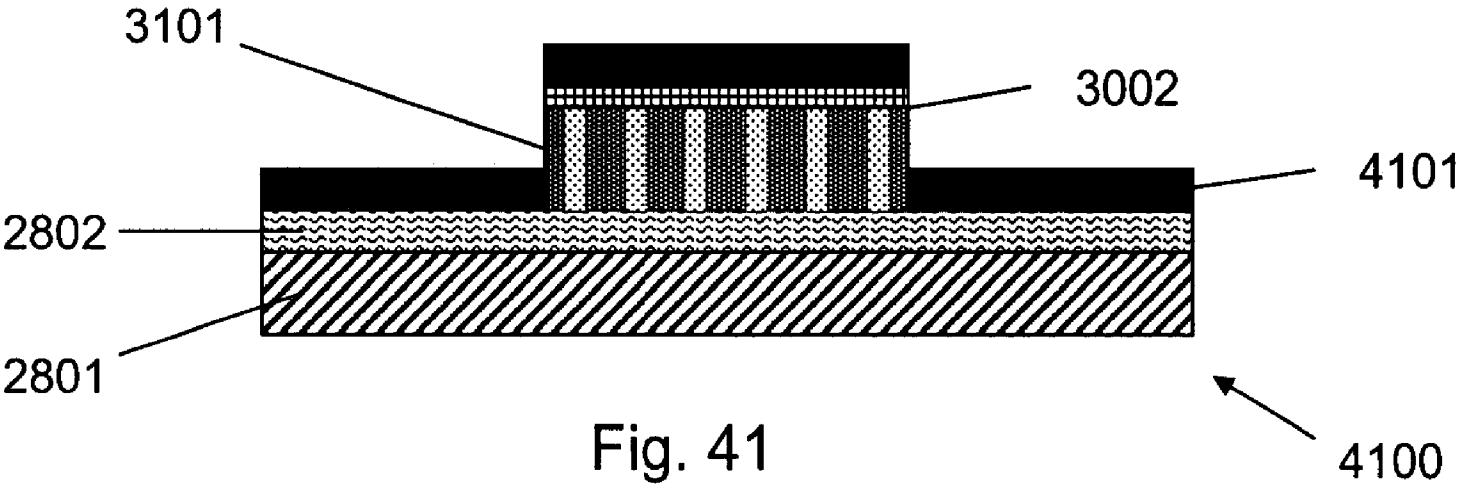
FIG. 41 illustrates the structure of FIG. 31, to which a thin layer of dielectric material (4101) is applied.
Figure 42:
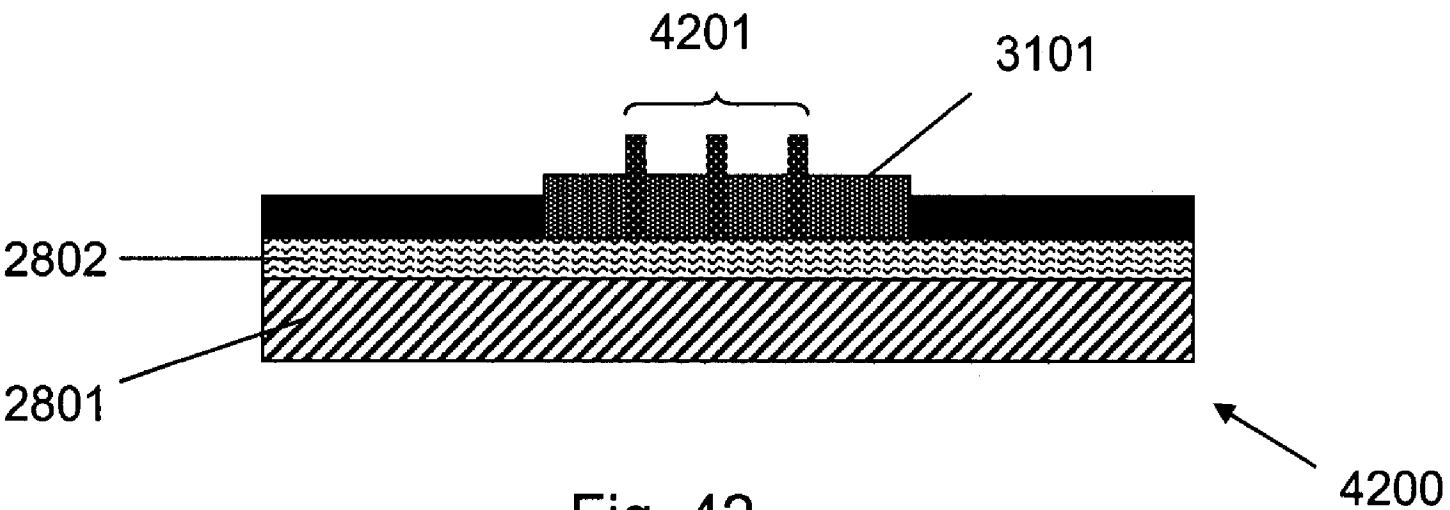
FIG. 42 illustrates the structure of FIG. 41, wherein the metal masking layer is removed, nanorods (4201) are electrodeposited in the pores of the AAO posts (3101), and the AAO is etched back.
Figure 43:
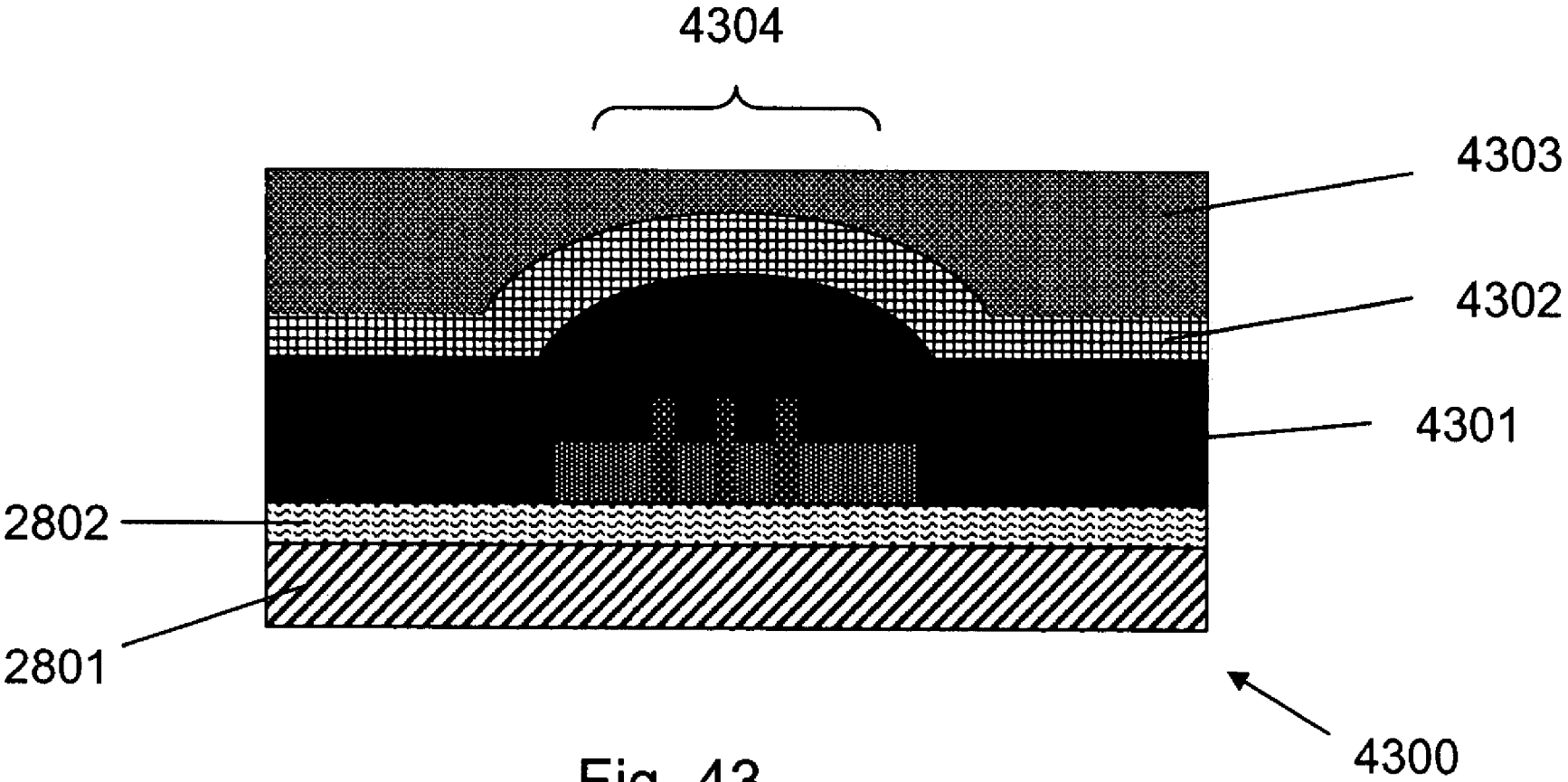
FIG. 43 illustrates the structure of FIG. 42 to which layers of dielectric (4301), metal (4302), and planarizable material (4303) have been conformally applied forming a bump (4304) over the post region.

Starting with structure 3100 shown in FIG. 31, a thin conformal layer of dielectric material 4101 is deposited over the masked AAO posts 3101, as shown in FIG. 41. The masking layer 3002 is then removed, and as shown in FIG. 42, nanorods 4201 are deposited in AAO post 3101 with subsequent etching of the post to yield structure 4200. As shown in FIG. 43, conformal layers of dielectric (4301), gate metal (4302), and planarizable material (4303) are then deposited to from a bump region 4304 over the nanorod/AAO post region. This bump region can then be etched as described above to yield structure 3500, as shown in FIG. 35. Note that materials, depositional layer thicknesses, etching, electrochemical deposition, etc. can all be as generally described above, and that a substrate posts, adhesion layers, sacrificial barrier layers, etc. can be incorporated into this method as well.

Figure 44:
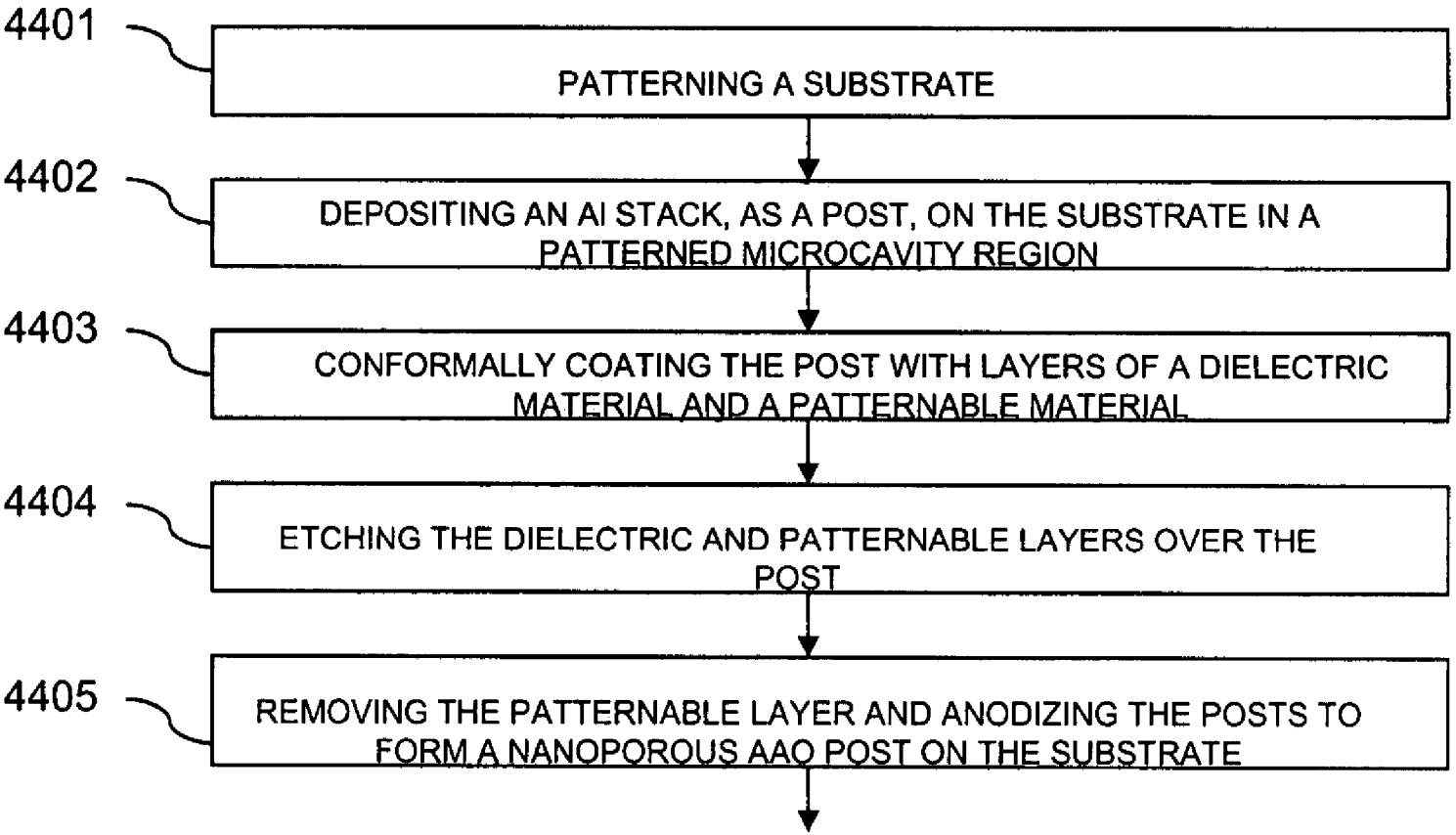
FIG. 44 depicts, in flow diagram form, methods for making gated nanorod field emitters, in accordance with some embodiments of the present invention.

Referring to FIG. 44, as another alternative to the above-described embodiments, in some or other embodiments the present invention is directed to methods comprising the steps of: (4401) patterning a substrate; (4402) depositing at least one Al stack, as an Al post, in a patterned microcavity region of the substrate; (4403) conformally coating the Al post with layers of a dielectric material and a patternable material that is subsequently planarized by reflow; (4404) etching the dielectric and patternable layers over the post; (4405) removing the patternable material and anodizing the posts to form a nanoporous AAO post on the substrate; (4406) electrochemically-depositing nanorods in the AAO posts to form nanorod/AAO posts; (4407) conformally depositing: (i) a dielectric layer comprising a second dielectric material, (ii) a gate metal layer, such that the dielectric and gate metal layers form a bump in the regions over the nanorod/AAO posts, and (iii) a planarizable layer over the bumps that is subsequently planarized via reflow; (4408) etching the planarizable, metal, and dielectric layers over the bump to form a via exposing the nanorod/AAO posts; and (4409) removing the planarizable material to form a gated nanorod emitter structure. Variations on these embodiments include, but are not limited to, fabricating posts in the Si substrate that the AAO posts can reside on.

Figure 45:
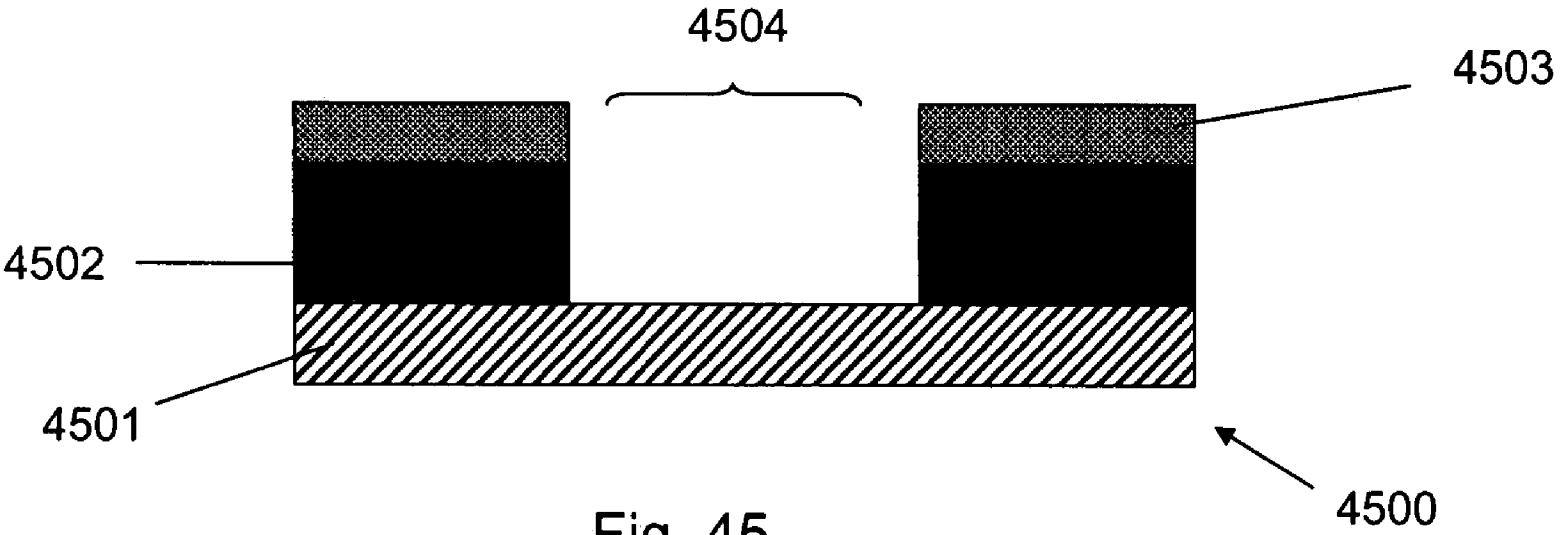
FIG. 45 illustrates a substrate (4501) on which dielectric material (4502) and patternable material (4503) have been deposited, patterned, and etched to yield patterned microcavity regions (4504)
Figure 46:
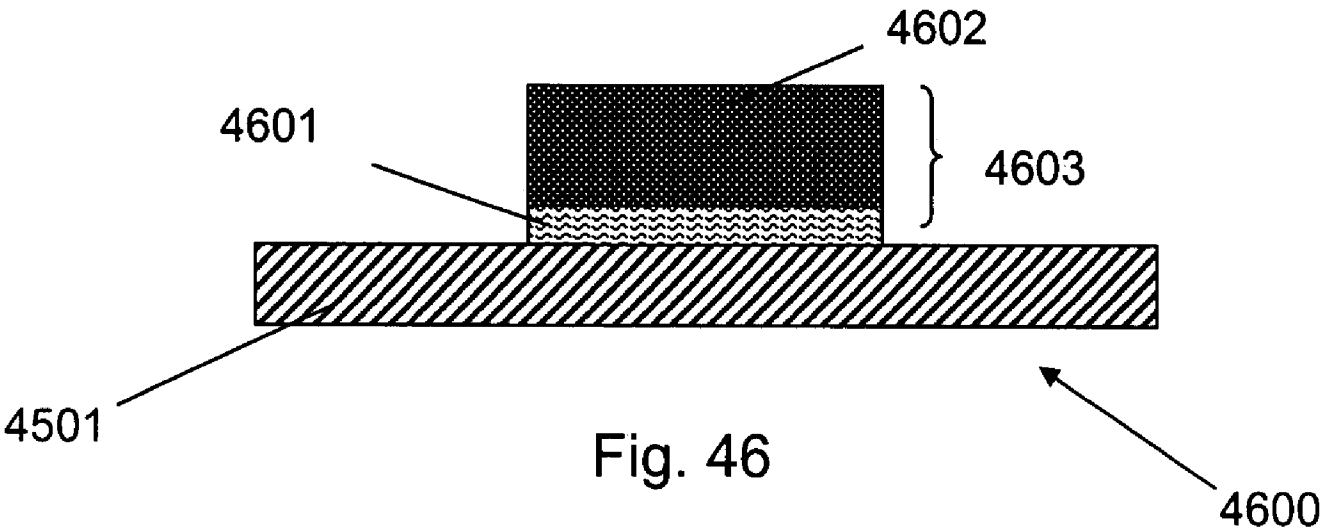
FIG. 46 illustrates an Al stack (4603) deposited in the patterned regions of the substrate shown in FIG. 45, wherein the Al stack comprises a conductive layer (4601) and an Al layer (4602)
Figure 47:
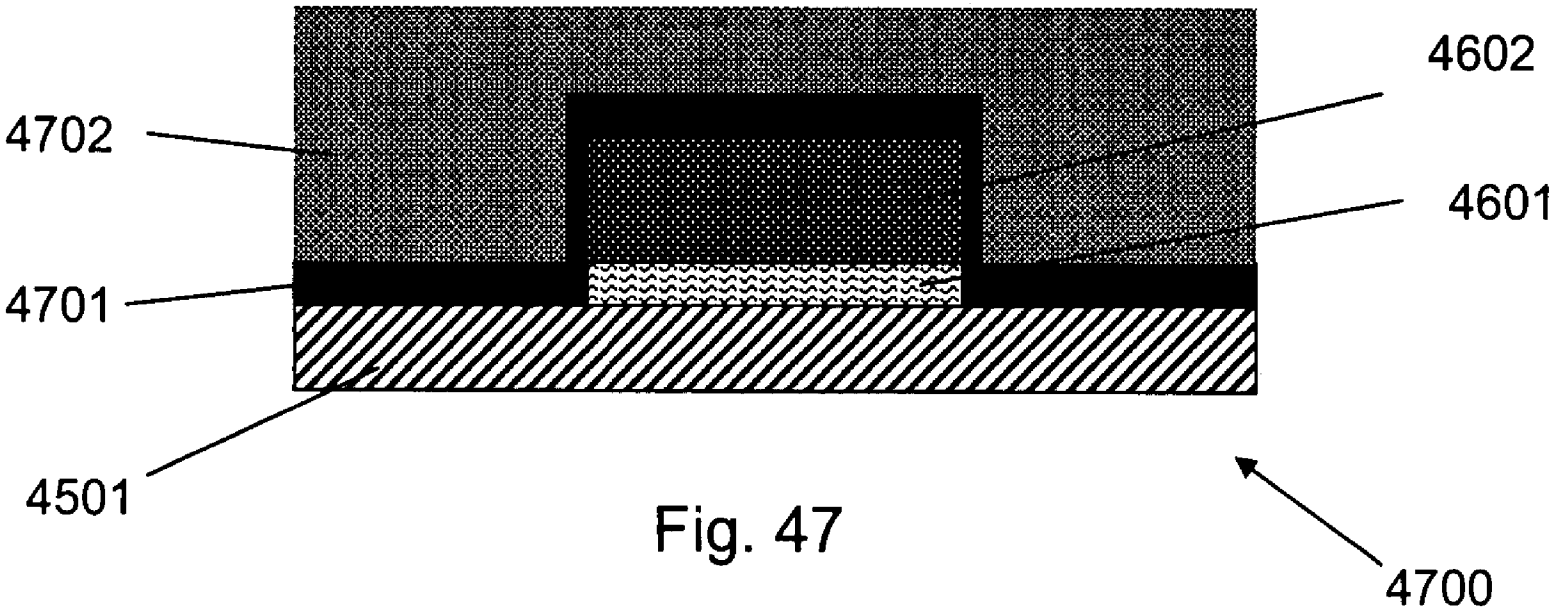
FIG. 47 illustrates the structure of FIG. 46, on which there has been deposited a thin conformal layer of dielectric (e.g., $SiO_2$) (4701) and a layer of patternable material (4702)
Figure 48:
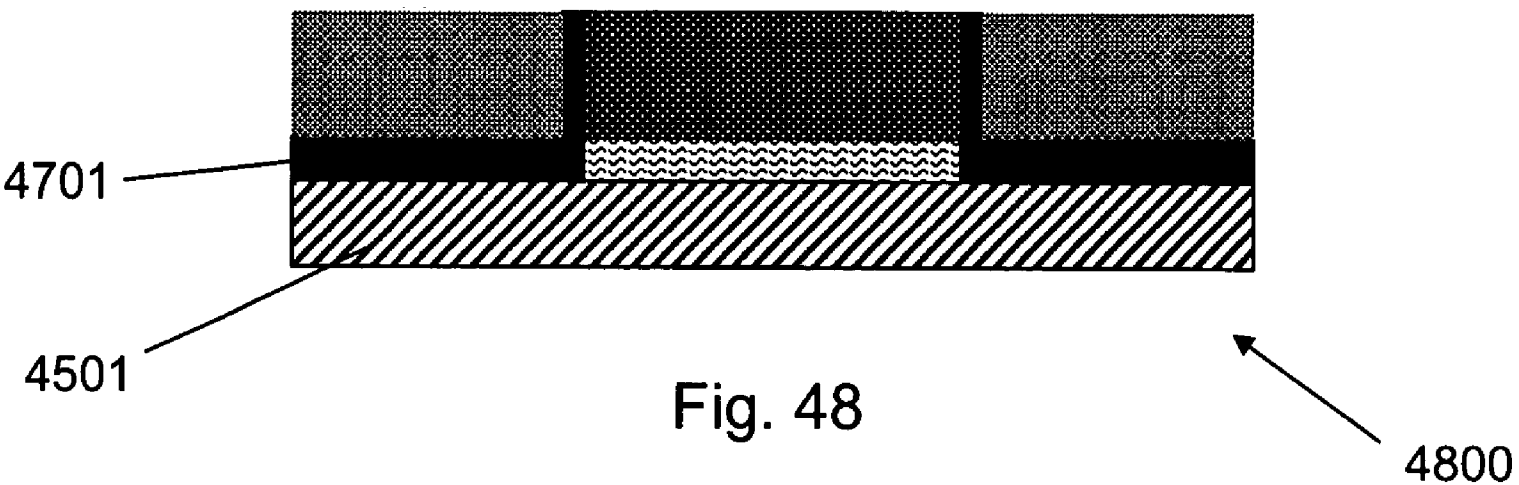
FIG. 48 illustrates the structure of FIG. 47, wherein the top portions of the dielectric and patternable layers have been removed to expose the Al post (4602)
Figure 49:
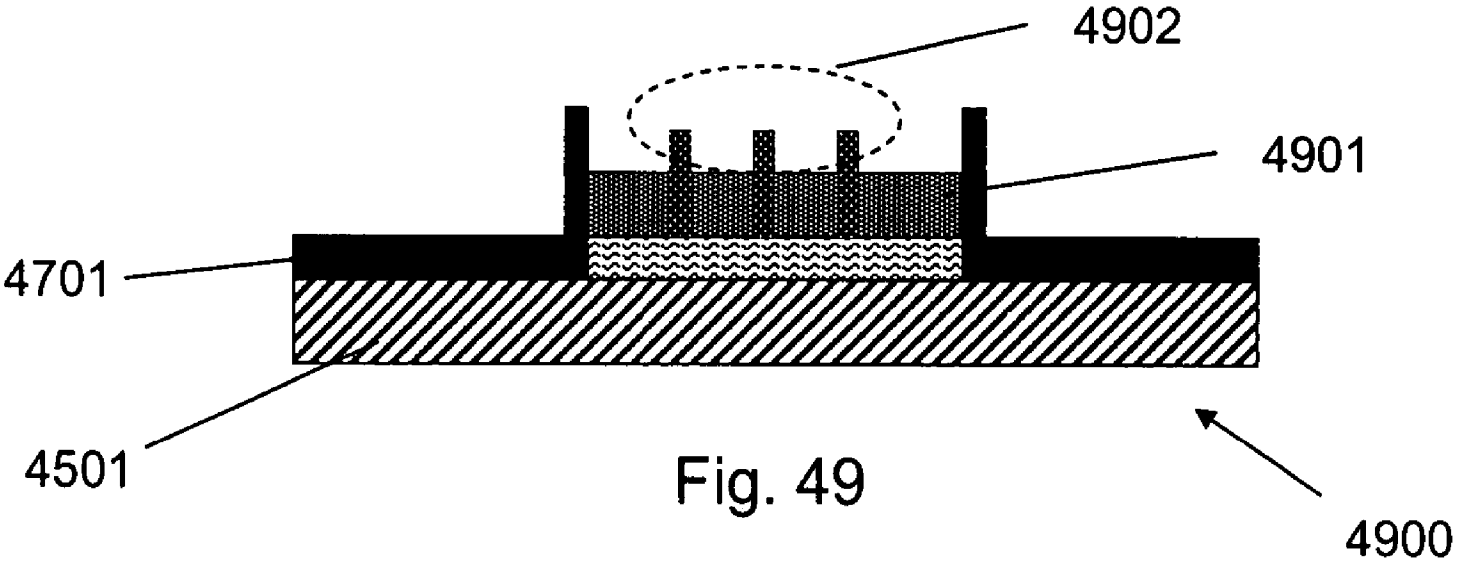
FIG. 49 illustrates the structure of FIG. 48, where the Al post has been anodized to a nanoporous AAO post (4901), where nanorods (4902) have been electrochemically deposited in the AAO post, where the AAO post has been etched back around the nanorods, and where the patternable material has been removed.
Figure 50:
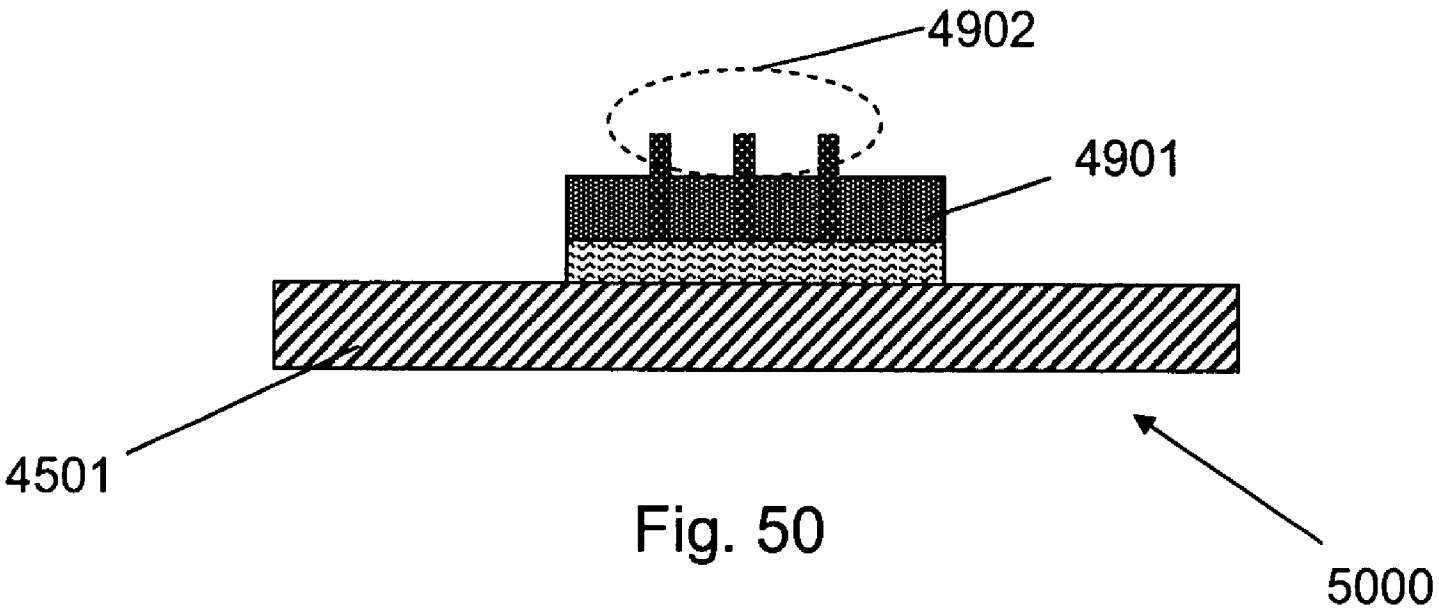
FIG. 50 illustrates the structure of FIG. 49, wherein the thin layer of dielectric has been removed.
Figure 51:
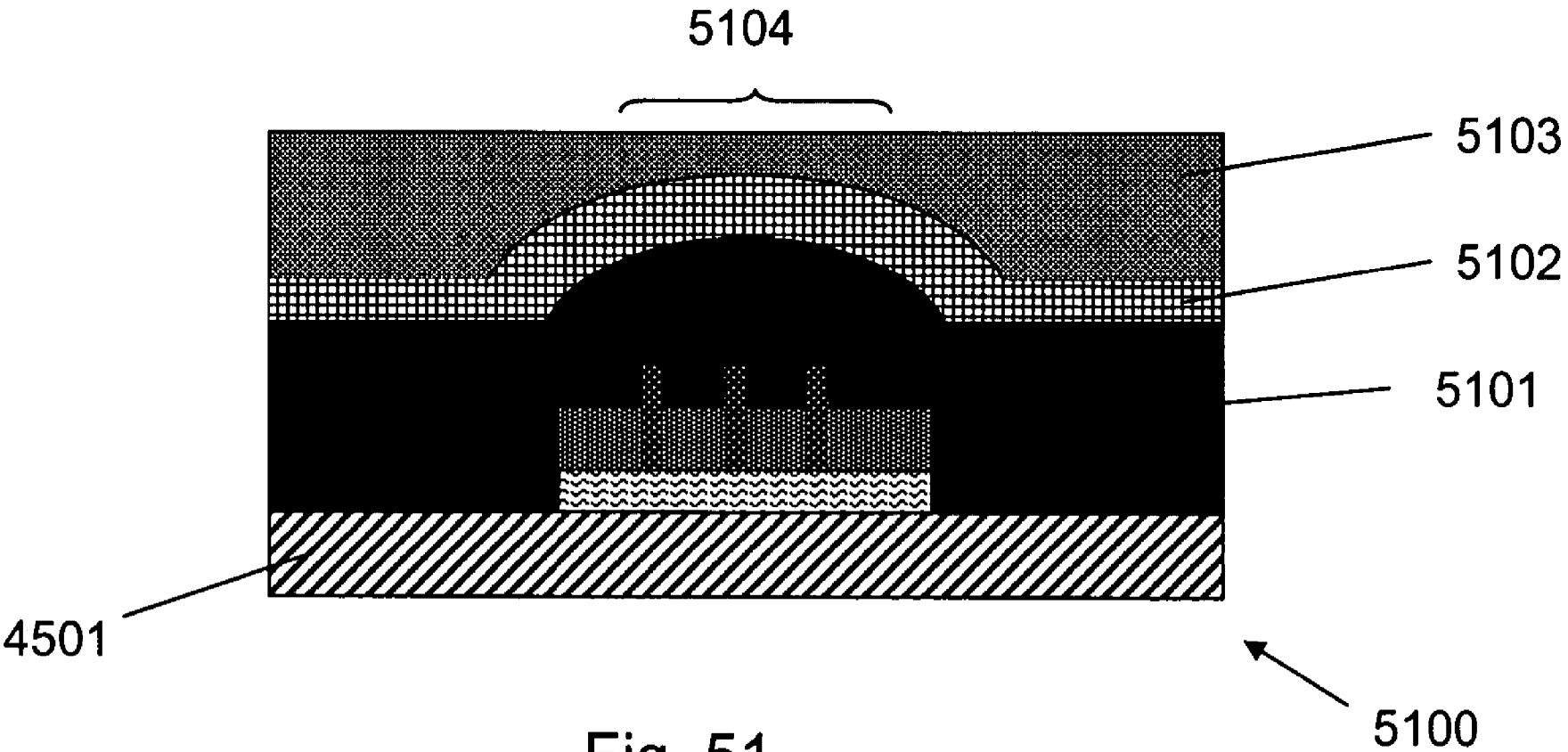
FIG. 51 illustrates the structure of FIG. 50, where layers of dielectric (5101), metal (5102), and planarizable material (5103) have been conformally deposited forming a bump in the region over the AAO posts comprising the nanorods.
Figure 52:
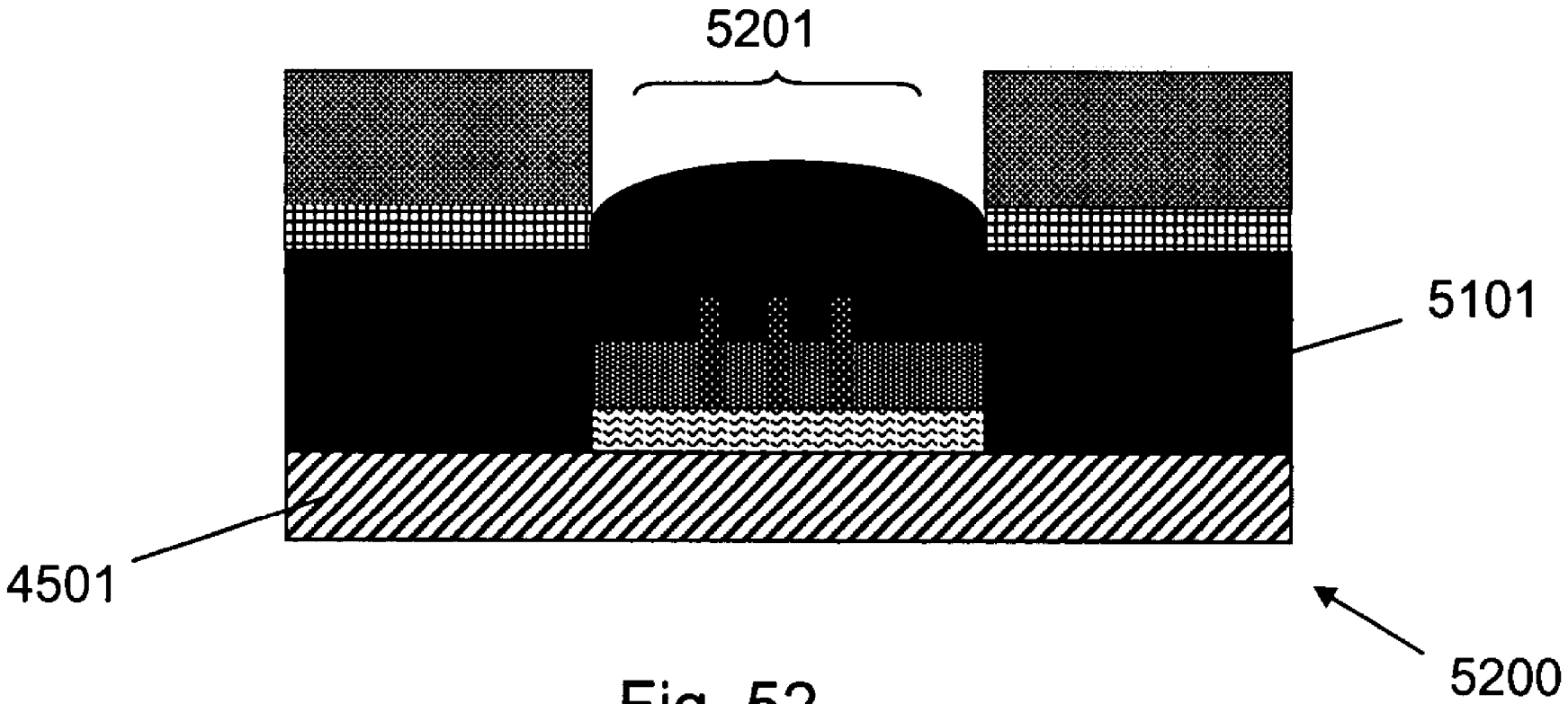
FIG. 52 illustrates the structure of FIG. 51, wherein the layers of planarizable material and metal have been etched such that they form a via (5201) in the region directly over the AAO posts comprising the nanorods.
Figure 53:
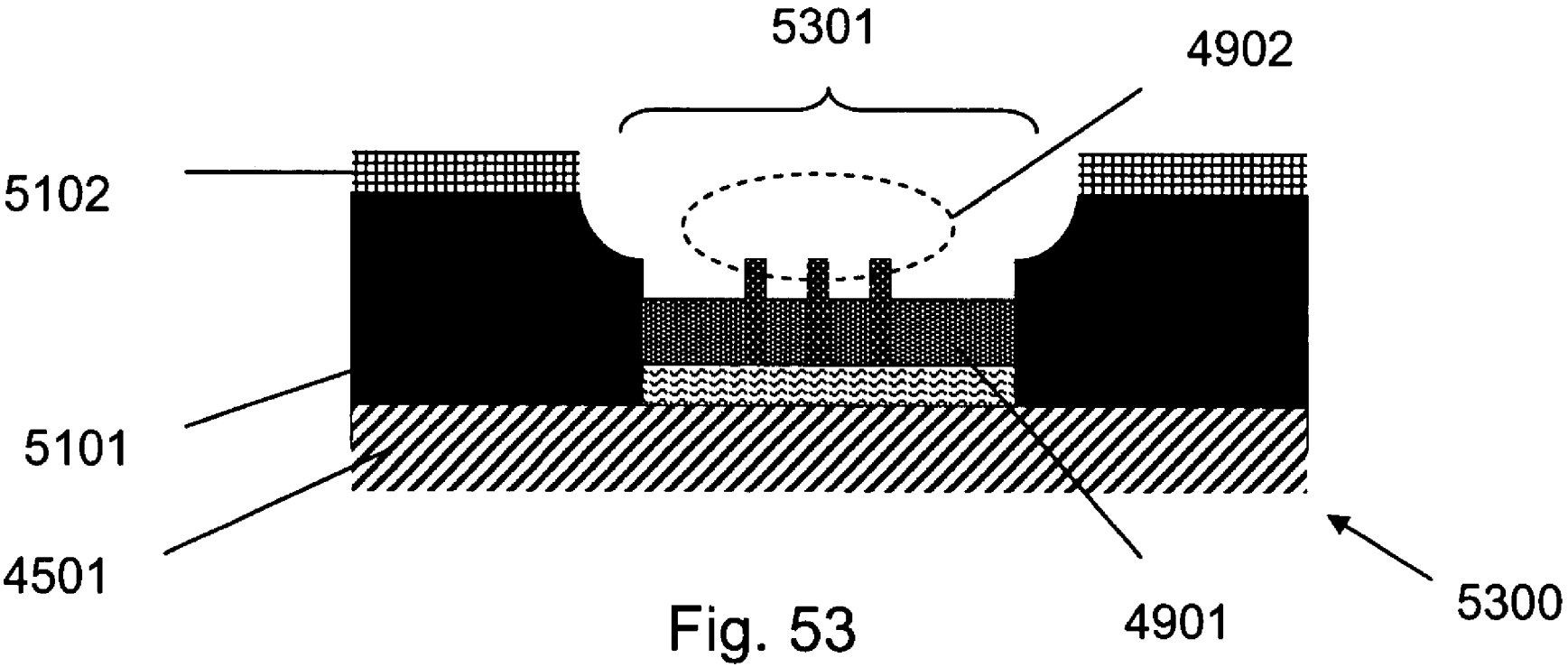
FIG. 53 illustrates the structure of FIG. 52, in which the planarizable material has been removed, and the dielectric layer etched to yield a gated field emitter structure (5300), in accordance with some embodiments of the present invention.
Figure 54:
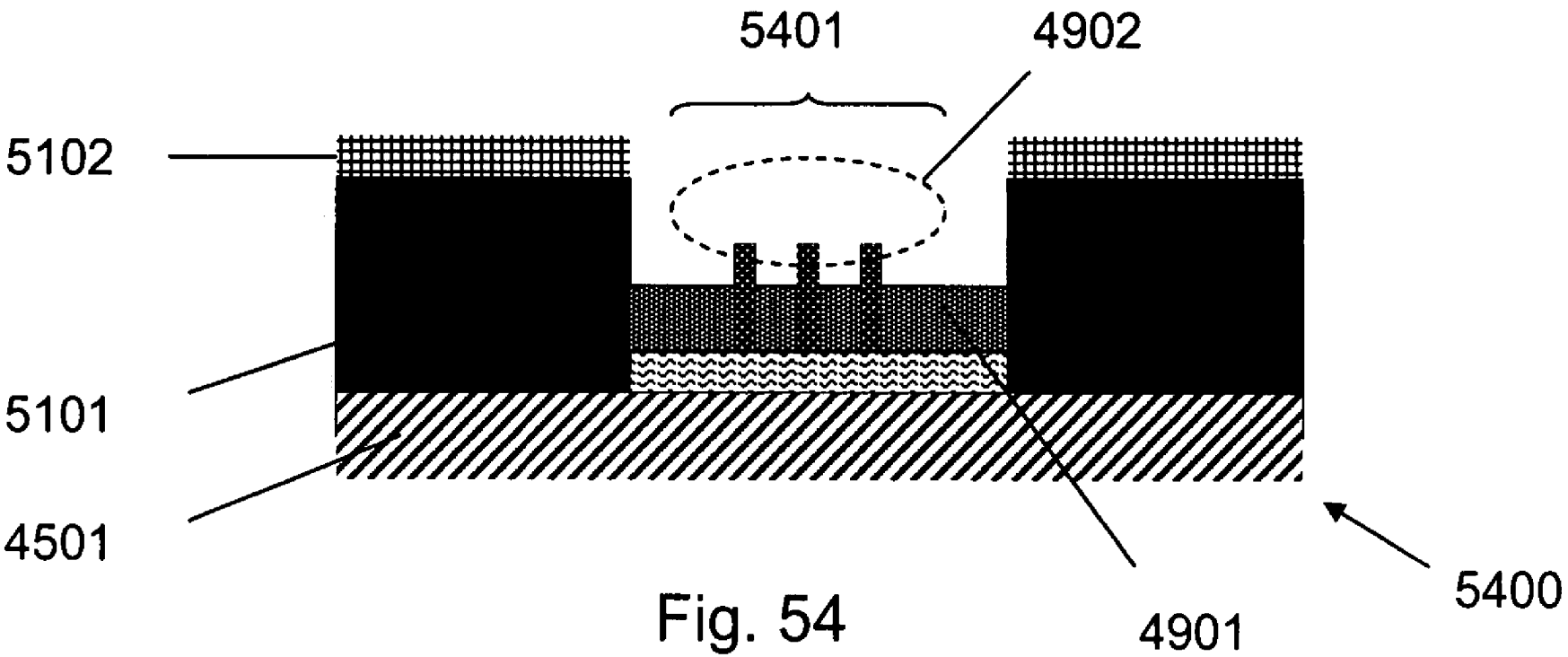
FIG. 54 illustrates the structure of FIG. 52, in which the planarizable material has been removed, and the dielectric layer etched to yield a gated field emitter structure (5400), in accordance with some embodiments of the present invention.

Referring to FIG. 45, a substrate 4501 is patterned using a dielectric material 4502 and a patternable material 4503. The patternable material 4503 is lithographically patterned and the dielectric material subsequently etched to yield patterned microcavity regions 4504 on the substrate 4501. Referring to FIG. 46, an Al stack 4603, comprising a conductive layer 4601 and an Al layer 4602, is deposited in the patterned regions of the substrate 4501. The dielectric and patternable layers are then removed to yield structure 4600 comprising Al stack 4603. Referring to FIG. 47, a thin layer of dielectric 4701 is then conformally deposited over the Al stack, followed by a reflowed layer of planarizable material 4702. The. dielectric 4701 and resist 4702 layers are then etched in such a way so as to expose the regions directly over the Al stack 4603, as depicted by structure 4800 shown in FIG. 48. Referring to FIG. 49, the remaining planarizable layer 4702 is then removed, the Al stack 4603 is anodized to form a AAO post 4901, nanorods 4902 are electrochemically deposited in the AAO post 4901, the AAO is etched back to expose the nanorods 4902, and the remaining dielectric layer 4701 is etched away to review structure 5000, as shown in FIG. 50. As shown in FIG. 51, to structure 5000, conformal layers of dielectric (5101), gate metal (5102), and reflowed resist material (5103) are deposited over the nanorod/AAO posts forming a bump region 5104 region. As shown in FIG. 52, the resist and gate metal layers in this bump region can be removed to form vias 5201, followed by etching of dielectric 5101 to yield either of devices 5300 or 5400, as depicted in FIGS. 53 and 54, respectively. Note that materials, depositional layer thicknesses, etching, electrochemical deposition, etc. can all be as generally described above, and that substrate posts, adhesion layers, sacrificial barrier layers, etc. can be incorporated into this method as well.

Advantages of the methods of the present invention over the prior art include a relatively simple fabrication process and flexibility in the tip-to-gate distance (i.e., the tip-to-gate distance is controlled by the thickness of the dielectric layer).

Turning now to the devices made by the above-described embodiments, devices such as 1300, 2300, 3500, 3900, 5300, and 5400 are novel cold cathode field emitter devices that comprise an array of emitter tips that have relatively small emitter tip-to-gate distances, thereby providing a relatively high emitter tip density and low turn on voltage. Such field emission devices are suitable for use in x-ray imaging applications, lighting applications, flat panel field emission display (FED) applications, etc.

Referring to FIG. 13, in some embodiments, devices of the present invention, such as device 1300, comprise a substrate 201, a conductive layer 202, a region of nanoporous AAO 302 comprising filled nanopores 601 and nanorod field emitters 1301, the latter of which are positioned within vias 1302, the vias 1302 being holes in the dielectric layer 801 and gate metal layer 802 that reside on top of the nanoporous AAO region, and wherein the nanorod field emitters extend down to the conductive layer.

In some of the above-described device embodiments, the substrate has a top surface that is substantially flat and comprises a material selected from the group consisting of semiconductors, glasses, molecular solids, metals, ceramics, polymers, and combinations thereof. Exemplary such materials include, but are not limited to Si, SiC, poly Si, amorphous Si, and combinations thereof. In some embodiments, the conductive layer comprises a material selected from the group consisting of Au, Cu, Pt, Ag, Pd, Rh, Ru, Os, and combinations thereof; and the conductive layer comprises a thickness of between about 10 nm and about 100 μm. In some embodiments, the region of nanoporous AAO comprises a thickness of between about 100 nm and about 5 μm. In some embodiments, the dielectric layer comprises a material selected from the group consisting of $SiO_2$, $SiN_x$ where $0.5 \leqq x \leqq 1.5$ (e.g., SiN and $Si_3N_4$), epi-i-SiC, $Al_2O_3$, undoped wide bandgap semiconductors (e.g., SiC, Ga, spin-on-glass), and combinations thereof and combinations thereof; and the dielectric layer comprises a thickness of between about 100 nm and about 5 μm. In some embodiments, the gate metal layer comprises a material selected from the group consisting of a metal, such as Nb, Pt, Al, W, Mo, Ti, Ni, Cr, TiW, and the like; a semiconductor, such as highly-doped Si, GaN, GaAs, SiC, doped poly Si, doped amorphous Si, and the like; and combinations thereof; and the gate metal layer comprises a thickness of between about 10 nm and about 100 μm.

In some of the above-described device embodiments, the vias are approximately circular in shape and comprise a diameter between about 100 nm and about 5 μm. Other shapes, or a plurality of shapes, are possible—depending upon the pattern of the mask or master used to make the device.

In some embodiments, the nanorod field emitters comprise any material that can be electrodeposited, i.e., metals; metal borides, carbides, nitrides, and oxides; etc., subject only to the availability of a suitable electrolyte from which these materials may be electrodeposited, such materials including, but not limited to, Pt, Pd, Ni, Au, Ag, Cu, Zn, ZnO, $MoO_3/Mo_2O_3$, and combinations thereof. In some or other embodiments, the nanorod field emitters are aligned substantially perpendicular to the substrate. In some or other embodiments, the nanorod field emitters comprise a diameter between about 10 nm and about 500 nm, and a length between about 100 nm and about 5 μm.

Referring to FIG. 23, in some or other embodiments alternative devices of the present invention, such as device 2300, comprise a substrate 1701, a dielectric layer 1702, a gate metal layer 1703, microcavities 2302 in the dielectric and gate metal layers, nanoporous AAO posts (mesas) 2104 in the microcavities 2302, and nanorod field emitters 2301 in the nanoporous AAO posts 2104. Generally, the substrate 1701 comprises at least a top portion that is conductive. The various materials and other dimensional attributes of such devices are described above in the discussions of such device fabrication.

Referring to FIG. 35, it can be seen that device 3500 is a variant of device 2300. Like device 2300, device 3500 comprises a substrate (2801), an AAO post 3101 comprising nanorods 3401 exposed by via 3301, surrounded by dielectric 3201 and gated by a gate metal layer 3202. The primary difference between device 2300 and device 3500 is the conductive layer 2802 of device 3500. Subtle structural differences (e.g., the mesa-like posts of device 2300) are also apparent. Device 3900 is essentially identical to device 3500, but further comprises a substrate post 3801 on which the nanorod/AAO post resides. Materials and dimensional attributes are generally as described above for the other device embodiments.

Referring to FIG. 53, device 5300 is generally the same as device 3500 shown in FIG. 35, but it can be seen from FIG. 53, that the conductive layer on which the AAO post 4901 resides does not extend over the entire substrate region as it does for device 3500 shown in FIG. 35. Variation between device 5300 and device 5400 of FIG. 54 is primarily of a dimensional nature with regard to the via. Again, materials and dimensional attributes are generally as described above for the other device embodiments.

In some of the above-described alternative device embodiments, the substrate comprises a material selected from the group consisting of semiconductors, glasses, molecular solids, metals, ceramics, polymers, and combinations thereof. Exemplary such materials include, but are not limited to, Si, SiC, poly Si, amorphous Si, and combinations thereof. Typically, the dielectric layer comprises a material selected from the group consisting of $SiO_2$, $SiN_x$ where $0.5 \leqq x \leqq 1.5$ (e.g., SiN and $Si_3N_4$), epi-i-SiC, $Al_2O_3$, undoped wide bandgap semiconductors (e.g., SiC, Ga, spin-on-glass), and combinations thereof; and possesses a thickness of between about 100 nm and about 5 μm. The gate metal layer typically comprises a material selected from the group consisting of metal, such as Nb, Pt, Al, W, Mo, Ti, Ni, Cr, TiW, and the like; a semiconductor material, such as highly-doped Si, GaN, GaAs, SiC, doped poly Si, doped amorphous Si, and the like; and combinations thereof, and comprises a thickness of between about 10 nm and about 100 μm.

In some of the above-described alternative device embodiments, the microcavities comprise a diameter between about 100 nm and about 5 μm. The nanorod field emitters typically comprise any material that can be electrodeposited, i.e., metals; metal borides, carbides, nitrides, and oxides; etc., subject only to the availability of a suitable electrolyte from which these materials may be electrodeposited, including, but not limited to, Pt, Pd, Ni, Au, Ag, Cu, Zn, ZnO, $MoO_3/Mo_2O_3$, and combinations thereof; wherein such emitters are typically aligned substantially perpendicular to the substrate. Typically, the nanorod field emitters comprise a diameter between about 10 nm and about 500 nm, and a length between about 100 nm and about 5 μm.

Advantages of the devices of the present invention over those of the prior art include a high emitter tip density and continuously sharp field emitter tips. It will be apparent to those of skill in the art that numerous variations exist with regard to the above-described devices and methods of making same, and that such variations fall within the scope of the claimed invention.

The following examples are included to demonstrate particular embodiments of the present invention. It should be appreciated by those of skill in the art that the methods disclosed in the examples that follows merely represent exemplary embodiments of the present invention. However, those of skill in the art should, in light of the present disclosure, appreciate that many changes can be made in the specific embodiments described and still obtain a like or similar result without departing from the spirit and scope of the present invention.

EXAMPLE 1

This Example serves to illustrate fabrication of a gated field emitter device (e.g., device 133, shown in FIG. 13), in accordance with some embodiments of the present invention.

A Si wafer was cleaned using a KEROS (peroxide and sulfuric acid clean also known as a piranha etch) and HF dip. On the cleaned wafer various layers were deposited in the following order and with the following thicknesses: 200 Å TiW/500 Å Au/60 Å Ti/1 μm Al. The TiW was used as an adhesion layer, Au as the conductive layer, and Ti as the sacrificial barrier layer. The Al in this layered stack was then anodized to create nanoporous AAO. During this process, the top Ti layer oxidized to form insulating $TiO_x$ (sacrificial barrier layer). The $TiO_x$ sacrificial barrier layer was etched using a wet etching solution (80 parts $H_2O$: 1 part HF: 1 part $H_2O_2$) for 30 seconds. Upon removal of the $TiO_x$, the nanopores in the nanoporous AAO extend down to the conductive Au layer and form a template in which nanorods can be electrochemically-deposited.

To form nanorods, Pt was then electrochemically-deposited in the nanopores of the nanoporous AAO template to form nanorods. FIG. 24 is an FE-SEM image depicting an AAO template with electrochemically-deposited nanorods, in accordance with some embodiments of the present invention. AAO around the nanorods was then etched back with an inductively-coupled plasma (ICP) of $BCl_3/Cl_2$ chemistry for 6.5 minutes. The resulting structure was then heat treated (i.e., annealed) at 500° C. for 2 hours. This latter step was done to promote adhesion. This latter step, however, can be done at any time after electrodeposition. The temperature and time of this heat treatment can be varied.

To this heat-treated structure was applied spin-on-glass (SOG). Spin-on-glass was applied to fill the pores of the AAO that were not filled with nanorods (i.e., fill factor was not 100%). The SOG was then annealed (425° C. for 30 minutes with a 2 hour cool) and etched from the surface using ICP for 5.5 minutes. Naturally, etch time is dependent on SOG thickness. The surface was then prepped for deposition by cleaning with PRS1000 for 5 minutes.

$SiO_2$ was deposited on the prepped surface to from a dielectric layer of thickness around 5000 Å (500 nm). Deposition of $SiO_2$ was then followed by cleaning with PRS1000 for 5 minutes, deposition of an ~1000 Å thick layer of gate metal (Cr), then another cleaning with PRS1000 for 5 minutes. Photoresist was then applied to the cleaned gate metal layer and photolithographically patterned using a photomask and a UV lamp. The photoexposed regions were then removed with developer.

For the regions that were exposed due to the above-described photolithography, the Cr gate metal layer was wet etched and the $SiO_2$ dielectric layer was dry etched using reactive ion etching (RIE). The resist was then striped using PRS1000, and AAO was etched back using an etching solution (1 $H_2O$: 1 $H_3PO_4$) for 5 minutes to expose the Pt nanorod emitter tips. This last step, however, may not be necessary.

Figure 25:
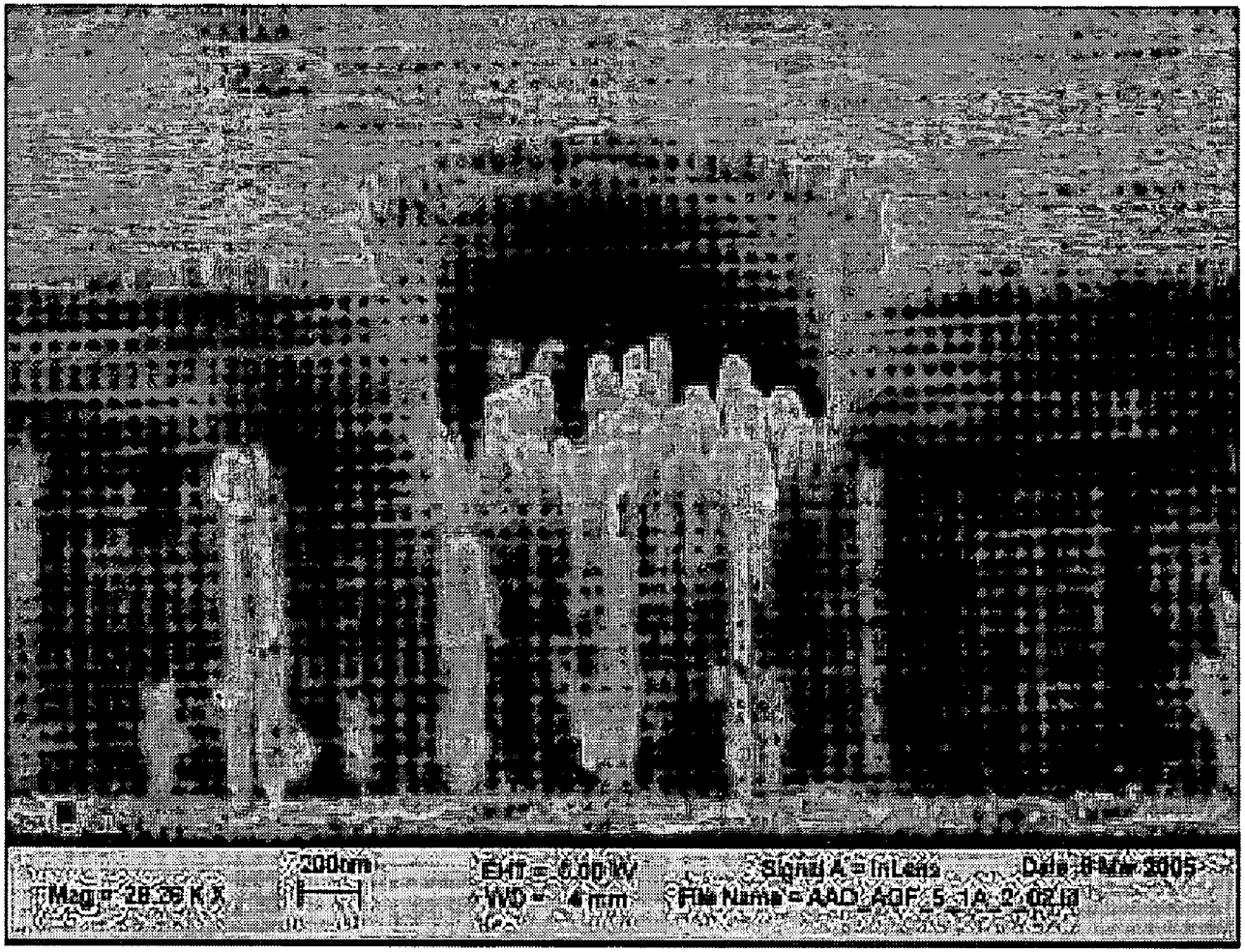
FIG. 25 is an FE-SEM image depicting a gated Pt-nanorod field emission array, wherein the tops of the Pt-nanorods are observed protruding above the plane of the AAO template.
Figure 26A:
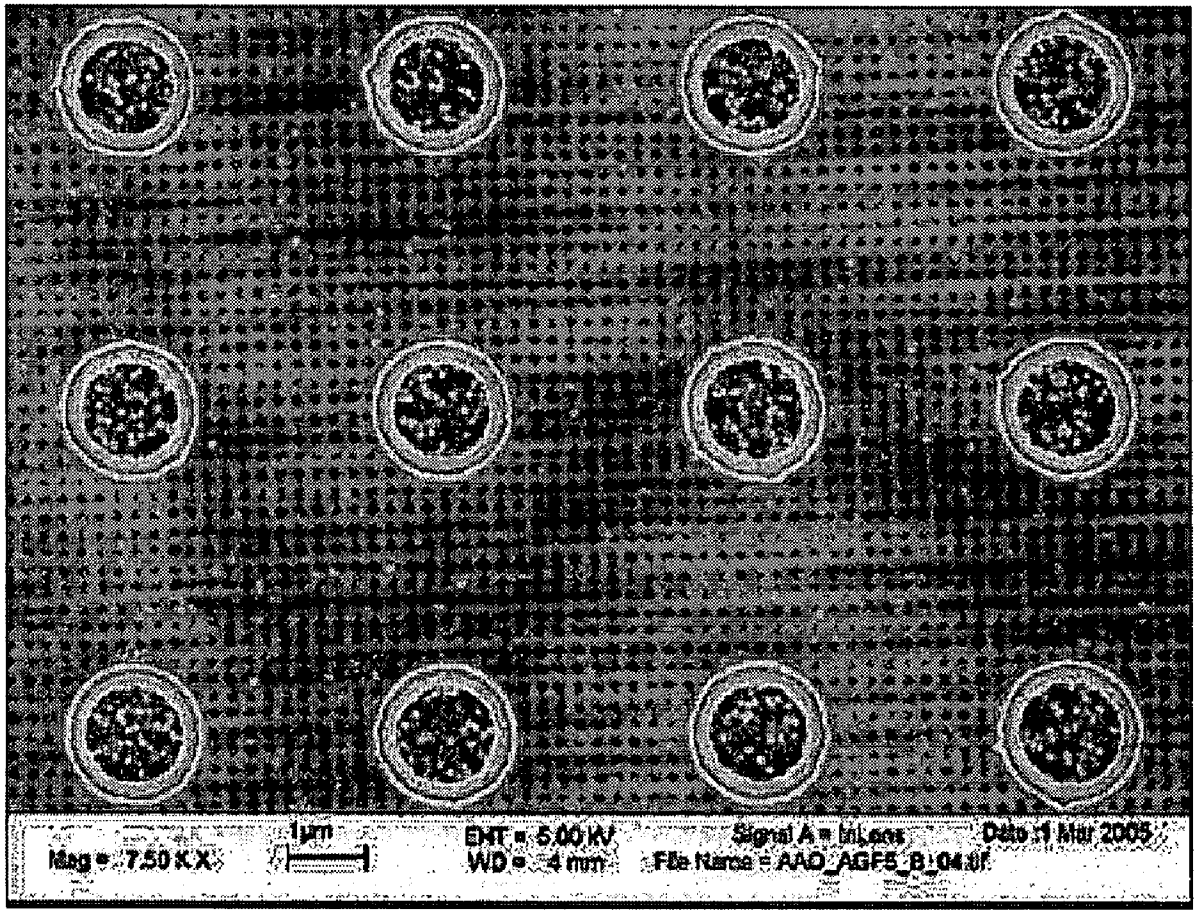
FIGS. 26A and 26B are top view FE-SEM images of a gated Pt-nanorod field emission array, where the tops of the Pt-nanorods are observed as white circular objects in the AAO template; and where (A) depicts 12 of 62,500 vias in a 1 $mm^2$ area, and (B) depicts an individual via showing Pt-nanorod emitters, $SiO_2$ dielectric, and a Cr gate, in accordance with some embodiments of the present invention.
Figure 26B:
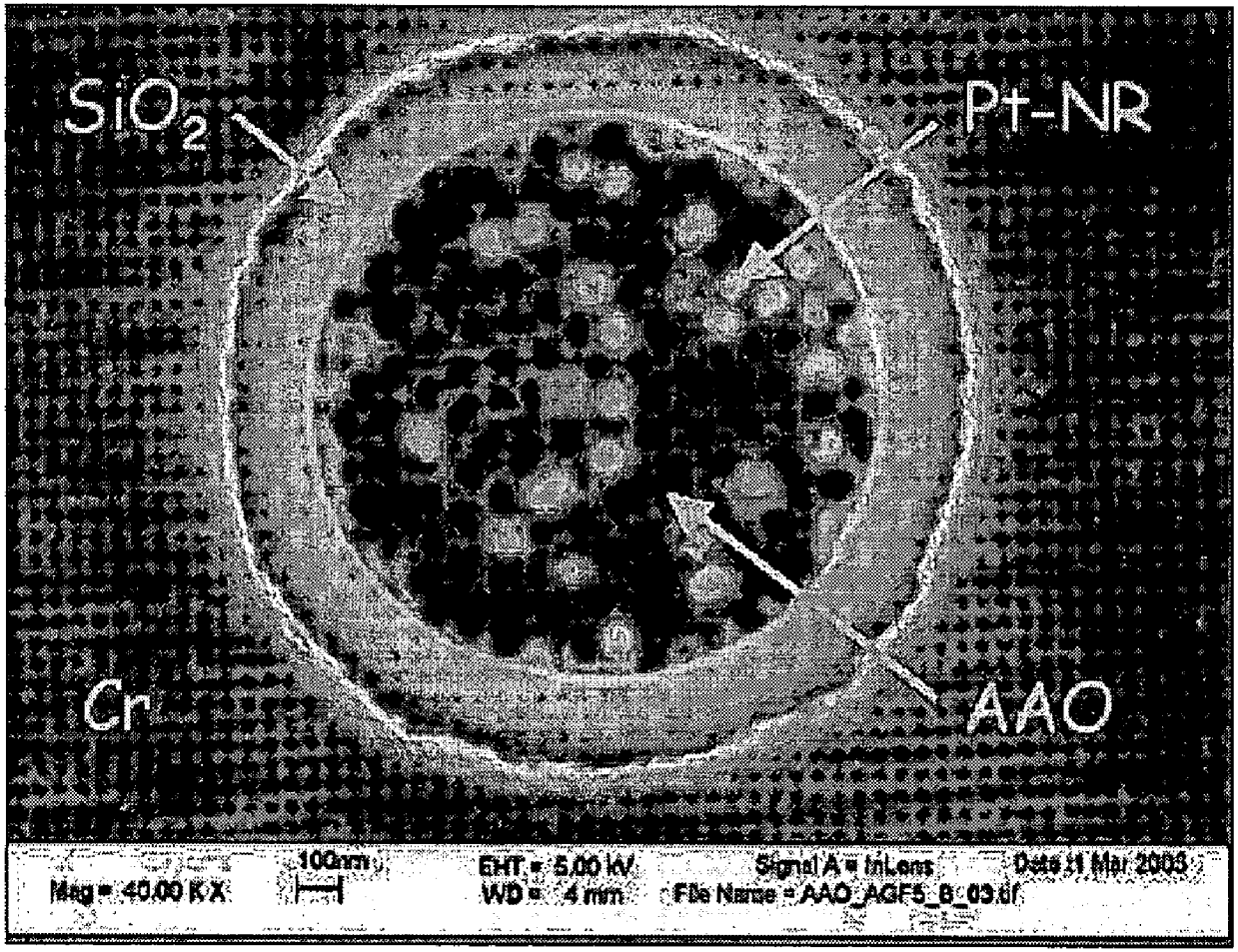

FIG. 25 is an FE-SEM image depicting a gated Pt-nanorod field emission array, wherein the tops of the Pt-nanorods are observed protruding above the plane of the AAO template. FIGS. 26A and 26B are top view FE-SEM images of a gated Pt-nanorod field emission array, where the tops of the Pt-nanorods are observed as white circular objects in the AAO template; and where (A) depicts 12 of 62,500 vias, and (B) depicts an individual via showing Pt-nanorod emitters, $SiO_2$ dielectric, and a Cr gate.

EXAMPLE 2

This Example serves to illustrate fabrication of a gated field emitter device (e.g., devices 3500 and 3900, shown in FIGS. 35 and 39, respectively), in accordance with some embodiments of the present invention.

A Si wafer was cleaned using a KEROS and HF Dip. On the cleaned wafer various layers were deposited in the following order and with the following thicknesses: 200 Å TiW/500 Å Cu/150 Å Ti/1 μm Al. The TiW was used as an adhesion layer, Au as the conductive layer, and Ti as the sacrificial barrier layer. The Al in this layered stack was then anodized to create a substrate supported nanoporous AAO template. During this process, the top Ti layer of the stack is oxidized to form insulating $TiO_x$ (sacrificial barrier layer).

Spin-on-glass (SOG) was applied to the top of the nanoporous AAO template and then annealed at 425° C. for 30 minutes with a 2 hour cool. The SOG was then etched from the surface using ICP for 5.5 minutes (time is dependent on SOG thickness). A photoresist was then applied and patterned. To the patterned nanoporous template was deposited a masking (metal) layer, after which the resist was removed and the unmasked AAO was etched to yield AAO posts. Note that the Ti/Cu/Ti conductive layer can be optionally removed and the Si substrate etched to form Si pillars. The masking metal was then stripped and $SiO_2$, gate metal (Cr, 1 k Å thick), and resist layers were deposited conformally over the AAO posts, such that the resist layer was reflowed to make it level. This region of layers over the AAO post is the bump region. The resist layer of the bump region was then (dry) etched, the gate (Cr) layer was wet etched, and the $SiO_2$ layer was either dry (RIE) or wet etched to open area above AAO posts (i.e., vias). To the exposed AAO posts, SOG was cleared from the pores and nanorods were electrochemically deposited in the AAO posts. The AAO in the posts was then etched back to more fully expose the nanorods. Finally, the resist was stripped with either PRS1000 or acetone to yield a gated field emitter structure, in accordance with an embodiment of the present invention.

EXAMPLE 3

This Example serves to illustrate fabrication of a gated field emitter device (e.g., devices 3500 and 3900, shown in FIGS. 35 and 39, respectively), in accordance with some embodiments of the present invention.

A Si wafer was cleaned using a KEROS and HF Dip. On the cleaned wafer various layers were deposited in the following order and with the following thicknesses: 200 Å TiW/500 Å Cu/150 Å Ti/1 μm Al. The TiW was used as an adhesion layer, Cu as the conductive layer, and Ti as the sacrificial barrier layer. The Al in this layered stack was then anodized to create a substrate supported nanoporous AAO template. During this process, the top Ti layer of the stack is oxidized to form insulating $TiO_x$ (sacrificial barrier layer). Note that this sacrificial barrier layer is formed in all of the Examples presented herein.

Spin-on-glass (SOG) was applied to the top of the nanoporous AAO template and then annealed at 425° C. for 30 minutes with a 2 hour cool. The SOG was then etched from the surface using ICP for 5.5 minutes (time is dependent on SOG thickness). A photoresist was then applied and patterned. To the patterned nanoporous template was deposited a masking (metal) layer, after which the resist was removed and the unmasked AAO was etched to yield AAO posts. A thin layer of SiO2 was deposited, the metal masking layer stripped, and nanorods were electrochemically deposited in the AAO posts. The AAO was then etched to more fully expose the nanorods. A thick layer of $SiO_2$ was deposited conformally over the AAO posts comprising the nanorods. This was followed by the deposition of a gate metal layer (Cr, 1 k Å thick) and a layer of resist, the latter of which was allowed to reflow to make it level. The resist layer of the bump region was then (dry) etched, the gate (Cr) layer was wet etched, and the $SiO_2$ layer was either dry (RIE) or wet etched to open area above AAO posts (i.e., vias). To the exposed AAO posts, SOG was cleared from the pores and nanorods were electrochemically deposited in the AAO posts. The AAO in the posts was then etched back to more fully expose the nanorods. Finally, the resist was stripped with either PRS1000 or acetone to yield a gated field emitter structure, in accordance with an embodiment of the present invention.

EXAMPLE 4

This Example serves to illustrate fabrication of a gated field emitter device (e.g., devices 5300 and 5400, shown in FIGS. 53 and 54, respectively), in accordance with some embodiments of the present invention.

A Si wafer was cleaned using a KEROS and HF dip. On the cleaned wafer $SiO_2$ was deposited and a photoresist was applied and patterned. Next, various layers were deposited in the following order and with the following thicknesses: 200 Å TiW/500 Å Cu/150 Å Ti/0.5 μm Al. The resist and dielectric layers were then stripped to yield Al posts (it is at this point that the Si wafer around the Al posts can be optionally etched to "elevate" the Al posts). A thin layer of $SiO_2$ was then deposited conformally over the Al posts followed by a layer of resist, the latter of which was allowed to reflow. Next, the resist and $SiO_2$ layers were dry etched to expose the top of the Al posts, and the resist was subsequently removed. Next, the Al posts were anodized to form AAO posts, wherein the topmost Ti underlayer oxidizes to $TiO_x$ and is subsequently etched. Nanorods were electrochemically deposited in the AAO posts and the AAO was etched back to more fully expose the nanorods (note that this etching is optional). Next, the remaining dielectric ($SiO_2$) was optionally removed and a fresh layer of dielectric conformally deposited over the AAO posts. This dielectric deposition was followed by deposition of a gate metal (Cr) layer and a resist layer, the latter of which was allowed to reflow. These layers formed bump regions over the AAO posts. The resist was then dry etched to open area above posts. The gate metal was then wet etched, followed by a dry etch (RIE) of the $SiO_2$. This series of etching opened up a via with which the nanorods are exposed. Lastly, the remaining resist was stripped to yield a gated field emitter structure in accordance with some embodiments of the present invention.

EXAMPLE 5

This Example serves to illustrate fabrication of a gated field emitter device (e.g., devices 5300 and 5400, shown in FIGS. 53 and 54, respectively), in accordance with some embodiments of the present invention.

A Si wafer was cleaned using a KEROS and HF Dip. On the cleaned wafer $SiO_2$ was deposited and a photoresist was applied and patterned. Next, various layers were deposited in the following order and with the following thicknesses: 200 Å TiW/500 Å Cu/150 Å Ti/0.5 μm Al. The resist and dielectric layers were then stripped to yield Al posts (it is at this point that the Si wafer around the Al posts can be optionally etched to "elevate" the Al posts). A thin layer of $SiO_2$ was then deposited conformally over the Al posts followed by a layer of resist, the latter of which was allowed to reflow. Next, the resist and $SiO_2$ layers were dry etched to expose the top of the Al posts, and the resist was subsequently removed. Next, the Al posts were anodized to form AAO posts, wherein the topmost Ti underlayer oxidizes to $TiO_x$ and is subsequently etched. Next, the remaining dielectric ($SiO_2$) was optionally removed and a fresh layer of dielectric conformally deposited over the AAO posts. This dielectric deposition was followed by deposition of a gate metal (Cr) layer and a resist layer, the latter of which was allowed to reflow. These layers formed bump regions over the AAO posts. The resist was then dry etched to open area above posts. The gate metal was then wet etched, followed by a dry etch (RIE) of the $SiO_2$. This series of etching opened up a via in which the AAO posts are exposed. Nanorods were electrochemically deposited in the AAO posts and the AAO was etched back to more fully expose the nanorods. Lastly, the remaining resist was stripped to yield a gated field emitter structure in accordance with some embodiments of the present invention.

In summary, the present invention relates to self-aligned gated nanorod field emission devices, wherein such devices have relatively small emitter tip-to-gate distances, and providing a relatively high emitter tip density. Such methods employ a combination of traditional device process techniques (lithography, etching, metallization, etc.) with electrochemical template anodization and electrochemical deposition of nanorods. These methods are relatively simple, cost-effective, and efficient; and they provide field emission devices that are suitable for use in x-ray imaging applications, lighting applications, flat panel field emission display (FED) applications, etc.

It will be understood that certain of the above-described structures, functions, and operations of the above-described embodiments are not necessary to practice the present invention and are included in the description simply for completeness of an exemplary embodiment or embodiments. In addition, it will be understood that specific structures, functions, and operations set forth in the above-described referenced patents and publications can be practiced in conjunction with the present invention, but they are not essential to its practice. It is therefore to be understood that the invention may be practiced otherwise than as specifically described without actually departing from the spirit and scope of the present invention as defined by the appended claims.

What is claimed is:

1. A method comprising the steps of:

a) providing a thin film material comprising:
   i) a substrate;
   ii) a dielectric layer on the substrate; and
   iii) a conductive film on the dielectric layer;

b) lithographically-patterning a patternable material deposited onto the conductive film so as to selectively remove portions of this material;

c) selectively etching the conductive film and dielectric layer in regions where the patternable material has been removed so as to form microcavities;

d) depositing Al inside the microcavities to form Al mesas;

e) anodizing the Al mesas to form localized nanoporous AAO templates; and f) electrochemically-depositing nanorods in the nanopores of the AAO templates to yield at least one gated nanorod field emission device.

2. The method of claim 1, further comprising a step of etching back the AAO to more fully expose the nanorod field emitters.

3. The method of claim 1, wherein the substrate comprises a material selected from the group consisting of semiconductors, glasses, molecular solids, metals, ceramics, polymers, and combinations thereof.

4. The method of claim 1, wherein the conductive film comprises a material selected from the group consisting of (a) metal selected from the group consisting of Nb, Pt, Al, W, Mo, Ti, Ni, Cr, TiW, and combinations thereof; (b) a semiconductor material selected from the group consisting of highly-doped Si, GaN, GaAs, SiC, doped poly Si, doped amorphous Si, and combinations thereof; and (c) combinations thereof.

5. The method of claim 1, wherein the dielectric layer comprises a material selected from the group consisting of $SiO_2$, $SiN_X$, epi-i-SiC, $Al_2O_3$, undoped wide bandgap material, and combinations thereof.

6. The method of claim 1, where the step of depositing Al involves the use of a metal evaporation technique.

7. The method of claim 1, wherein the step of electrochemically-depositing involves the deposition of a material selected from the group consisting of Pt, Pd, Ni, Au, Ag, Cu, Zn, ZnO, $MoO_3/Mo_2O_3$, and combinations thereof.

8. A method comprising the steps of:

a) providing a nanoporous AAO template comprising nanopores that extend down to a substrate-supported conductive layer on which the nanoporous AAO template resides;

b) filling the nanopores with nanopore filler comprising a first dielectric material to form a filled nanoporous AAO template;

c) patterning and etching the AAO template to form AAO posts;

d) conformally depositing: (i) a dielectric layer comprising a second dielectric material, (ii) a gate metal layer, such that the dielectric and gate metal layers form a bump in the regions over the AAO posts, and (iii) a planarizable layer over the bumps that is subsequently planarized via reflow;

e) etching the dielectric, gate metal, and planarizable layers over the bump to form vias, such vias providing depositional access to the AAO posts;

f) electrochemically-depositing nanorods in the AAO posts and etching back the AAO to more fully expose the nanorods; and g) removing the resist to form gated emitter structures.

9. The method of claim 8, wherein the step of patterning and etching the AAO template involves a lithographic patterning technique and an etching technique selected from the group consisting of dry etching, wet etching, and combinations thereof.

10. The method of claim 8, wherein the step of conformally depositing comprises deposition of a dielectric layer selected from the group consisting of $SiO_2$, $SiN_X$, epi-i-SiC, $Al_2O_3$, undoped wide bandgap material, and combinations thereof; a gate metal layer selected from the group consisting of Nb, Pt, Al, W, Mo, Ti, Ni, Cr, TiW, and combinations thereof; and a patternable layer selected from the group consisting of photoresist, UV resist, e-beam resist, and combinations thereof.

11. The method of claim 8, wherein the step of etching the dielectric, gate metal, and resist layers over the bump comprises a combination of wet and dry etching techniques.

12. The method of claim 8, wherein the step of electrochemically-depositing nanorods involves the deposition of a material selected from the group consisting of Pt, Pd, Ni, Au, Ag, Cu, Zn, ZnO, $MoO_3/Mo_2O_3$, and combinations thereof.

13. The method of claim 8, further comprising a step of substrate etching so as to provide for substrate posts on which the AAO posts reside.

14. A method comprising the steps of:

a) providing a nanoporous AAO template comprising nanopores that extend down to a substrate-supported conductive layer on which the nanoporous AAO template resides;

b) filling the nanopores with nanopore filler comprising a first dielectric material to form a filled nanoporous AAO template;

c) patterning and etching the AAO template to form AAO posts capped with a metal masking layer;

d) depositing a thin conformal layer of a second dielectric material over the capped AAO posts, removing residual masking layer to expose the AAO posts, electrochemically depositing nanorods in the AAO posts to form nanorod/AAO posts, and etching back the AAO to more fully expose the nanorods in the nanorod/AAO posts;

e) conformally depositing: (i) a dielectric layer comprising a second dielectric material, (ii) a gate metal layer, such that the dielectric and gate metal layers form a bump in the regions over the nanorod/AAO posts, and (iii) a planarizable layer over the bumps that is subsequently planarized via reflow;

f) etching the dielectric, gate metal, and planarizable layers over the bump to form vias, such vias providing access to the nanorod/AAO posts; and g) removing the planarizing layer to form gated emitter structures.

15. The method of claim 14, wherein the step of patterning and etching the AAO template involves a lithographic patterning technique and an etching technique selected from the group consisting of dry etching, wet etching, and combinations thereof; and wherein the metal masking layer comprises a material selected from the group consisting of Ni, Cr, Al, and combinations thereof.

16. The method of claim 14, wherein the step of electrochemically-depositing nanorods involves the deposition of a material selected from the group consisting of Pt, Pd, Ni, Au, Ag, Cu, Zn, ZnO, $MoO_3/Mo_2O_3$, and combinations thereof.

17. The method of claim 14, wherein the step of conformally depositing comprises deposition of a dielectric layer selected from the group consisting of $SiO_2$, $SiN_X$, epi-i-SiC, $Al_2O_3$, undoped wide bandgap material, and combinations thereof; a gate metal layer selected from the group consisting of Nb, Pt, Al, W, Mo, Ti, Ni, Cr, TiW, and combinations thereof; and a patternable layer selected from the group consisting of photoresist, UV resist, e-beam resist, and combinations thereof.

18. The method of claim 14, wherein the step of etching the dielectric, gate metal, and resist layers over the bump comprises a combination of wet and dry etching techniques.

19. The method of claim 14, further comprising a step of substrate etching so as to provide for substrate posts on which the AAO posts reside.

20. A method comprising the steps of:

a) patterning a substrate;

b) depositing at least one Al stack, as an Al post, in a patterned microcavity region of the substrate;

c) conformally coating the Al post with layers of a dielectric material and a planarizable material;

d) etching the dielectric and planarizable layers over the post;

e) removing the planarizable and anodizing the posts to form a nanoporous AAO post on the substrate;

f) electrochemically depositing nanorods in the AAO posts to form nanorod/AAO posts;

g) conformally depositing: (i) a dielectric layer comprising a second dielectric material, (ii) a gate metal layer, such that the dielectric and gate metal layers form a bump in the regions over the nanorod/AAO posts, and (iii) a planarizable layer over the bumps that is subsequently planarized via reflow;

h) etching the planarizable, metal, and dielectric layers over the bump to form a via exposing the nanorod/AAO posts; and i) removing the planarizable material to form a gated emitter structure.

21. The method of claim 20, wherein the step of patterning comprises the sub-steps of: (i) depositing a layer of dielectric on the substrate; (ii) depositing a layer of resist on the layer of dielectric; (iii) lithographically patterning the resist; and (iv) etching the dielectric in regions where the resist was patterned.

22. The method of claim 20, wherein the Al stack comprises a conductive bottom layer and an Al top layer.

23. The method of claim 20, wherein the step of electrochemically-depositing nanorods involves the deposition of a material selected from the group consisting of Pt, Pd, Ni, Au, Ag, Cu, Zn, ZnO, $MoO_3/Mo_2O_3$, and combinations thereof.

24. The method of claim 20, wherein the step of conformally depositing comprises deposition of a dielectric layer selected from the group consisting of $SiO_2$, $SiN_X$, epi-i-SiC, $Al_2O_3$, undoped wide bandgap material, and combinations thereof; a gate metal layer selected from the group consisting of Nb, Pt, Al, W, Mo, Ti, Ni, Cr, TiW, and combinations thereof; and a resist layer selected from the group consisting of photoresist, UV resist, e-beam resist, and combinations thereof.

25. The method of claim 20, further comprising a step of substrate etching so as to provide for substrate posts on which the AAO posts reside.

* * * * *